US005405737A

United States Patent [19]

Shibata

[11] Patent Number: 5,405,737

[45] Date of Patent: Apr. 11, 1995

[54] SILVER HALIDE COLOR PHOTOGRAPHIC LIGHT-SENSITIVE MATERIAL COMPRISING BLUE SENSITIVE EMULSION LAYERS CONTAINING ACYLACETOAMIDE TYPE YELLOW DYE FORMING COUPLERS AND REDUCTION SENSITIZED SILVER HALIDE EMULSION

[75] Inventor: Yoshinori Shibata, Minami-ashigara, Japan

[73] Assignee: Fuji Photo Film Co., Ltd., Kanagawa, Japan

[21] Appl. No.: 944,312

[22] Filed: Sep. 14, 1992

[30] Foreign Application Priority Data

Sep. 18, 1991 [JP] Japan ..... 3-265537

[51] Int. Cl.[6] ..... G03C 7/36; G03C 1/035

[52] U.S. Cl. ..... 430/556; 430/557; 430/567; 430/603; 430/605; 430/583

[58] Field of Search ..... 430/556, 557, 558, 567, 430/569, 603, 605, 583–585

[56] References Cited

U.S. PATENT DOCUMENTS

| | | | |
|---|---|---|---|
| 4,268,591 | 5/1981 | Tschopp | 430/557 |
| 4,806,461 | 2/1989 | Ikeda et al. | 430/569 |
| 5,068,173 | 11/1991 | Takehara et al. | 430/569 |
| 5,118,599 | 6/1992 | Lau et al. | 430/558 |

FOREIGN PATENT DOCUMENTS 0447969 9/1991 European Pat. Off. .

OTHER PUBLICATIONS

Research Disclosure 17643 Dec. 1978.

*Primary Examiner*—Lee C. Wright

*Attorney, Agent, or Firm*—Birch, Stewart, Kolasch & Birch

[57] ABSTRACT

Disclosed herein is a light-sensitive material which has a high sensitivity and excels in yellow-image storage stability and pressure resistance. The material has blue-sensitive emulsion layers containing specific acylacetoamide type yellow dye-forming couplers represented by formula (I):

Formula (I)

wherein $R_1$ is a monovalent group, Q is a non-metal atom group which bonds to C to form 3- to 5-membered hydrocarbon ring and $R_1$ is not a hydrogen atom and does not bond to Q to form a ring, at least one of the blue-sensitive emulsion layers contains at least one silver halide emulsion (A) having silver halide grains, 50% or more of which contain 10 or more dislocation lines per grain.

20 Claims, 1 Drawing Sheet

SILVER HALIDE COLOR PHOTOGRAPHIC LIGHT-SENSITIVE MATERIAL COMPRISING BLUE SENSITIVE EMULSION LAYERS CONTAINING ACYLACETOAMIDE TYPE YELLOW DYE FORMING COUPLERS AND REDUCTION SENSITIZED SILVER HALIDE EMULSION

BACKGROUND OF THE INVENTION

1. Field of the Invention

The present invention relates to a silver halide color photographic light-sensitive material, and more particularly to a silver halide color photographic light-sensitive material which contains silver halide emulsions introducing a number of dislocation lines and also contains a novel yellow coupler, which has a high sensitivity and excels in processed color image stability and pressure resistance.

2. Description of the Related Art

There is a demand for a silver halide color photographic light-sensitive material (hereinafter called "light-sensitive material"), particularly one for photography use, which has a high sensitivity and excels in graininess, color reproduction and sharpness, the photographic properties of which change but a little during storage, and which excels in processed image stability.

Generally used as yellow couplers for forming color photographic images are a benzoylacetoanilide type coupler having active methylene (methine) groups, and a pivaloylacetoanilide type coupler, as is described in T. H. James "The Theory of the Photographic Process," 4th edition, pp. 354–356. However, these couplers are very problematical. They can hardly be satisfactory in terms of coloring density, dye-forming speed, dye hue and dye stability. If a coupler having high coloring density or high dye-forming speed is used for imparting a high sensitivity, hue and dye stability are very low.

As well known in the art, most silver halide emulsions containing many dislocations will exhibit a high surface sensitivity if the surface of the silver halide grains are chemically sensitized to an appropriate degree. Couplers considered to fall within this category are Burton's emulsion and the halogen-converted emulsion, described in, for example, "Fundamentals of Photographic Engineering-Silver Salt Photography," ed. the Photograph Society of Japan, Corona Press, 1978, pp. 264 and 265.

Also known in the art is that a reduction-sensitized emulsion generally exhibits a high sensitivity, as is described in, for example, "Fundamentals of Photographic Engineering-Silver Salt Photography," ed. the Photograph Society of Japan, Corona Press, 1978, pp. 90, 91, and 253.

In view of the structure of the light-sensitive material, it is desirable in some cases that silver halide grains be tabular. For instance, tabular grains are advantageous in that the sharpness will increase if the grains are arranged on the side near incident light. This is because the tabular grains are orientated with their major surfaces located parallel to the support of the light-sensitive material, so that scattering light can hardly reach the side away from the incident light. Further, since tabular grains have a great surface area-to-volume ratio, a sensitizing dye can be adsorbed to the grains in a relatively large amount per unit area, whereby the amount of light absorbed into the grains increases, making the light-sensitive material highly sensitive. These facts are described in detail in, for example, JP-A-58-113927. ("JP-A" means Published Unexamined Japanese Patent Application.)

Generally, various pressures are applied to photographic light-sensitive materials coated with silver halide emulsions. For example, negative film for general photographic use is rolled into a cartridge, bent and pulled while being fed, frame by frame while being loaded into a camera.

Sheet-like film, such as light-sensitive materials for use in printing and X-ray sensitive materials for direct use in medicine, are handled directly by people, and is often bent or curved.

Any light-sensitive material receives a high pressure when it is cut or processed.

If various pressures are applied to a photographic light-sensitive material, they are exerted on the silver halide grains through the gelatin used as binder for the silver halide grains or the plastic film used as support. When pressures are exerted to the silver halide grains, changes occur in the photographic properties of the photographic light-sensitive material, as is known in the art, or as is reported in detail in, for example, K. B. Mather, J. Opt. Soc. Am., 38 1054 (1948), P. Faelens and P. de Smet, Sci. et Ind. Phot., 25, No. 5.178 (1954), P. Faelens, J. Phot. Sci., 2, 105 (1954).

In recent years, the requirements made of silver halide emulsions for photographic use have become more and more severe. For example, it is demanded that the emulsions have not only better photographic properties such as sensitivity and higher image qualities such as graininess and sharpness, but also greater toughness such as storage stability and pressure property. Obviously, however, an increase in sensitivity is accompanied by an increase in pressure marks. Hence, an emulsion is desired which has a high sensitivity and has less pressure marks. JP-A-63-220228 discloses silver halide grains which have improved exposure-illminance dependency, storage stability and pressure property. However, these grains are not sufficiently improved in terms of pressure marks due to the film scratching taking place within a camera or caused by claws.

The research of the inventors hereof has made it clear that fog generated when pressures are applied to the light-sensitive material is increased by absorbing a sensitizing dye onto the silver halide grains. This phenomenon was particularly remarkable in the case of large tabular grains having a great surface area-to-volume ratio. A sensitizing dye may be adsorbed to the silver halide grains at a high temperature (e.g., 50° C. or more) in order to prevent desorption of the dye from the silver halide grains (particularly, at high humidity). This process will increase pressure marks. There is a method in which a sensitizing dye is adsorbed before chemical sensitization, in order to make the emulsion more sensitive. This method, however, will increase pressure marks, too.

The techniques of making silver halide emulsions more sensitive, described above, and the techniques of spectral sensitization, if employed in combination of the use of conventional yellow couplers, provide light-sensitive materials which have poor storage stability after exposed and developed and which do not have stable properties required of any practical light-sensitive material.

SUMMARY OF THE INVENTION

The object of the present invention is to provide a light-sensitive material which has a high sensitivity and excels in yellow-image storage stability and pressure resistance.

The object of the invention is attained by the silver halide color photographic light-sensitive materials described below.

(1) A silver halide color photographic light-sensitive material including blue-sensitive emulsion layers containing acylacetoamide type yellow dye-forming couplers represented by the following formula (I), at least one of which contains at least one silver halide emulsion (A) having silver halide grains, 50% or more of which contain 10 or more dislocation lines per grain, formula (I)

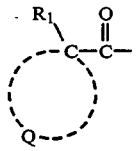

formula (I)

wherein $R_1$ is a monovalent group, Q is a non-metal atom group required for forming 3- to 5-membered hydrocarbon ring or a 3- or 5-membered hetero ring having at least one hetero atom selected from the group consisting of N, S, O and P, and $R_1$ is not a hydrogen atom and does not bond to Q to form a ring.

(2) A silver halide color photographic light-sensitive material including blue-sensitive emulsion layers containing the yellow dye-forming couplers represented by the above formula (I), at least one of which contains at least one silver halide emulsion which has been reduction-sensitized.

(3) A silver halide color photographic light-sensitive material including blue-sensitive emulsion layers containing the yellow dye-forming couplers represented by the above formula (I), at least one of which contains at least one silver halide emulsion which has been spectrally sensitized with a compound represented by the following formula (II),

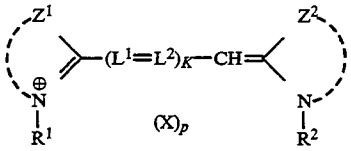

Formula (II)

The symbols in the formula (II) represent the following items.

$R^1$, $R^2$: alkyl groups in at least one of which at least one carbon atom bonds to at least three atoms other than hydrogen atoms $Z^1$, $Z^2$: atom groups required to form 5- or 6-membered hetero ring containing nitrogen $L^1$, $L^2$: substituted or unsubstituted methine groups X: anion k: 0, 1 or 2 p: integer required for balancing electric charge.

(4) A silver halide color photographic light-sensitive material including blue-sensitive emulsion layers containing the yellow dye-forming couplers represented by the above formula (I), at least one of which contains at least one silver halide emulsion which has been chemically sensitized with a gold sensitizer, a sulfur sensitizer, and a selenium sensitizer.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

DETAILED DESCRIPTION OF THE PREFERRED EMBODIMENTS

Figure 1:
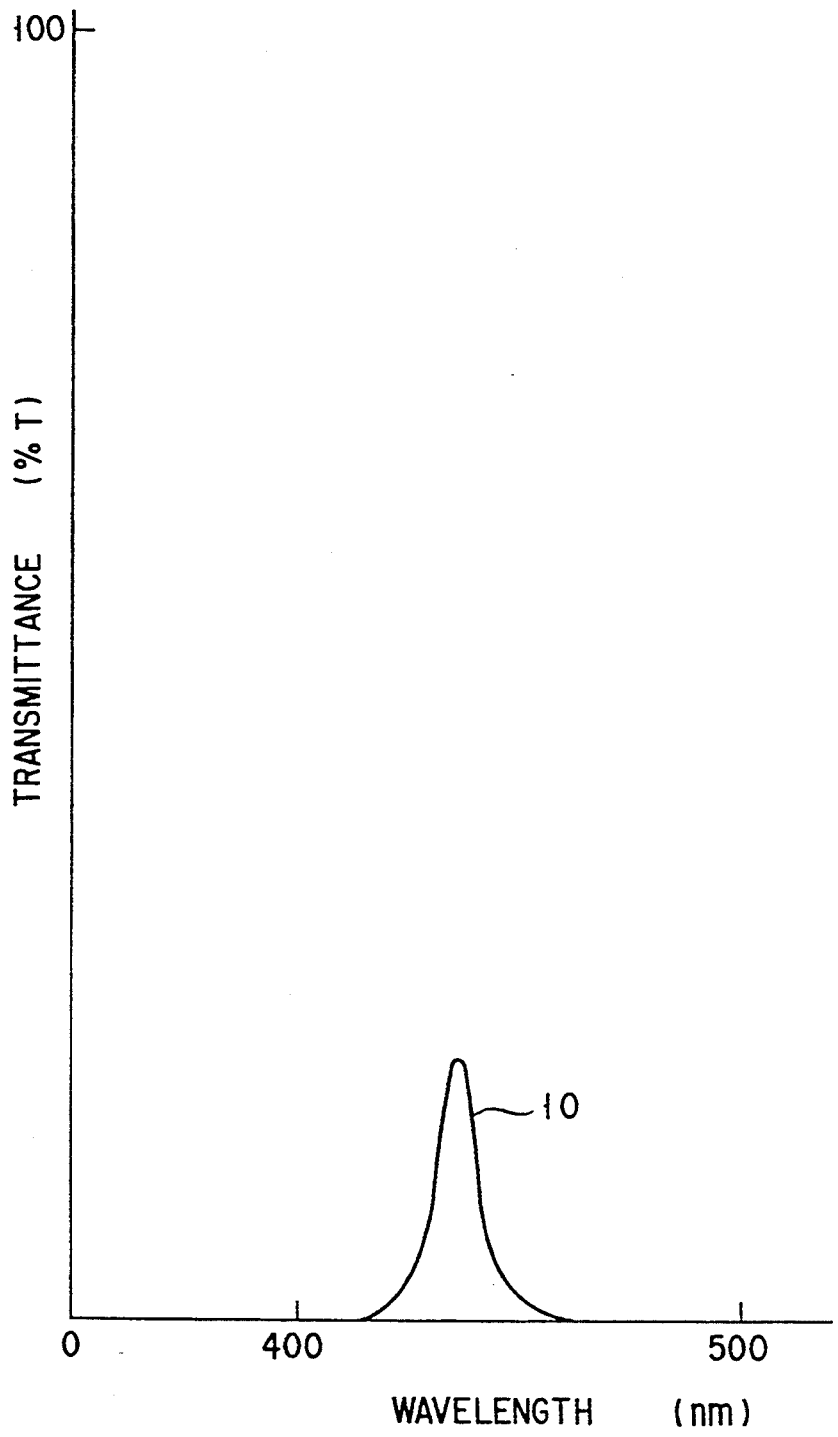
FIG. 1 is a graph showing the spectral transmission factor characteristic of the filter used to measure the relative sensitivities of samples.

Embodiments of the present invention will be described below.

Preferably, the acylacetoamide type yellow coupler is represented by the following formula (Y).

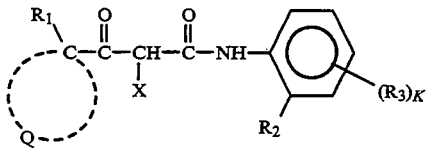

Formula (Y)

wherein $R_1$ is a monovalent group other than a hydrogen atom, Q is a non-metal atom group which bonds to C to form a 3- to 5-membered hydrocarbon ring or a 3- to 5-membered hetero ring having at least one hetero atom selected from the group consisting of N, S, O and P, $R_2$ is a hydrogen atom, a halogen atom (F, Cl, Br, or I), an alkoxy group, an aryloxy group, an alkyl group, or an amino group, $R_3$ is a group which can be substituted on a benzene ring, X is a hydrogen atom or a group (hereinafter called "leaving group") which can leave by virtue of coupling reaction with an oxidized form of an aromatic primary amine developing agent, k is an integer ranging from 0 to 4, and if k is 2 or more, groups $R_3$ may be identical or different. (The term "halogen atom" used hereinafter in describing the formula (Y) means F, Cl, Br, or I.)

Examples of $R_3$ are: a halogen atom, an alkyl group, an aryl group, an alkoxy group, an aryloxy group, an alkoxycarbonyl group, an aryloxycarbonyl group, a carbonamido group, a sulfonamido group, a carbamoyl group, a sulfamoyl group, an alkylsulfonyl group, an ureido group, a sulfamoylamino group, an alkoxycarbonylamino group, an alkoxysulfonyl group, an acyloxy group, a nitro group, a heterocyclic group, a cyano group, an acyl group, an amino group, an imido group, an alkylsufomyloxy group, an arylsulfonyloxy group, a carboxyl group, a sulfo group, a hydroxyl group (hereinafter referred to as "substituent groups A"). Examples of the leaving group are a heterocyclic group, an aryloxy group, an arylthio group, an acyloxy group, an alkylsulfonyloxy group, an arylsulfonyloxy group, a heterocyclicoxy group, and a halogen atom, each attached to a coupling active position through a nitrogen atom.

If the substituent group in the formula (Y) is an alkyl group or contains an alkyl group, the alkyl group may be a straight chain, a branch chain or cyclic, may be substituted, or contains a unsaturated bond, unless otherwise specified.

If the substituent group in the formula (Y) is an aryl group or contains an aryl group, it is an aryl group of a monocyclic or a condensed-ring aryl group which may be substituted, unless otherwise specified.

If the substituent group in the formula (Y) is a heterocyclic group or contains a heterocyclic group, it is a heterocyclic group of a 3- to 8-membered monocyclic or condensed-ring heterocyclic group which may be substituted and includes at least one heterocyclic group selected from the group consisting of O, N, S, P, Se and Te, unless otherwise specified.

Substituent groups suitable for use in the formula (Y) will now be explained.

In the formula (Y), $R_1$ is preferably a halogen atom, a cyano group, a monovalent group which can be substituted or and has a total carbon number (herein after referred to as "C number") of 1 to 30 (e.g., an alkyl group or an alkoxy group), or a monovalent group which has a C number of 6 to 30 (e.g., an aryl group or an aryloxy group). Examples of substituents for these are: a halogen atom, an alkyl group, an alkoxy group, a nitro group, an amino group, a carbonamido group, a sulfonamide group, and an acyl group.

In the formula (Y), Q is preferably a non-metal atom group which may be substituted and form, along with C, a 3- to 5-membered hydrocarbon ring which can be substituted and which has a C number of 3 to 30, or a heterocyclic ring which includes at least one hetero atom selected from the group consisting of N, S, O and P and which has a C number of 2 to 30. The ring which Q and C form may have an unsaturated bond. Examples of the ring which Q and C form are: a cyclopropane ring, a cyclobutane ring, a cyclopentane ring, a cyclopropene ring, a cyclobutene ring, a cyclopentene ring, an oxetane ring, an oxolane ring, 1,3-dioxolane ring, a thietane ring, a thiolane ring, and a pyrrolidine ring. Examples of the substituent group are: a halogen atom, a hydroxyl group, an alkyl group, an aryl group, an acyl group, an alkoxy group, an aryloxy group, a cyano group, an alkoxycarbonyl group, an alkylthio group, and an arylthio group.

In the formula (Y), $R_2$ is preferably a halogen atom, an alkoxy group having a C number of 1 to 30, an aryloxy group having a C number of 6 to 30, an alkyl group having a C number of 1 to 30, or an amino group having a C number of 0 to 30. Each of these groups may be substituted. Examples of the substituent group for these groups are: a halogen atom, an alkyl group, an alkoxy group, and an aryloxy group.

In the formula (Y), $R_3$ is preferably a halogen atom, an alkyl group having a C number of 1 to 30, an aryl group having a C number of 6 to 30, an alkoxy group having a C number of 1 to 30, an alkoxycarbonyl group having a C number of 2 to 30, an arylkoxycarbonyl group having a C number of 7 to 30, a carbonamido group having a C number of 1 to 30, a sulfonamide group having a C number of 1 to 30, a carbamoyl group having a C number of 1 to 30, a sulfamoyl group having a C number of 0 to 30, an alkylsulfonyl group having a C number of 1 to 30, an arylsulfonyl group having a C number of 6 to 30, an ureido group having a C number of 1 to 30, a sulfamoylamino group having a C number of 0 to 30, an alkoxycarbonylamino group having a C number of 2 to 30, a heterocyclic group having a C number of 1 to 30, an acyl group having a C number of 1 to 30, an alkylsulfonyloxy group having a C number of 1 to 30, and an arylsulfonyloxy group having a C number of 6 to 30. Each of these groups may be substituted. Examples of the substituent group for these groups are those selected from the "substituent groups A" described above.

In the formula (Y), k is preferably an integer of 1 or 2, and the position of the substituent group $R_3$ is preferably the meta-position or para-position in the following formula:

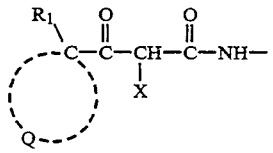

In the formula (Y), X is preferably a heterocyclic group or an aryloxy group which attached at a coupling active position through a nitrogen atom.

If X is a heterocyclic group, X is preferably a group of a 5- to 7-membered, monoyclic or condensed hetero ring, which may be substituted. Examples of this hetero ring are: succinimide, maleinimide, phthalimide, diglycolimide, pyrrole, pyrazole, imidazole, 1,2,4-triazole, tetrazole, indole, indazole, benzimidazole, benzotriazole, imidazolidine-2,4-dione, oxazolidine-2,4-one, thiazoline-2,4-dione, imdazolidine-2-one, oxazolidine-2-one, thiazolidine-2-one, benzimidazoline-2-one, benzoxazoline-2-one, benzothiazoline-2-one, 2-pyrroline-5-one, 2-imidazoline-5-one, indoline-2,3-dione, 2,6-dioxypurine, parabanic acid, 1,2,4-triazolidine-3,5-dione, 2-pyridone, 4-pyridone, 2-pyrimidone, 6-pyridazone-2-pyrazone, 2-amino-1,3,4-thiazolidine, and 2-imino-1,3,4-thiazolidine-4-one. These hetero rings may be substituted. Examples of the substituent group for these hetero rings are those selected from the "substituent groups A" described above.

If X is an aryloxy group, X is preferably an aryloxy group having a C number of 6 to 30 and may be substituted by a group selected from those substituent groups specified above which may be used if X is a hetero ring. Preferable as substituent group for the aryloxy group are: a halogen atom, a cyano group, a nitro group, a carboxyl group, a trifluoromethyl group, an alkoxycarbonyl group, a carbonamido group, a sulfonamide group, a carbamoyl group, a sulfamoyl group, an alkylsulfonyl group, and an arylsulfonyl group.

Substituent groups which are particularly preferred for use in the formula (Y), will now be described.

$R_1$ is preferably a halogen atom or an alkyl group having a C number of 1 to 5. Most preferably it is methyl, ethyl, or n-propyl. Particularly preferable as Q is a non-metal atom group which form, together with C, a 3- to 5-membered hydrocarbon ring. Examples of the non-metal atom group are: $—(CR_2)_2—$, $—(CR_2)_3—$, and $—(CR_2)_4—$, where R is a hydrogen atom, a halogen atom or an alkyl atom. R's may be identical or different, and $CR_2$'s may be the same or different.

Most preferably, Q is $—(CR_2)_2—$ which combines with C, forming a 3-membered ring.

It is desirable that $R_2$ be a chlorine atom, a fluorine atom, an alkyl group having a C number of 1 to 6 (e.g., methyl, trifluoromethyl, ethyl, isopropyl, or t-butyl), an alkoxy group having a C number of 1 to 8 (e.g., methoxy, ethoxy, methoxyethoxy, or butoxy), or an aryloxy group having a C number of 6 to 24 (e.g., phenoxy, p-tolyloxy, or p-methoxyphenoxy). Of these, the most preferable is a chlorine atom, a methoxy group, or a trifluoromethyl group.

Particularly preferable as $R_3$ are: a halogen atom, an alkoxy group, an alkoxycarbonyl group, an aryloxycarbonyl group, a carbonamido group, a sulfonamide group, a carbamoyl group, and a sulfamoyl group. Of these, the most preferable is an alkoxy group, an alkoxycarbonyl group, a carbonamido group, or a sulfonamido group.

Particularly preferable as X are: a 5-membered heterocyclic group (e.g., imidazolidine-2,4-dione-3-yl or oxazolidine-2,4-dione-3-yl) or an aryloxy group, which is attached to a coupling active position through a nitrogen atom. Of these, the most preferable is imidazolidine-2,4-dione-3-yl.

The coupler represented by the formula (Y) may be a dimer or a polymer, in which substituent groups $R_1$, Q's, X's, or groups specified below are coupled through a group or groups having valence of 2 or more. In this case, each of the substituent groups used may have a C number falling outside the range specified above.

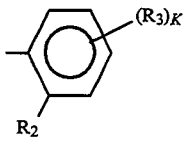

Specific examples of the various substituent groups in the formula (Y) are as follows:

Examples of $R_1$ formed of $R^1$, Q and C.

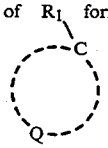

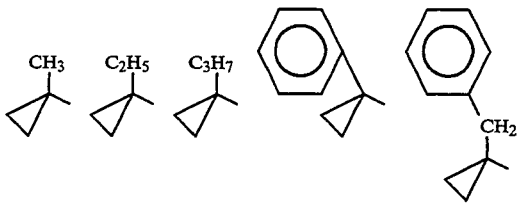

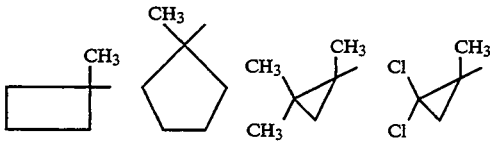

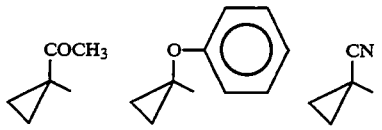

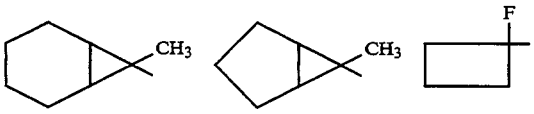

-continued

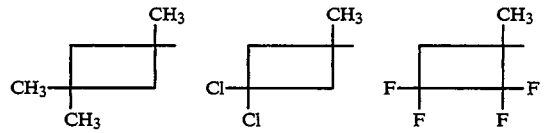

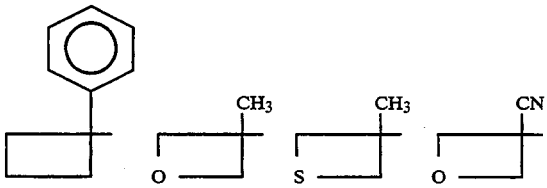

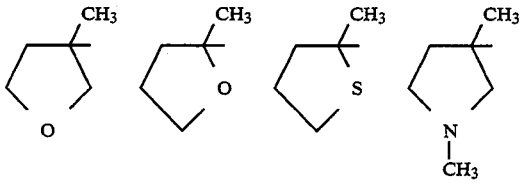

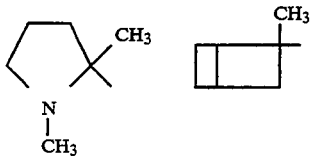

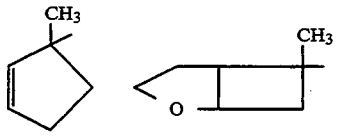

(2) Examples of $R^2$

F, Cl, Br, I, $CH_3O$—, 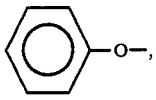

,

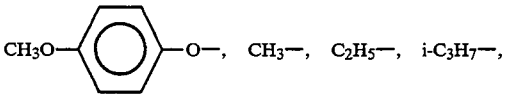

, $CH_3$—, $C_2H_5$—, i-$C_3H_7$—, t-$C_4H_9$—, $CH_3OCH_2CH_2O$—, $CF_3$—, $(CH_3)_2N$—,

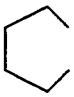

n-$C_4H_9O$—, n-$C_{14}H_{29}O$—, n-$C_{16}H_{33}O$—,

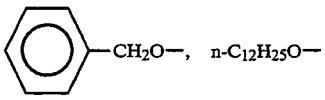

, n-$C_{12}H_{25}O$—

(3) Examples of $R^3$

F, Cl, Br, I, —$OCH_3$, —$OC_{12}H_{25}$, —$OC_{16}H_{33}$

—$COOCH_3$, —$COOC_{12}H_{25}$, —$COO\overset{CH_3}{\overset{|}{C}}HCOOC_{12}H_{25}$ -continued
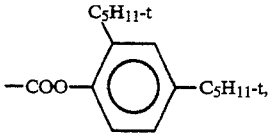
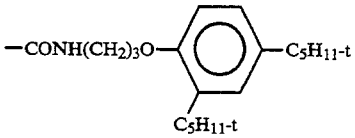
$-SO_2NH(CH_2)_3OC_{12}H_{25}$, 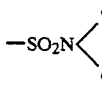 , 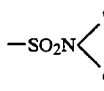
$-SO_2NHCOC_2H_5$, $-NHCOC_{13}H_{27}$, $-NHCOCHC_8H_{17}$ ($C_6H_{13}$)
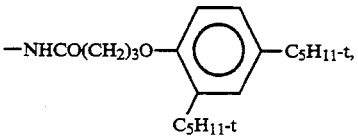
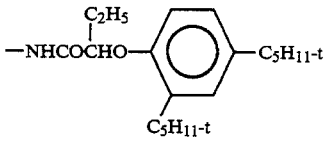
$-NHCOCHCH_2SO_2C_{12}H_{25}$ ($CH_3$), $-NHSO_2C_{16}H_{33}$
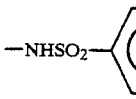 , 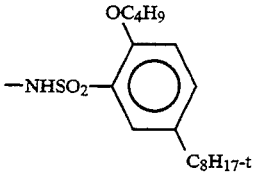
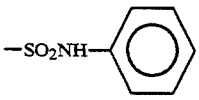 , $-SO_2NHC_3H_{17}$-i, $-OCOC_{15}H_{31}$
$-OSO_2C_{16}H_{33}$, $-SO_2OC_{12}H_{25}$, $-NHCOOC_{12}H_{25}$
(4) Examples of X
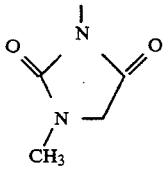
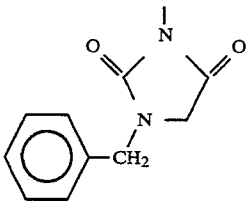
-continued
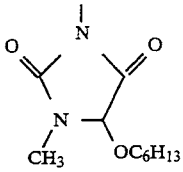
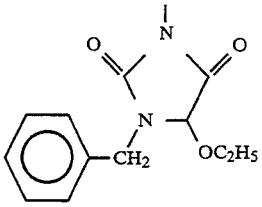
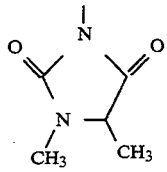
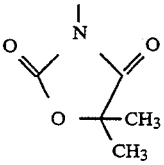
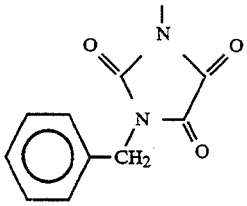
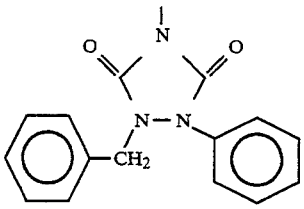
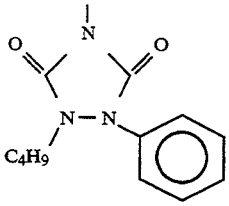
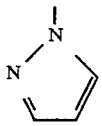
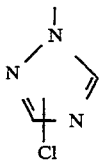
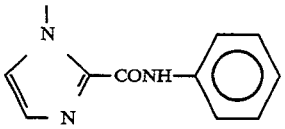
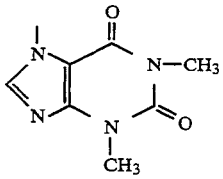
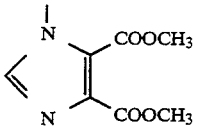
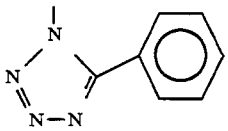
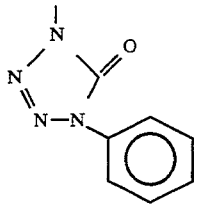
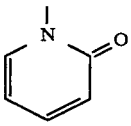
H Cl Br I $-OCOCH_3$ $-OSO_2CH_3$
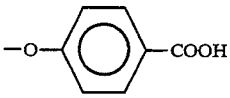
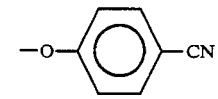

-continued
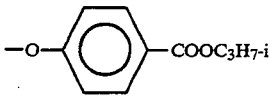
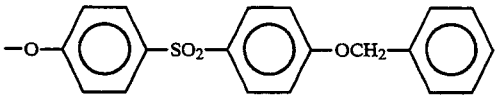
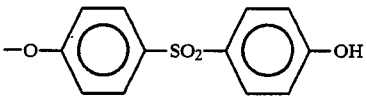
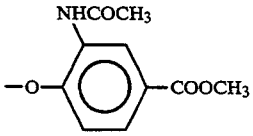
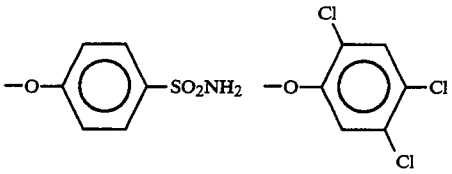
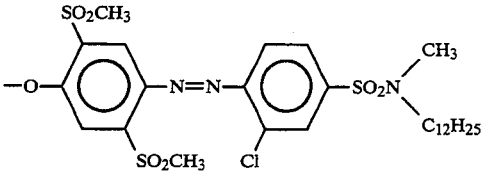
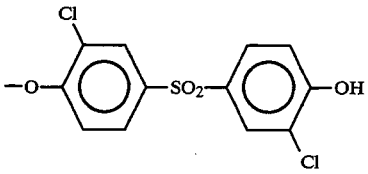
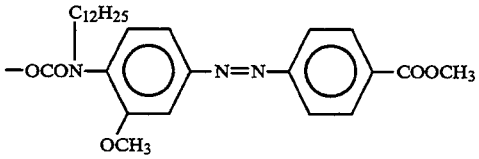
-continued
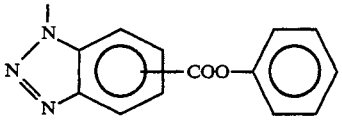
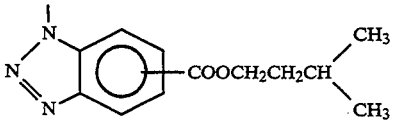
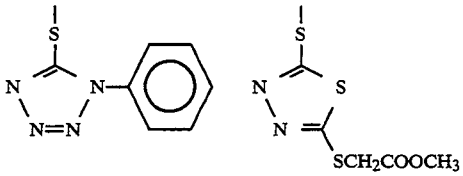
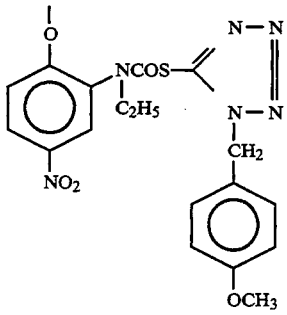
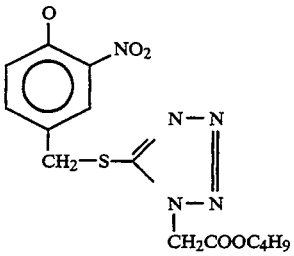
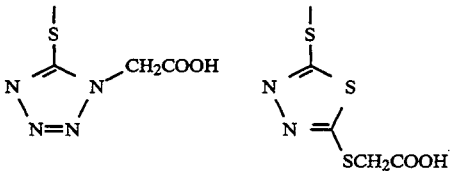
Specific examples of the yellow coupler represented by the formula (Y) are as follows:

Y-1
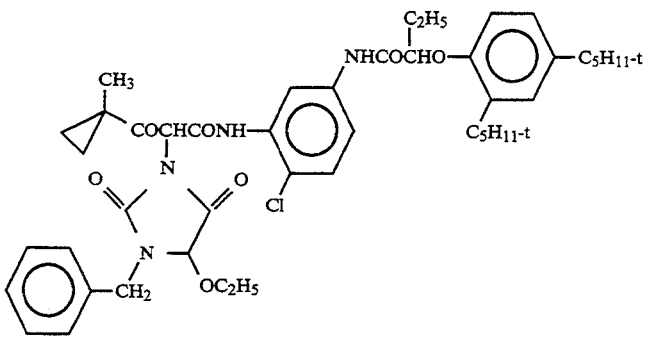
Y-2
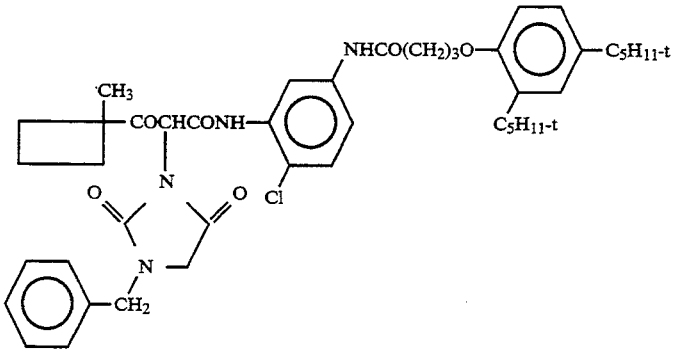
Y-3
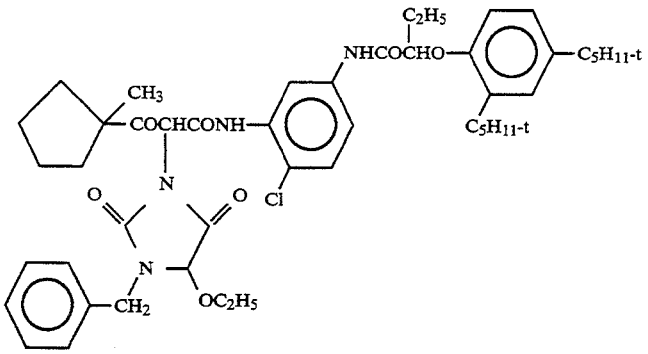
Y-4
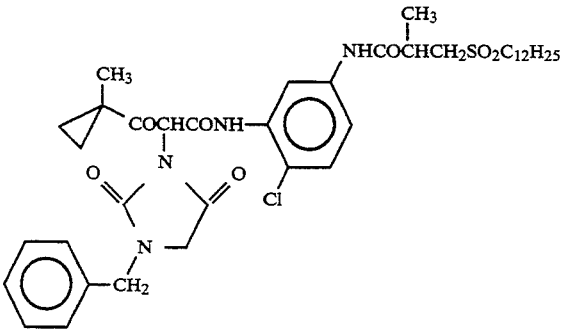

-continued
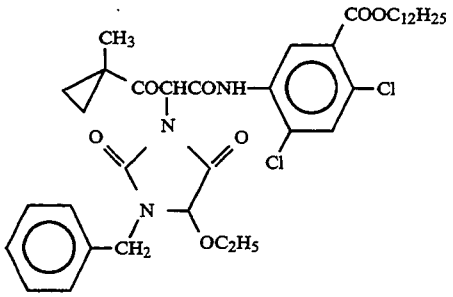
Y-5
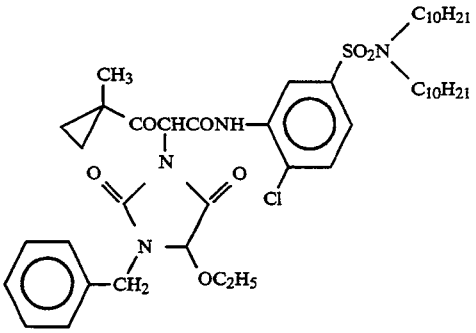
Y-6
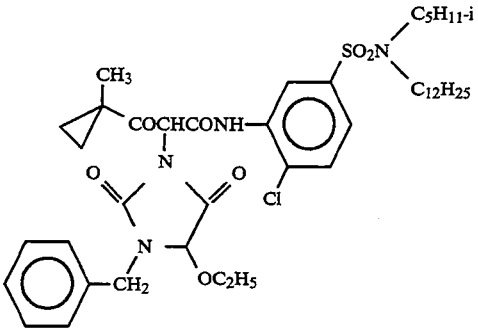
Y-7
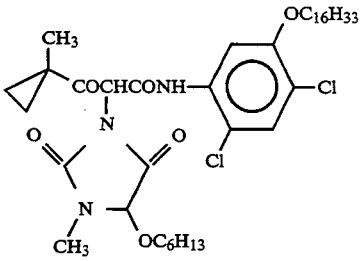
Y-8
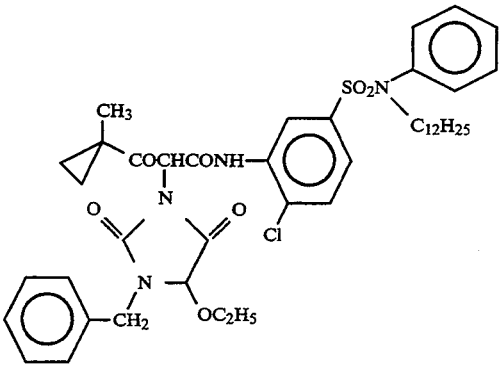
Y-9

-continued
Y-10
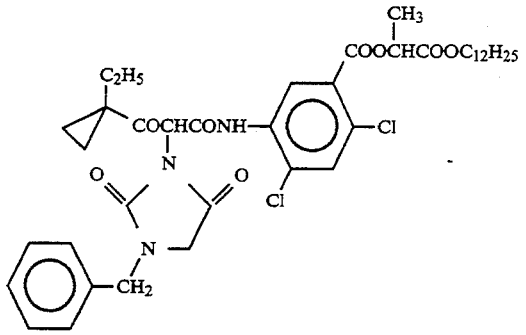
Y-11
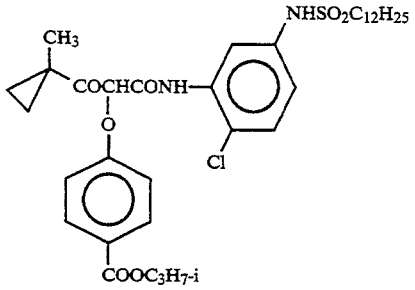
Y-12
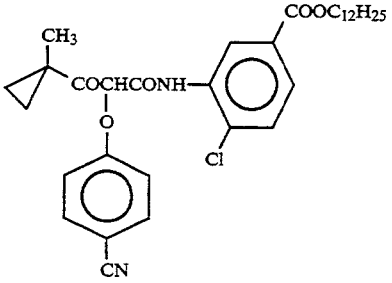
Y-13
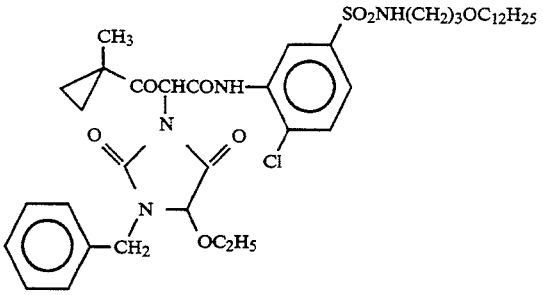
Y-14
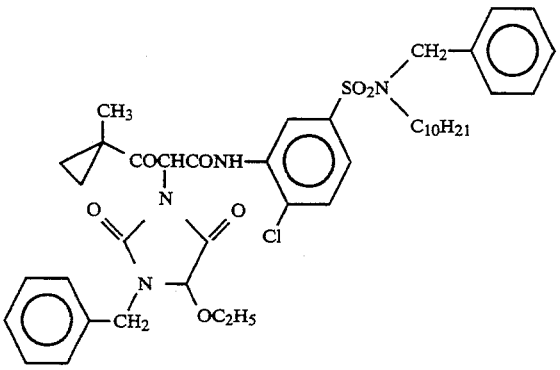

-continued
Y-15
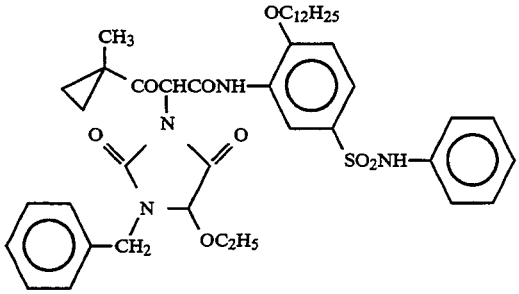
Y-16
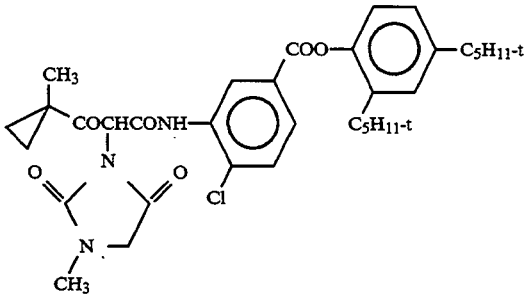
Y-17
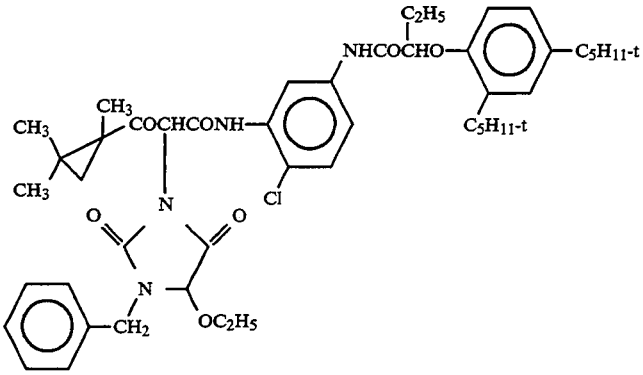
Y-18
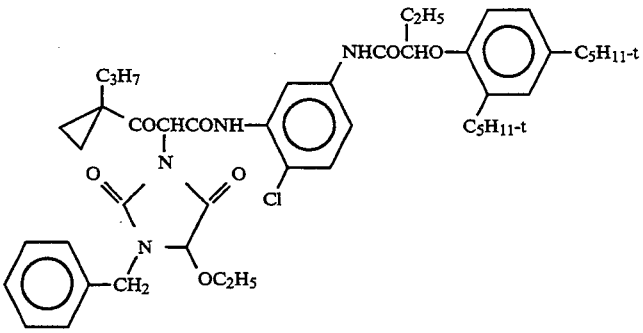
Y-19
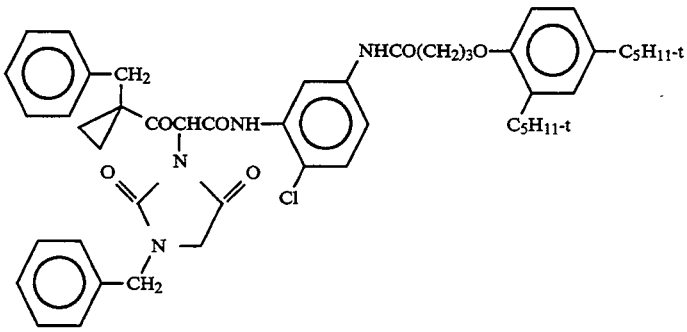

-continued
Y-20
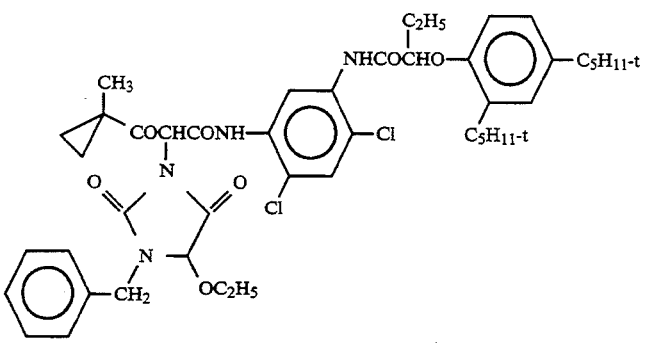
Y-21
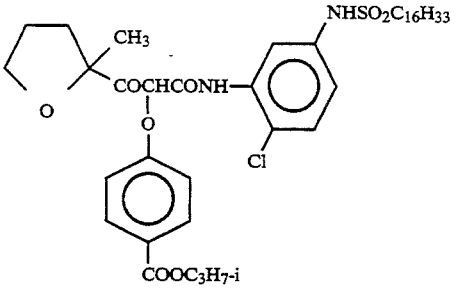
Y-22
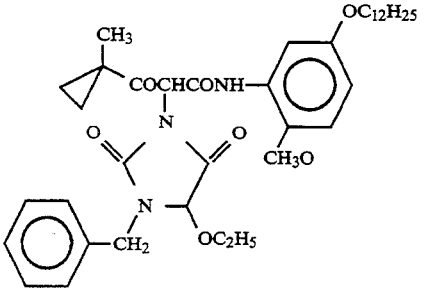
Y-23
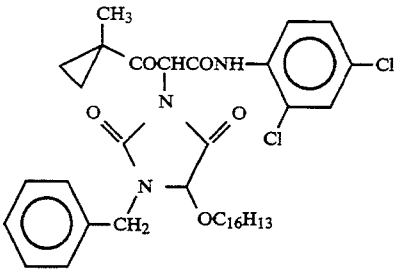
Y-24
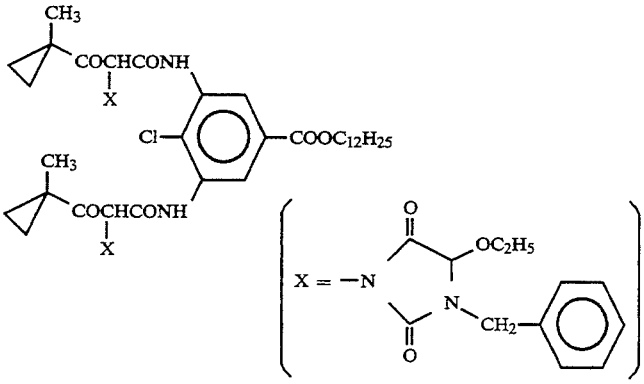

-continued
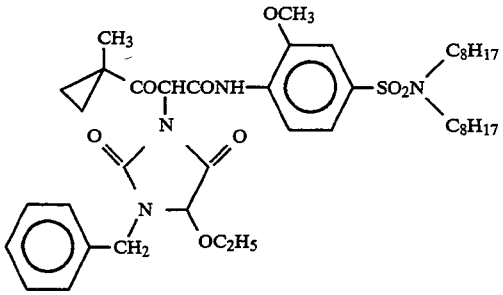
Y-25
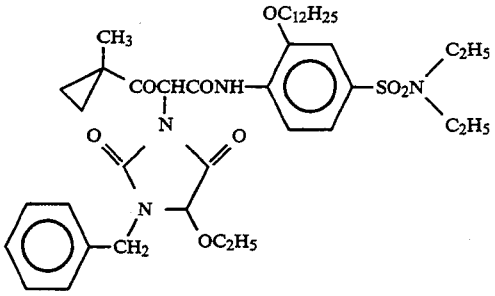
Y-26
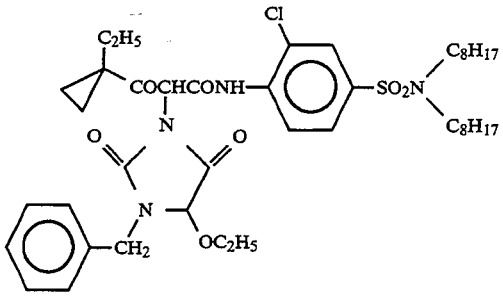
Y-27
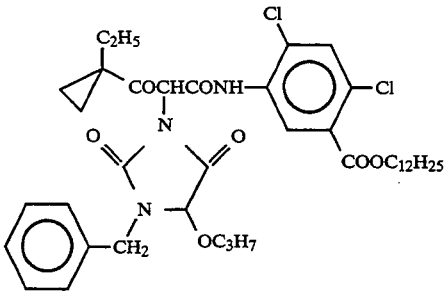
Y-28
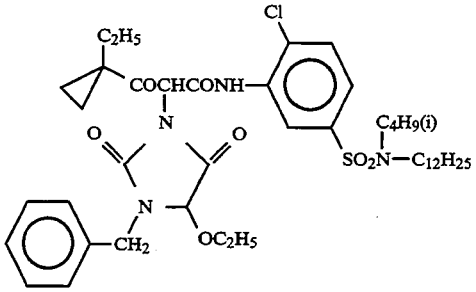
Y-29

-continued
Y-30
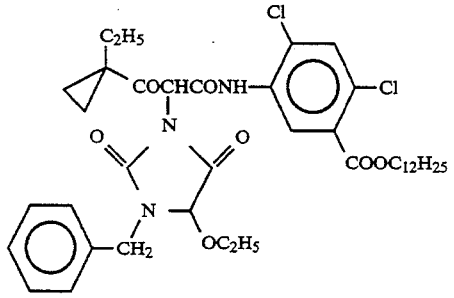
Y-31
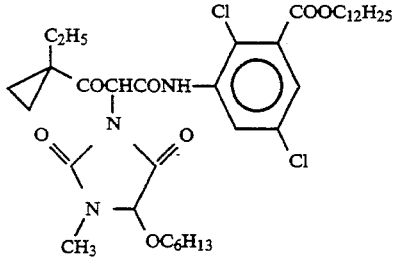
Y-32
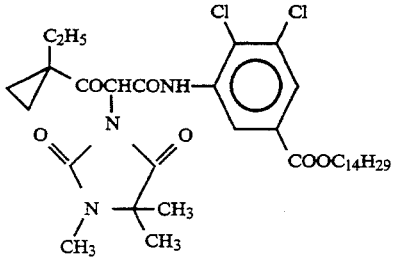
Y-33
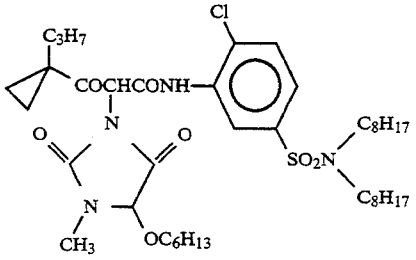
Y-34
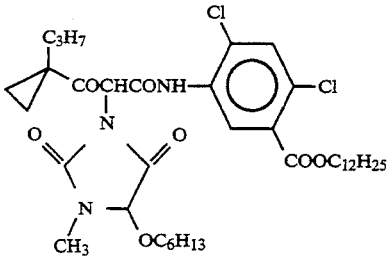
Y-35
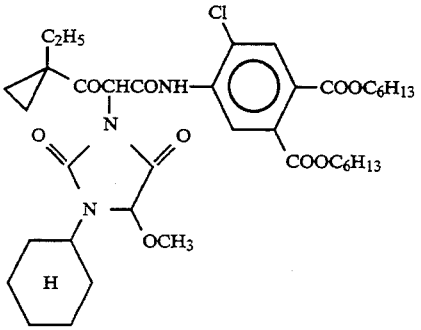

-continued
Y-36
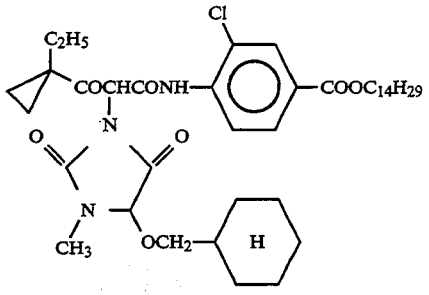
Y-37
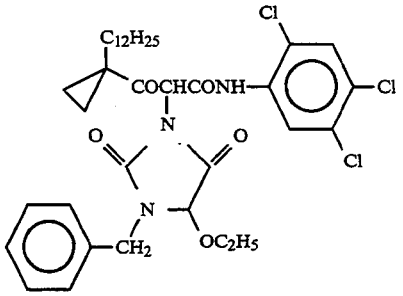
Y-38
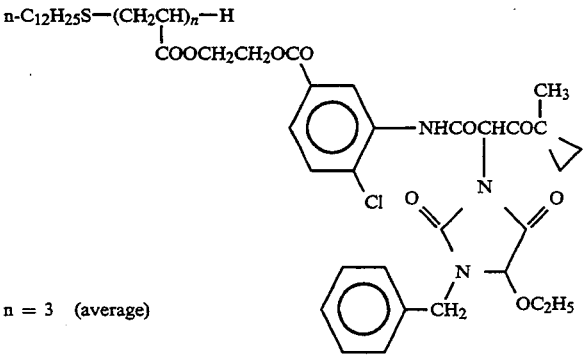
n = 3 (average)
Y-39
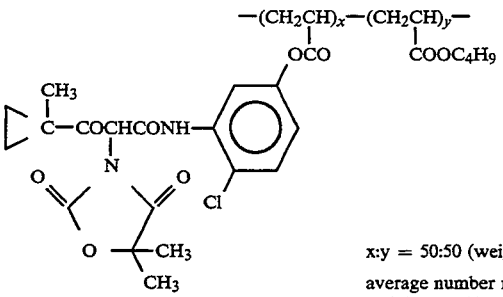
x:y = 50:50 (weight ratio)
average number molecular weight: 50,000
Y-40
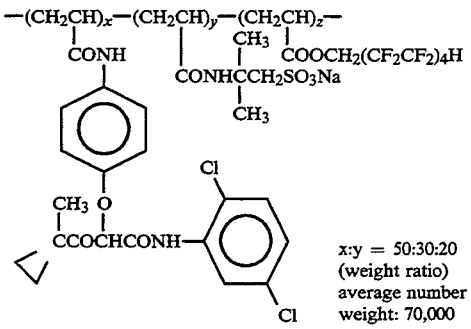
x:y = 50:30:20 (weight ratio)
average number molecular weight: 70,000
Yellow couplers represented by the formula (Y) can be synthesized by synthesizing carboxylic acid of the following formula (A) and by performing the known

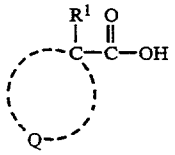

Formula (A)

Carboxylic acid represented by the formula (A) can be synthesized by the methods disclosed in, for example, J. Chem. Soc. (C), 1968, 2548, J. Am. Chem. Soc., 1934, 56, 2710, synthesis, 1971, 258, J. Org. Chem., 1978, 43, 1729, CA, 1960, 66, 18533y.

In the manufacture of the silver halide grains, which characterize the present invention, reduction sensitization is carried out during the growing of the silver halide grains. The term "during the growing" means "during the physical ripening of silver halide grains," "during the addition of water-soluble silver salt and water-soluble alkali halogenide" (i.e., precipitation), and "during the precipitation process after the reduction sensitization performed while suspending the addition of the silver salt and the alkali halogenide."

The reduction sensitization for use in the present invention can be a method of adding a reduction sensitizer to a silver halide emulsion, a method called "silver ripening" in which grains are grown or ripened in a low-pAg atmosphere having a pAg value of 1 to 7, or a method called "high-pH ripening" in which grains are grown or ripened in a high-pH atmosphere having a pH value of 5.7 to 11. Alternatively, two or more methods can be used in combination.

The method of adding a reduction sensitizer is preferable in that it can minutely control the the level of reduction sensitization.

Known as reduction sensitizers are, for example, stannate, amines, polyamines, hydrazine derivatives, formamidinesulfinic acid, silane compounds, and borane compounds. Any reduction sensitizer selected from these known ones can be used in the present invention. Two or more compounds can be used in combination in the invention. Preferable as reduction sensitizers are stannous chloride, thiourea dioxide, dimethylamineborane, and L-ascorbic acid. More preferably, thiourea dioxide and L-ascorbic acid were used as reduction sensitizer. The amount in which to added the reduction sensitization in this invention should be determined from the conditions in which the emulsion is manufactured. The appropriate range of the amount is $10^{-7}$ to $10^{-3}$ per mol of silver halide.

The reduction sensitizer is dissolved in, for example, water, alcohol, gylcol, ketone, ester, or amide, thus forming a solution. The solution is added during the growing of grains. Although the solution can be introduced into the reaction vessel beforehand, the method of adding the solution at a proper time during the growth of silver halide grains. Alternatively, the reduction sensitizer may be added to an aqueous solution of water-soluble silver salt or water-soluble alkali halide, and the resultant solution may be applied, thereby precipitating silver halide grains. Another preferable method is to add the reduction sensitizer solution several times, in portions, or continuously over a long time, as while the silver halide grains are growing.

It is desirable that the reduction sensitization be conducted in the presence of a compound represented by the following formula (III), (IV) or (V):

$R—SO_2S—M$ Formula (III)

$R—SO_2S—R^1$ Formula (IV)

$RSO_2S—L_m—SSO_2—R^2$ Formula (V)

In the formulas R, $R^1$, and $R^2$ may be the same or different, and are aliphatic groups, aromatic groups, or heterocyclic groups. M is a cation. L is a divalent linking group. The notation of m is 0 or 1.

The compounds of the formulas (III) and (IV) may be polymers containing divalent groups derived from the structures shown by the formulas (III) to (v), which are used as repeating units. If possible, R, $R^1$, $R^2$, and L may bond together, forming a ring.

The compounds of the formulas (III), (IV) and (V) will now be described in more detail. If R, $R^1$, and $R^2$ are aliphatic groups, they are saturated or unsaturated aliphatic groups in the shape of straight chains, branches or rings. Preferably, they are alkyl groups having 1 to 22 carbon atoms, alkenyl groups having 2 to 22 carbon atoms, or alkynyl groups having 2 to 22 carbon atoms, which may be substituted. Examples of the alkyl group are: methyl, ethyl, propyl, butyl, pentyl, hexyl, octyl, 2-ethylhexyl, decyl, dodecyl, hexadecyl, octadecyl, cyclohexyl, isopropyl, and t-butyl.

Examples of alkenyl group are allyl and butenyl.

Examples of alkynyl group are propargyl and butynyl.

If R, $R^1$, and $R^2$ are aromatic groups, they may be aromatic groups of monocyclic or condensed rings which preferably have 6 to 20 carbon atoms each. Examples of these are phenyl and naphthyl, which may be substituted.

If R, $R^1$, and $R^2$ are heterocyclic groups, they are 3- to 15-membered rings, more preferably 3- to 6-membered ones, each having at least one element selected from the group consisting of nitrogen, oxygen, sulfur, selenium and tellurium and also having at least one carbon atom. Examples of these rings are: pyrrolidine, piperidine, pyridine, tetrahydrofuran, thiophene, oxazole, thiazole, imidazole, benzothiazol, benzoxazole, benzimidazole, selenazole, benzoselenazole, tellurazole, triazole, benzotriazole, tetrazole, oxadiazole, and thiodiazole.

Substituent groups for R, $R^1$, and $R^2$ are, for example, an alkyl group (e.g., methyl, ethyl or hexyl), an alkoxy group (e.g., methoxy, ethoxy or octyl), an aryl group (e.g., phenyl, naphthyl or tolyl), a hydroxy group, a halogen atom (fluorine, chlorine, bromine or iodine), an aryloxy group (e.g., phenoxy), an alkylthio group (e.g., methylthio or butylthio), an arylthio group (e.g., phenylthio), an acyl group (e.g., acetyl, propionyl, butyryl or valeryl), a sulfonyl group (e.g., methylsulfonyl or phenylsulfonyl), an acylamino group (e.g., acetylamino or benzoylamino), a sulfonylamino group (e.g., methanesulfonylamino or benzensulfonylamino), an acyloxy group (e.g., acetoxy or benzoxy), a carboxyl group, a cyano group, a sulfo group, an amino group, $—SO_2SM$ group, and $SO_2R^1$ group.

The divalent linking group represented by L is either an atom or an atom group containing at least one element selected from the group consisting of C, N, S and O. More specifically, it is an alkylnene group, an alkenylene group, an arylene group, —O—, —S—, —NH—, —CO—, $—SO_2—$, or a combination of these.

Preferably, L is a divalent aliphatic group or a divalent aromatic group. Examples of the divalent aliphatic group for L are as follows:

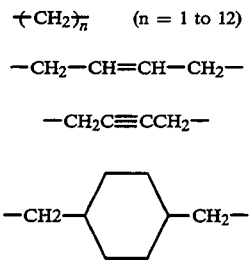

Another example of the divalent aliphatic group is xylylene. L may be a divalent aromatic group such as a phenylene group or a naphthylene group.

These substituent groups may be substituted by those substituent groups which have been described above.

Preferable as M is a metal ion or an organic cation. Examples of the metal ion are: a lithium ion, a sodium ion, and a potassium ion, Examples of the organic cations are: an ammonium ion (e.g., ammonium, tetramethyl ammonuium or tetrabutyl ammonium), a phosphonium ion (e.g., tetraphenylphosphonium) and guanidyl group.

If the formulas (III) to (v) represent polymers, the repeating units of these are, for example, as follows:

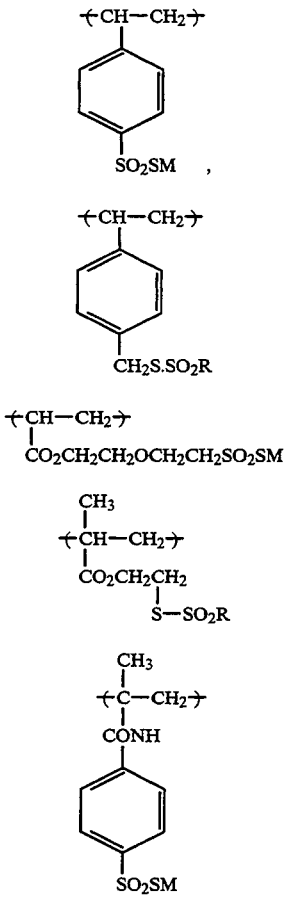

These polymers may be homopolymers or copolymers each formed of different monomers.

Specific examples of a compound represented by the formula (III), (IV) or (V) will be shown in Table A presented later. Nonetheless, these compounds are not limited to those specified in Table A.

The compounds of the formula (III) can easily be synthesized by the methods referred to in JP-A-54-1019, British Patent 972,211, Journal of Organic Chemistry, Vol. 53, p. 396 (1988), and Chemical Abstracts, Vol. 59, 9776e.

The compound represented by the formula (III), (IV) or (V) is added, preferably in an amount of $10^{-7}$ to $10^{-1}$ mol per mol of silver halide, more preferably $10^{-6}$ to $10^{-2}$ mol/mol Ag, and still more preferably $10^{-5}$ to $10^{-3}$ mol/mol Ag.

To add the compounds of the formulas (III) to (V) during the manufacture of the emulsion, the method can be used which is usually employed to add additives to a photographic emulsion. For example, a water-soluble compound is added in the form of an aqueous solution having an appropriate concentration. A compound which cannot be or can hardly be dissolved in water is added in the form of a solution, or dissolved in a solvent which will not adversely influence photographic properties, such as organic solvent capable of mixing with water, e.g., alcohol, glycol, ketone, ester or amide.

The compound represented by the formula (III), (IV) or (V) can be present at any stage of the reduction sensitization carried out during the growing of grains.

The compound, which is most preferred for use in the present invention, is the compound represented by the formula (III).

Preferably, the emulsion used in the silver halide photographic light-sensitive material according to the invention contains a compound of the following formula (II), which is used as a spectral sensitizer, in the emulsion:

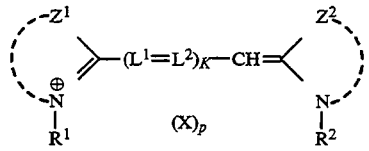

Formula (II)

In the formula (II), $R^1$ and $R^2$ are alkyl groups. Examples of the alkyl groups represented by $R^1$ and $R^2$ are alkyl groups, each having 1 to 18 carbon atoms, preferably 1 to 7 carbon atoms, more preferably 1 to 4 carbon atoms. Among these alkyl groups are: a unsubstituted alkyl group (e.g., methyl, ethyl, propyl, isopropyl, butyl, isobutyl, hexyl, octyl, dodecyl or octadecyl); a substituted alkyl group such as a aralkyl group (e.g., benzyl or 2-phenylethyl), a hydroxyalkyl group (e.g., 2-hydroxyethyl or 3-hydroxypropyl), a carboxyalkyl group (e.g., 2-carboxyethyl, 3-carboxypropyl, 4-carboxybutyl, or caboxymethyl), an alkoxyalkyl group (e.g., 2-methoxyethyl or 2-(2-methoxyethoxy)ethyl), a sulfoalkyl group (e.g., 2-sulfoethyl, 3-sulfopropyl, 3-sulfobutyl, 4-sulfobutyl, 2-(3-sulfopropoxy)ethyl, 2-hydroxy-3-sulfopropyl, 3-sulfopropoxyethoxhyethyl), a sulfatoalkyl group (e.g., 3-sulfatopropyl and 4-sulfatobutyl); and a heterocyclic-substituted alkyl group (e.g., 2-(pyrrolidine-2-one-l-yl)ethyl or tetrahydrofurfuryl), 2-acetoxylethyl carbomethoxymethyl, 2-methanesulfonylaminoethyl, or an allyl group.

If either $R^1$ or $R^2$ is an alkyl group, or preferably both $R^1$ and $R^2$ are alkyl groups, they have at least one carbon atom which bonds to at least three atoms which are not hydrogen atoms. At least one of $R^1$ or $R^2$ is an alkyl group having an organic acid group, and is represented by the following formula (VI):

$$\text{-}(CH-CH_2)_m-\underset{\underset{A}{|}}{CH}-(CH_2)_n-CH_3 \qquad \text{Formula (VI)}$$

In the formula (VI), A is an organic acid group, and m and n are integers ranging from 0 to 5.

Examples of alkyl group $R^1$ and/or alkyl group $R^2$, which has at least one carbon atom which bonds to at least three atoms other than hydrogen atoms, are: 2-methylpropyl, t-butyl, 2-methylbutyl, 1,1-dimethylpropyl, 3-methylbutyl, 1,2-dimethylpropyl, 2-methylpentyl, 1,1-dimethylbutyl, 1-isopropylpropyl, 3-methylpentyl, 1,2-dimethylbutyl, 1-ethyl-1methylpropyl, 4-methylpentyl, 1,3-dimethylbutyl, 1,1-dimethylpentyl, 1-isopropylbutyl, 1,4-dimethylpentyl, 1-methylpropyl, 1-methylbutyl, 1-methylpentyl, 2-methylhexyl, 1-methyl-4,4-dimethylpentyl, 3,4,4-trimethylpentyl, 3,5,5-trimethylhexyl, 3-carboxy-1-methylpropyl, 3-carboxybutyl, 3-carboxy-1-methylbutyl, 3carboxy-1,1-dimethylpropyl, 4-carboxy-3-methylbutyl, 2-carboxy-2-methylpropyl, 3-carboxy-2-methylpropyl, 1-methyl-3-sulfopropyl, 3-carboxy-2-methylpropyl, 1-methyl-3-sulfopropyl, 3-sulfobutyl, 3-methyl-4-sulfobutyl, 1-methyl-3-sulfobutyl, 1,1-dimethyl-3-sulfopropyl, 2-methyl-2-sulfopropyl, and 2-methyl-3-sulfopropyl. In the formula (VI), preferably, m is 2 or 3, n is 0 or 1, and A is sulfo group, more preferably m is 2 and n is 0.

Examples of the organic group A in the formula (VI) are, for example, a carboxy group, a sulfo group and a phosphoryl group.

The anion represented by X is, for example, a halogen anion ($Cl^-$, $Br^-$ or $I^-$), alkylsulfate (e.g., methylsulfate or ethylsulfate), arylsulfonate (e.g., benzenesulfonate, toluenesulfonate, 4-chlorobenzenesulfonate, or naphthalene-1,5-disulfonate), perchlorate, or alkylcarboxylate (e.g., acetate or propionate).

The notation of p has the value of 0 or 1 for balancing the electric charge; p is 0 in the case where a salt is formed within the molecule.

Examples of the 5- or 6-membered hetero ring formed of $Z^1$ and $Z^2$ are: a thiazole nucleus (e.g., thiazole, 4-methylthiazole, 4-phenylthiazole, 4,5-dimethylthiazole, or 4,5-diphenylthiazole); a benzothiazole nucleus (e.g., benzothiazole, 4-chlorobenzothiazole, 5-chlorobenzothiazole, 6-chlorobenzothiazole, 5-nitrobenzothiazole, 4 -methylbenzothiazole, 5-methylbenzothiazole, 6-methylbenzothiazole, 5-bromobenzothiazole, 6-bromobenzothiazole, 5- iodobenzothizole, 5-phenylbenzothiazole, 5-methoxybenzothiazole, 6-methoxybenzothiazole, 5-ethoxycarbonylbenzothiazole, 5-ethoxycarbonylbenzothiazole, 5-carboxybenzothiazole, 5 -phenetylbenzothiazole, 5-fluorobenzothiazole, 5-chloro-6-methylbenzothiazole, 5,6-dimethylbenzothiazole, 5-hydroxy-6-methylbenzothiazole, tetrahydrobenzothiazole, 4-phenylbenzothiazole, or 5-styrylbenzothiazole); a naphthothiazole nucleus (e.g., naphtho[2,1-d]thiazole, naphtho[2,3-d]thiazole, 5-methoxynaphtho[1,2-d]thiazole, 7-ethoxynaphtho[2,1-d]thiazole, 8-methoxynaphtho[2,1-d]thiazole, or 5-methoxynaphtho[2,3-d]thiazole); a thiazoline nucleus (e.g., thiazoline, 4-methylthiazoline, or 4-nitrothiazoline); an oxazole nucleus (e.g., oxazole, 4-methyloxazole, 4-nitroxazole, 5-methyloxazole, 4-phenyloxazole, 4,5-diphenyloxazole, or 4-ethyloxazole); a benzoxazole nucleus (e.g., benzoxazole, 5-chlorobenzoxazole, 5-methylbenzoxazole, 5-bromobenzoxazole, 5-fluorobenzoxazole, 5-phenyl benzoxazole, 5-methoxybenzoxazole, 5-nitrobenzoxazole, 5-trifluoromethylbenzoxazole, 5-hydroxybenzoxazole, 5-carboxybenzoxazole, 6-methylbenzoxazole, 6-chlorobenzoxazole, 6-nitrobenzoxazole, 6-methoxybenzoxazole, 6-hydroxybenzoxazole, 5,6-dimethylbenzoxazole, 4,6-dimethylbenzoxazole, or 5-ethoxybenzoxazole); a naphthoxazole nucleus (e.g., naphtho[2,1-d]oxazole, naphtho[1,2-d ]oxazole, naphtho[2,3-d]oxazole, or 5-nitronaphtho[2,1-d]oxazole); an oxazoline nucleus (e.g., 4,4-dimethyloxazoline), a selenazole nucleus (e.g., 4-methylselenazole, 4-nitroselenazole, or 4-phenylselenazole); a benzoselenazole nucleus (e.g., benzoselenazole, 5-chlorobenzoselenazole, 5-nitrobenzoselenazole, 5-methoxybenzoselenazole, 5-hydroxybenzoselenazole, 6-nitrobenzoselenazole, or 5-chloro-6-nitrobenzoselenazole); a naphthoselenazole nucleus (e.g., naphtho[2,1-d]selenazole or naphtho[1,2-d]selenazole); a tellurazol nucleus (e.g., benzotellurazole, 5-methylbenzotellurazole, 5-methoxybenzotellurazole, or naphtho[1,2-d]tellurazole); a 3,3-dialkylindolenine nucleus (e.g., 3,3-dimethylindolenine, 3,3-diethylindolenine, 3,3-dimethyl-5-cyanoindolenine, 3,3-diemthyl-6-nitroindolenine, 3,3-dimethyl-5-nitroindolenine, 3,3-dimethyl-5-methoxy indolenine, 3,3,5-trimethylindolenine, or 3,3-dimethyl-5-chloroindolenine); an imidazole nucleus (e.g., 1-alkylimidazole, 1-alkyl-4-phenylimidazole, 1-alkylbenzoimidazole, 1-alkyl-5-chlorobenzoimidazole, 1-alkyl-5,6-dichlorobenzoimidazole, 1-alkyl-5-cyanobenzoimidazole, 1-alkyl-5-cyanobenzoimidazole, 1-alkyl-5-flurobenzoimidazole, 1-alkyl-5-trifluoromethyl benzoimidazole, 1-alkyl-6-chloro-5-cyanobenzoimidazole, 1-alkyl-6-chloro-5-trifluoromethylbenzoimdazole, 1-alkylnaphtho[1,2-d]imdazole, 1-allyl-5,6-dichlorobenzoimdazole, 1-allyl-5-chlorobenzoimdazole, 1-arylimdazole, 1-arylbenzoimidazole, 1-aryl-5-chlorobenzoimdazole, 1-allyl-5,6-dichlorobenzoimidazole, 1-aryl-5-methoxybenzoimdazole, 1-aryl-5-cyanobenzoimidazole, or 1-arylnaphtho[1,2-d]imidazole; a pyridine nuclues (e.g., 2-pyridine or 5-methyl-2-pyridine); a quinoline nucleus (e.g., 2-quinoline, 3-methyl-2-quinoline, 5-ethyl-2-quinoline, 6-methyl-2-quinoline, 6-nitro-2-quinoline, 8-fluoro-2-quinoline, 6-methoxy-2-quinoline, 6-hydroxy-2-quinoline, 8- chloro- 2-quinoline, isoquinoline, 6-nitro-l-isoquinoline, 3,4-dihydro-1-isoquinoline, or 6-nitro-2-isoqunoline); an imdazo[4,5-d]quinoxaline nuluus (e.g., 1,3-diethylimidazo[4,5-d]quinoxaline or 6-chloro-1,3-diallylimidazo[4,5-d]quinoxaline); an oxadiazole nucleus; a thiadiazole nucleus; a tetrazole nucleus; and a pyrimidine nucleus. Preferably, the alkyl group in the imidazole nucleus described above is a one which has 1 to 8 carbon atoms, such as an unsubstituted alkyl group (e.g., methyl, ethyl, propyl, isopropyl, or butyl), or a hydroxyalkyl (e.g., 2-hydroxyethyl or 3-hydroxypropyl). Of these, particularly preferable are methyl and ethyl. The aryl group in the imidazole nucleus is, for example, phenyl, halogen (e.g., chloro)-substituted phenyl, alkyl (e.g., methyl)-substituted phenyl, or alkoxy (e.g., metyoxy)-substituted phenyl.

Of the substituted or unsubstituted methine group represented by $L_1$ or $L_2$, the substituted methine group is a methine group substituted by, for example, a lower alkyl group (e.g., methyl or ethyl), phenyl, substituted phenyl, methoxy, or ethoxy. k is 0, 1, or 2.

Specific examples of the compound of the formula (II) are as follows:
I-1
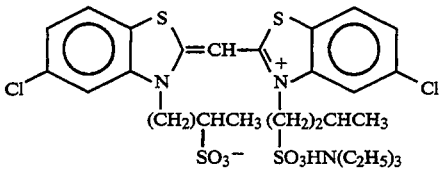
I-2
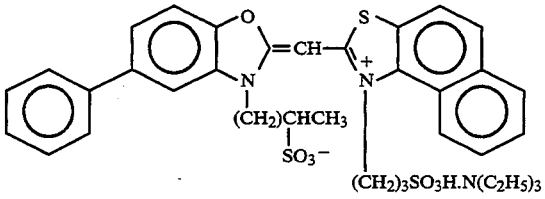
I-3
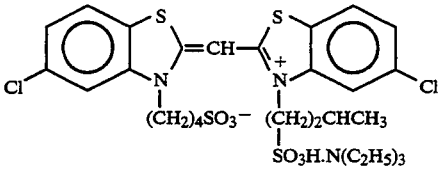
I-4
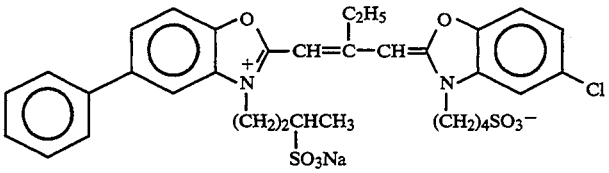
I-5
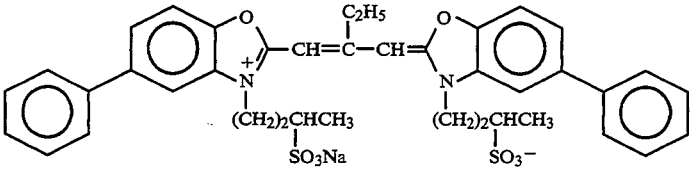
I-6
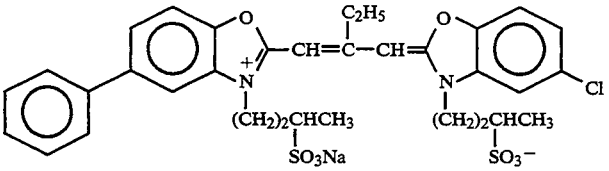
I-7
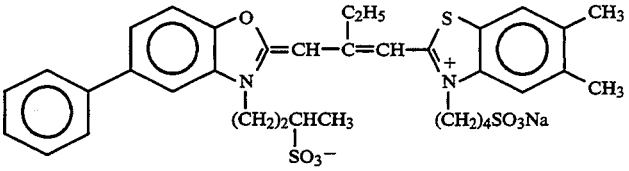
I-8
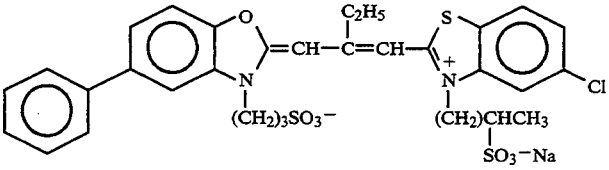

-continued
I-9
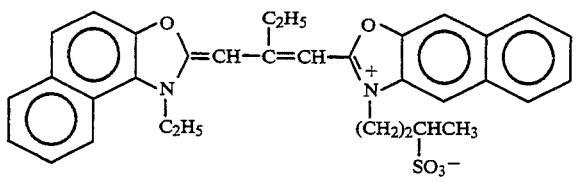
I-10
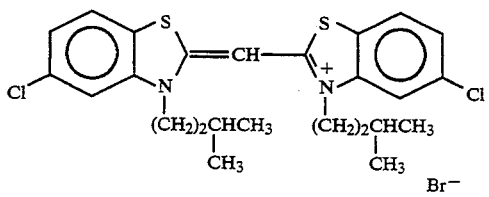
I-11
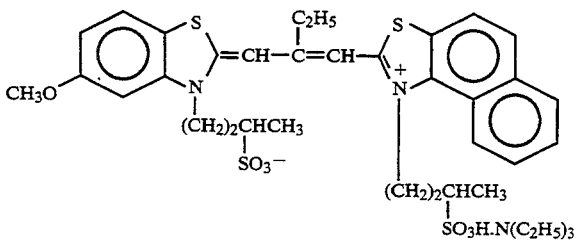
I-12
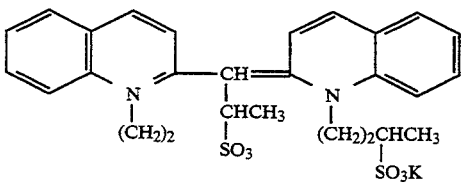
I-13
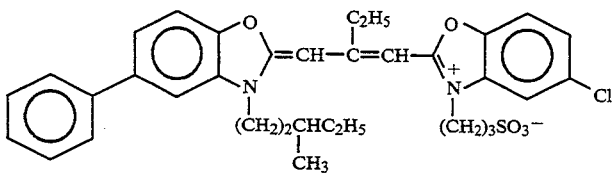
I-14
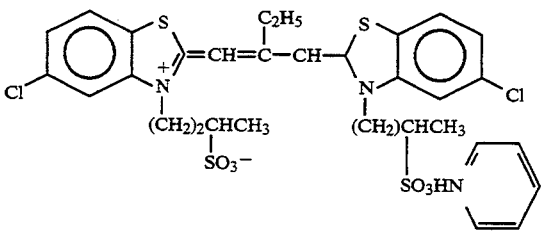
I-15
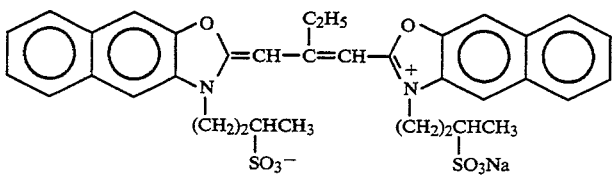

-continued

I-16

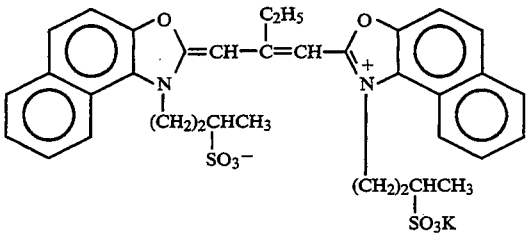

I-17

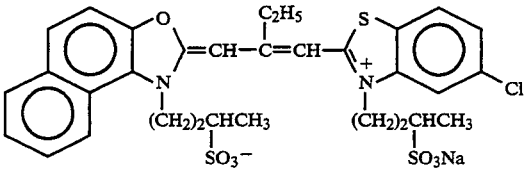

I-18

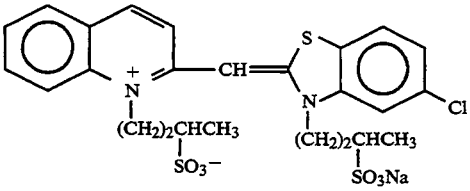

I-19

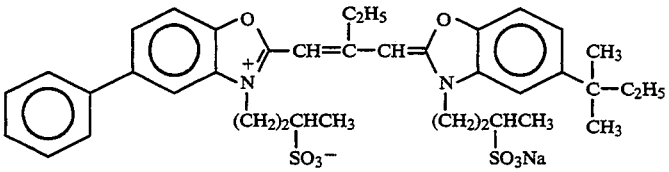

Of these compounds, compound I-1 is most preferable as a sensitizing dye to be used in combination with the yellow coupler of the formula (I).

Dislocation lines can be introduced into silver halide grains by performing, on purpose, controlled recrystallization of silver halide grains during the manufacture of grains of a silver halide emulsion. Various methods are available for observing dislocation lines. Dislocation lines can be directly observed by means of an electron microscope, as is described in, for example, the Japan Institute of Metallics, ed., "Theory of Dislocation-Its Application to Metallics", Marzen, 1971, pp. 627–645. As for the number of dislocation lines, T. H. James "The Theory of the Photographic Process," third edition, New York, Macmillan, 1967 reads on page 17, "The number of dislocation found in an emulsion crystals is ordinarily a small number, such as 5 to 10, but is zero in some silver halide precipitates."

It is sufficient for 50% of number of all silver halide grains in the emulsion to have 10 or more dislocation lines on an average. Preferably, 50% of the silver halide grains have 20 or more dislocation lines on average. More preferably, they have 30 or more dislocation lines on average.

In order to introduce dislocation lines into a silver halide crystal, it is necessary to alter the periodic structure of the crystal to an aperiodic structure. In other words, dislocation lines can be introduced by adding an organic compound or ions different from those halogen ions and silver ions which serve to grow silver halide, in a specific form during the growth of the crystals, so as to discontinuously change the lattice constant at a specific position in the crystal lattice, or by supplying halogen ions and silver ions so as to drastically change the halogen composition. If an organic compound is added for this purpose, it is desirable one which mutually acts with silver halide. More specifically, a sensitizing dye or a stabilizer, which is commonly used in this field of art, can be used for that purpose. Among methods of drastically changing the composition of silver halide are: for example, the method of adding a KI solution during the forming of AgBr grains; and the method of growing AgI or AgCl during the forming of AgBr grains and then ripening the grains or further forming AgBr grains. Another method is available, in which $Ag^+$ and $Br^-$ are added to a system of small nucleus grains having a high iodine content, thereby initiating vigorous recrystallization. In short, it suffices to achieve crystallization in such a way that the silver halide is stabilized as the lattice constant abruptly changes in a specific region of the crystal lattice when the energy for forming the crystal lattice is minimized during the growth of the silver halide.

Silver halide emulsions are chemically sensitized in most cases. They can be chemically sensitized by, for example, the method described in H. Fireser, ed., "Die Grundlagen der photographischen Prozesse mit Silberhalogeniden," Akademische Verlagsgesellschaft, 1968, pp. 674–734.

That is, use can be made of sulfur sensitization using sulfur-containing compounds which can reacts with active gelatin or silver (e.g., thiosulfates, thioureas, mercapto compounds, and rohdanines); reduction sensitization using reducing materials (e.g., stannate chloride, amines, hydrazine derivative, formamidinesulfinic acid, silane compound); precious-metal sensitization using precious-metal compounds (e.g., gold complex salt and complex salts of Group VIII metals such as Pt, Ir and Pd); and selenium sensitization using selenium compounds (e.g., selenoureas, selenoketones, and selenides).

Known selenium compounds disclosed in patent publications can be used as selenium sensitizers in the present invention. More specifically, an unstable selenium compound and/or a non-labile selenium compound are added to an emulsion, and the emulsion is stirred for a predetermined time at a high temperature, preferably 40° C. or more. Preferable examples of the unstable selenium compound are those disclosed in, for example, JP-B-44-15748, JP-B-43-13489, and Japanese Patent Applications 2-130976 and 2-229300. ("JP-B" means Published Examined Japanese Patent Application.) Specific examples of the unstable selenium compound are: isoselenocyanates (e.g., aliphatic isoselenocyanates such as allylisoselenocyanates); selenoureas; selenoketones; selenoamides; selenocarboxylic acides (e.g., 2-selenopropionic acid and 2-selenobutyric acid); seleno esters; diacylselenides (e.g., bis(3-chloro-2,6-dimethoxybenzoyl)selenide); selenophosphates; phosphineselenides; and colloidal metal selenium.

Preferable examples of the unstable selenium compound have been described above, but the compound is not limited to these examples. The structure of an unstable selenium compound which may be used as a sensitizer for photographic emulsions is not so important to those skilled in the art, as long as selenium is unstable. In the art it is generally understood that the organic part of a selenium sensitizer molecule plays no other roles than to support selenium and render it unstable in the emulsion. In the present invention, unstable selenium compounds in this broad sense are used advantageously.

Preferable for use as non-labile selenium compounds in the present invention are the compounds described in JP-B-46-4553, JP-B-52-34492, and JP-B-52-34491. Examples of the non-labile selenium compound are: selenious acid, potassium selenocyanate, selenazole, quaternary salt of selenazole, diarylselenide, diaryldiselenide, dialkylselenide, dialkyldiselenide, 2-selenazolidinedione, 2-selenoxazolidinethione, and derivative thereof.

Of these selenium compounds, preferable are those represented by the following formulas (VII) and (VIII):

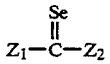

Formula (VII)

In the formulas, $Z_1$ and $Z_2$ may be the same or different, each representing an alkyl group (e.g., methyl, ethyl, t-butyl, adamantyl, t-octyl), an alkenyl group (e.g., vinyl or propenyl), an aralkyl group (e.g., benzyl or phenetyl), an aryl group (e.g., phenyl, pentafluorophenyl, 4-chlorophenyl, 3-nitrophenyl, 4-octylsulfamoylphenyl, or a-naphthyl), a heterocyclic group (e.g., pyridyl, thienyl, furyl, or imidazolyl), $—NR_3(R_4)$, $—OR_5$, or $—SR_6$.

$R_3$, $R_4$, $R_5$, and $R_6$ are identical or different, each representing an alkyl group, an aralkyl group, an aryl group, or a heterocyclic group. Examples of the alkyl, aralkyl, aryl and heterocyclic groups can be the same as cited for group $Z_1$. However, $R_3$ and $R_4$ may also be each a hydrogen atom or an acyl group (e.g., acetyl group, propanoyl group, benzoyl group, heptafluorobutanoyl group, difluoroacetyl group, 4-nitrobenzoyl group, α-naphthoyl group, or 4-trifluoromethylbenzoyl group).

In the formula (VII), $Z_1$ is preferably an alkyl group, an aryl group, or $—NR_3(R_4)$, and $Z_2$ is preferably $—NR_7(R_8)$. $R_3$, $R_4$, $R_7$, and $R_8$ are identical or different, each representing a hydrogen atom, an alkyl group, an aryl group, or an acyl group.

In the formula (VII), N,N-dialkylselenourea, N,N,N'-trialkyl-N'-acylselenourea, tetraalkylselenourea, N,N-dialkyl-arylselenoamide, N-alkyl-N-arylarylselenoamide is to be more preferable.

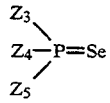

Formula (VIII)

In the formula (VIII), $Z_3$, $Z_4$ and $Z_5$ may be the same or different, each representing an aliphatic group, an aromatic group, a heterocyclic group, $—OR_9$, $—NR_{10}(R_{11})$, $—SR_{12}$, $—SeR_{13}$, X, or a hydrogen atom.

$R_9$, $R_{12}$, and $R_{13}$ each represent an aliphatic group, an aromatic group, a heterocyclic group, a hydrogen atom, or a cation. $R_{10}$ and $R_{11}$ each represent an aliphatic group, an aromatic group, a heterocyclic group, or a hydrogen atom. X rerepresents a halogen atom.

In the formula (VIII), each of the aliphatic groups represented by $Z_3$, $Z_4$, $Z_5$, $R_9$, $R_{10}$, $R_{11}$, $R_{12}$, and $R_{13}$ is a straight-chain, branched or ring-shaped alkyl group, alkenyl group, alkynyl group or aralkyl group (e.g., methyl, ethyl, n-propyl, isopropyl, t-butyl, n-butyl, n-octyl, n-decyl, n-hexadecyl, cyclopentyl, cyclohexyl, allyl, 2-butenyl, 3-pentenyl, propargyl, 3-pentynyl, benzyl, or phenetyl).

In the formula (VIII), each of the aromatic groups represented by $Z_3$, $Z_4$, $Z_5$, $R_9$, $R_{10}$, $R_{11}$, $R_{12}$, and $R_{13}$ is a monocyclic or condensed ring aryl group (e.g., phenyl, pentafluorophenyl, 4-chlorophenyl, 3-sulfophenyl, α-naphthyl, or 4-methylphenyl).

In the formula (VIII), each of the heterocyclic groups represented by $Z_3$, $Z_4$, $Z_5$, $R_9$, $R_{10}$, $R_{11}$, $R_{12}$, and $R_{13}$ is a 3- to 10-membered saturated or unsaturated heterocyclic group containing at least one oxygen or sulfur atom (e.g., pyridyl, thienyl, furyl, thiazolyl, imidazolyl, or benzimidazolyl).

In the formula (VIII), each of the cations represented by $R_9$, $R_{12}$, and $R_{13}$ is an alkali metal atom or ammonium, and the halogen atom represented by X is, for example, a fluorine atom, a chlorine atom, a bromine atom, or an iodine atom.

In the formula (VIII), $Z_3$, $Z_4$ or $Z_5$ is preferably an aliphatic group, an aromatic group, or $—OR_9$, where $R_9$ is an aliphatic group or an aromatic group.

In the formula (VIII) trialkylphosphineselenide, triarylphosphfineselenide, trialkylselenophosphate, or triarylselenophosphate is to be more preferable.

Specific examples of the compounds represented by the formulas (VII) and (VIII) will be described below. Nonetheless, the compounds are not limited to these examples.

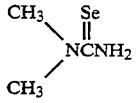

1.

-continued

2. $H_2N\overset{\overset{Se}{\|}}{C}NH_2$

3. $CH_3NH\overset{\overset{Se}{\|}}{C}NH_2$

4. $(CH_3)_2N\overset{\overset{Se}{\|}}{C}N(CH_3)_2$

5. $(CH_3)_2N\overset{\overset{Se}{\|}}{C}CCH_3$ (O)

6. $(CH_3)_2N\overset{\overset{Se}{\|}}{C}CCF_3$ (O)

7. $(CH_3)_2N\overset{\overset{Se}{\|}}{C}CC_3F_7$ (O)

8. $C_6H_5CH_2NH\overset{\overset{Se}{\|}}{C}NHCH_2C_6H_5$

9. $(C_2H_5)_2N\overset{\overset{Se}{\|}}{C}H$ — $C(=O)C_6H_5$

10. $(C_2H_5)_2N\overset{\overset{Se}{\|}}{C}NH_2$

11. $C_6H_5\overset{\overset{Se}{\|}}{C}N(CH_3)_2$

12. $C_{10}H_7\overset{\overset{Se}{\|}}{C}N(CH_3)_2$

13. $(n)C_8H_{17}NHSO_2C_6H_4\overset{\overset{Se}{\|}}{C}N(C_2H_5)_2$

14. $CH_3\overset{\overset{Se}{\|}}{C}NH_2$

-continued

15. 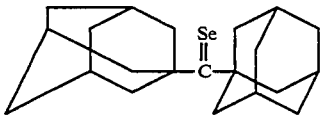

16. $C_6H_5\overset{\overset{Se}{\|}}{C}COC_2H_5$

17. $ClC_6H_4\overset{\overset{Se}{\|}}{C}SC_2H_5$

18. $C_6H_5\overset{\overset{Se}{\|}}{C}N(CH_3)C_6H_5$

19. $C_6H_5\overset{\overset{Se}{\|}}{C}C_6H_5$

20. $C_6H_5\overset{\overset{Se}{\|}}{C}CH_3$

21. $[C_6H_5]_3P{=}Se$

22. $[CH_3C_6H_4]_3P{=}Se$

23. $(nC_4H_9)_3P{=}Se$

24. $[C_6H_{11}]_3P{=}Se$

25. $C_6H_5P(C_2H_5)_2{=}Se$

26. $[C_6H_5O]_3P{=}Se$

27. $[CH_3C_6H_4O]_3P{=}Se$

28. $(nC_4H_9O)_3P{=}Se$

-continued

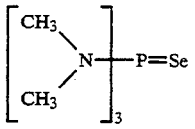

$(C_2H_5O)_3PSe$

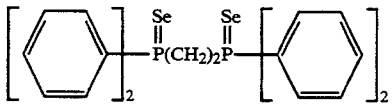

$(nC_8H_{17})_3P{=}Se$

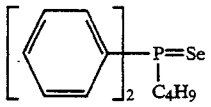

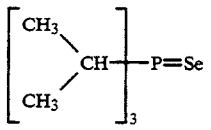

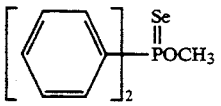

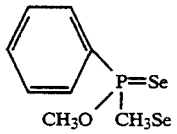

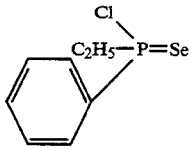

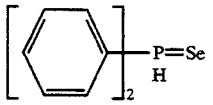

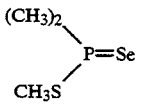

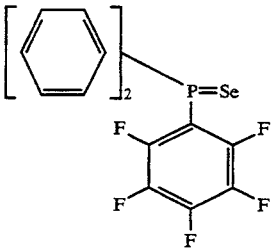

Each of these selenium sensitizers is dissolved in water, an organic solvent such as methanol or ethanol, or a mixture of organic solvents, and is added at the time of chemical sensitization. Preferably, it is added before the start of the chemical sensitization. One of the selenium sensitizers described above may be used. Alternatively, two or more of them may be used in combination. It is desirable that an unstable selenium compound and a non-labile selenium compound be used together.

The amount in which to add the selenium sensitizer in the present invention differs in accordance with the activity of the selenium sensitizers, the type and size of the silver halide grains, the ripening temperature and time, and the like. The amount is preferably $1\times10^{-8}$ mol or more per mol of silver halide, more preferably $1\times10^{-7}$ to $5\times10^{-5}$ mol per mol of silver halide. In the case where selenium sensitizers are used, the chemical ripening temperature is preferably 45° C. or more, more preferably 50° C. to 80° C. The values of aAg and pH are optional. Over a broad pH range of 4 to 9, for example, the advantage of the present invention can be attained.

The selenium sensitization of this invention is more effective if carried out in the presence of silver halide solvent.

Examples of the silver halide solvent used in present invention are: (a) organic thioethers disclosed in U.S. Pat. Nos. 3,271,157, 3,531,289 and 3,574,628, JP-A-54-1019,and JP-A-54-15891 136736; (b) thiourea derivatives disclosed in JP-A-53-82408, JP-A-55-77737, and JP-A-55-2982; (c) a silver halide solvent having a thiocarbonyl group interposed between an oxygen or sulfur atom and a nitrogen atom, disclosed in JP-A-53-144319; (d) imidazoles disclosed in JP-A-54-100717; (e) sulfites; and (f) thiocyanates.

Particularly preferable solvents are thiocyanate and tetramethylthiourea. The amount in which to use the solvent differs in according to the type of the solvent. In the case of thiocyanate, the preferable amount is $1\times10^{-4}$ to $1\times10^{-2}$ mol per mol of silver halide.

Sulfur sensitization is performed, usually by adding a sulfur sensitizer to an emulsion and by stirring the emulsion for a predetermined time at a high temperature, preferably 40° C. or more.

Gold sensitization is performed, usually by adding a gold sensitizer to an emulsion and by stirring the emulsion for a predetermined time at a high temperature, preferably 40° C. or more.

In the sulfur sensitization, use can be made of the sulfur sensitizers known in the art. Examples of the sulfur sensitizers are thiosulfate, allylthiocarbamidethiourea, allylisothiacyanate, cystine, p-toluenethiosulfonate, and rohdanine. Other examples of sulfur sensitizers which can be used in the invention are those disclosed in, for example, U.S. Pat. Nos. 1,574,944, 2,410,689, 2,278,947, 2,728,668, 3,501,313 and 3,656,955, German Patent 1,422,869, JP-B-56-24937, and JP-A-55-45016. It suffices to add a sulfur sensitizer in such an amount as will effectively increase the sensitivity of the emulsion. The amount, which depends on various conditions such as the pH value, the temperature and the size of the silver halide grains, is preferably $1\times10^{-7}$ to $5\times10^{-5}$ mol per mol of silver halide.

In the gold sensitization described above, use can be made of a gold sensitizer in which the oxidation number of gold is +1 or +3, or a gold compound which is usually employed as a gold sensitizer. Typical examples of the gold sensitizer are: chloroauric acid, potassium chloroaurate, auric trichloride, potassium auric thiocyanate, potassium iodoaurate, tetracyanoauric acid, ammonium aurothiocyanate, and pyridyltrichloro gold.

Although the amount in which to add the gold sensitizer depends on various conditions, it is preferably $1\times10^{-7}$ to $5\times10^{-5}$ mol per mol of silver halide.

In chemical ripening the times at which to add the silver halide solvent, the selenium sensitizer, the sulfur sensitizer and the gold sensitizer, or the order in which to add them is not limited in particular. The compounds may be added simultaneously or at different times, (preferably) at the initial stage of the chemical ripening or in the process of thereof. The compounds may be added after dissolved in water, an organic solvent which can mix with water, such as methanol, ethanol, acetone or a mixture thereof.

Preferably the silver halide of the present invention is used the emulsion containing tabular grains in order to the improvement of sharpness.

Methods well known in the art can be used to prepare the tabular silver halide emulsion for use in the present invention.

Tabular silver halide emulsions are described in Cagnac and Chateau, "Evolution of the Morphorlogy of Silver Bromide Crystals during Physical Ripening" Science et Industrielle Photographie, Vol. 33, No. 2 (1962), pp. 121–125; Duffin, "Photographic Emulsion Chemistry" Focal Press, New York, 1966, pp. 66–72; and A. P. H. Trivelli and W. F. Smith, "Photographic Journal" Vol. 80, p. 285 (1940). They can easily be prepared by the methods described in, for example, JP-A-58-127921, JP-A-58-113927, and JP-A-58-113928.

For example, seed crystals, 40 wt % or more of which are tabular grains, are formed in a relatively low-pBr atmosphere having a pBr value of 1.3 or less, and silver and a halogen solution are preferably added during the growing of grains so that no new crystal nuclei may not formed.

The aspect ratio of a tabular grain is defined as the ratio of the diameter of the grain to the thickness thereof. The definition of the aspect ratio, and the method of measuring the ratio are the same as is disclosed in JP-A-63-106746, JP-A-63-316847, and JP-A-2-193138. If a tabular silver halide emulsion is used, it is sufficient that the grains have an average aspect ratio of 3 or more. Nonetheless, the average aspect ratio should better be 4 or more but less than 8, more preferable 4.5 or more but less than 7.

An emulsion of this invention may be used in a light-sensitive emulsion layer. Alternatively, two or more emulsions of the invention, which differ in average grain size or in average silver iodide content, may be used in the same light-sensitive emulsion layer. To mix and use emulsions in a layer is desirable in view of the control of gradation, the control of graininess in various regions, from a low-exposure region to a high-exposure region, and the control of color-development dependency (i.e., the dependency on time, pH and the composition of the developing solution containing a color developing agent and sodium sulfite).

The light-sensitive material of the present invention needs only to have at least one of silver halide emulsion layers, i.e., a blue-sensitive layer, a green-sensitive layer, and a red-sensitive layer, formed on a support. The number or order of the silver halide emulsion layers and the non-light-sensitive layers are particularly not limited. A typical example is a silver halide photographic light-sensitive material having, on a support, at least one light-sensitive layers constituted by a plurality of silver halide emulsion layers which are sensitive to essentially the same color sensitivity but has different sensitivities. The light-sensitive layers are unit light-sensitive layer sensitive to blue, green or red. In a multilayered silver halide color photographic light-sensitive material, the unit light-sensitive layers are generally arranged such that red-, green-, and blue-sensitive layers are formed from a support side in the order named. However, this order may be reversed or a layer sensitive to one color may be sandwiched between layers sensitive to another color in accordance with the application.

Non-light-sensitive layers such as various types of interlayers may be formed between the silver halide light-sensitive layers and as the uppermost layer and the lowermost layer.

The interlayer may contain, e.g., couplers and DIR compounds as described in JP-A-61-43748, JP-A-59-113438, JP-A-59-113440, JP-A-61-20037, and JP-A-61-20038 or a color mixing inhibitor which is normally used.

As a plurality of silver halide emulsion layers constituting each unit light-sensitive layer, a two-layered structure of high- and low-sensitivity emulsion layers can be preferably used as described in West German Patent 1,121,470 or British Patent 923,045. In this case, layers are preferably arranged such that the sensitivity is sequentially decreased toward a support, and a non-light-sensitive layer may be formed between the silver halide emulsion layers. In addition, as described in JP-A-57-112751, JP-A-62-200350, JP-A-62-206541, and JP-A-62-206543, layers may be arranged such that a low-sensitivity emulsion layer is formed remotely from a support and a high-sensitivity layer is formed close to the support.

More specifically, layers may be arranged from the farthest side from a support in an order of low-sensitivity blue-sensitive layer (BL)/high-sensitivity blue-sensitive layer (BH)/high-sensitivity green-sensitive layer (GH)/low-sensitive green-sensitive layer (GL)/high-sensitivity red-sensitive layer (RH)/low-sensitivity red-sensitive layer (RL), an order of BH/BL/GL/GH/RH/RL, or an order of BH/BL/GH/GL/RL/RH.

In addition, as described in JP-B-55-34932, layers may be arranged from the farthest side from a support in an order of blue-sensitive layer/GH/RH/GL/RL. Furthermore, as described in JP-A-56-25738 and JP-A-62-63936, layers may be arranged from the farthest side from a support in an order of blue-sensitive layer/GL/RL/GH/RH.

As described in JP-B-49-15495, three layers may be arranged such that a silver halide emulsion layer having the highest sensitivity is arranged as an upper layer, a silver halide emulsion layer having sensitivity lower than that of the upper layer is arranged as an interlayer, and a silver halide emulsion layer having sensitivity lower than that of the interlayer is arranged as a lower layer. In other words, three layers having different sensitivities may be arranged such that the sensitivity is sequentially decreased toward the support. When a layer structure is constituted by three layers having different sensitivities, these layers may be arranged in an order of medium-sensitivity emulsion layer/high-sensitivity emulsion layer/low-sensitivity emulsion layer from the farthest side from a support in a layer sensitive to one color, as described in JP-A-59-202464.

Also, an order of high-sensitivity emulsion layer/-low-sensitivity emulsion layer/medium-sensitivity emulsion layer or low-sensitivity emulsion layer/medium-sensitivity emulsion layer/high-sensitivity emulsion layer may be adopted.

Furthermore, the arrangement can be changed as described above even when four or more layers are formed.

As described above, various layer structures and arrangements can be selected in accordance with the application of the light-sensitive material.

In the light-sensitive material according to the present invention, two or more types of light-sensitive silver halide emulsions, differing in at least one of features such as grain size, grain-size distribution, halogen composition, grain shape and sensitivity, can be used as a mixture in the same layer.

In the present invention, a non-light-sensitive fine grain silver halide is preferably used. The non-light-sensitive fine grain silver halide means silver halide fine grains not sensitive upon imagewise exposure for obtaining a dye image and essentially not developed in development. The non-light-sensitive fine grain silver halide is preferably not fogged beforehand.

The fine grain silver halide contains 0 to 100 mol % of silver bromide and may contain silver chloride and/or silver iodide as needed. Preferably, the fine grain silver halide contains 0.5 to 10 mol % of silver iodide.

An average grain size (an average value of equivalent-circle diameters of projected surface areas) of the fine grain silver halide is preferably 0.01 to 0.5 μm, and more preferably, 0.02 to 0.2 μm.

The fine grain silver halide can be prepared by a method similar to a method of preparing normal light-sensitive silver halide. In this preparation, the surface of a silver halide grain need not be subjected to either optical sensitization or spectral sensitization. However, before the silver halide grains are added to a coating solution, a known stabilizer such as a triazole compound, an azaindene compound, a benzothiazolium compound, a mercapto compound, or a zinc compound is preferably added. This fine grain silver halide grain containing layer preferably contains colloidal silver.

A coating silver amount of the light-sensitive material of the present invention is preferably 6.0 g/m$^2$ or less, and most preferably, 4.5 g/m$^2$ or less.

Known photographic additives usable in the present invention are also described in the above three RDs, and they are summarized in the following Table:

| Additives | RD17643 Dec., 1978 | RD18716 Nov., 1979 | RD307105 Nov., 1989 |
|---|---|---|---|
| 1. Chemical sensitizers | page 23 | page 648, right column | page 866 |
| 2. Sensitivity increasing agents | | page 648, right column | |
| 3. Spectral sensitizers, super sensitizers | pp. 23–24 | page 648, right column to page 649, right column | pp. 866–868 |
| 4. Brighteners | page 24 | page 647, right column | page 868 |
| 5. Antifoggants and stabilizers | pp. 24–25 | page 649. right column | pp. 868–870 |
| 6. Light absorbent, filter dye, ultraviolet absorbents | pp. 25–26 | page 649, right column to page 650, left column | page 873 |
| 7. Stain preventing agents | page 25, right column | page 650. left to right columns | page 872 |
| 8. Dye image stabilizer | page 25 | page 650, left column | page 872 |
| 9. Hardening agents | page 26 | page 651, left column | pp. 874–875 |
| 10. Binder | page 26 | page 651, left column | pp. 873–874 |
| 11. Plasticizers, lubricants | page 27 | page 650, right column | page 876 |
| 12. Coating aids, surface active agents | pp. 26–27 | page 650, right column | pp. 875–876 |
| 13. Antistatic agents | page 27 | page 650, right column | pp. 876–877 |
| 14. Matting agent | | | pp. 878–879 |

In order to prevent degradation in photographic properties caused by formaldehyde gas, a compound described in U.S. Pat. No. 4,411,987 or 4,435,503, which can react with formaldehyde and fix the same, is preferably added to the light-sensitive material.

The light-sensitive material of the present invention preferably contains compounds for releasing a fogging agent, a development accelerator, a silver halide solvent, or precursors thereof regardless of a developed silver amount produced by the development, as is described in JP-A-1-106052.

The light-sensitive material of the present invention preferably contains dyes dispersed by methods described in International Disclosure WO 88/04794 and JP-A-1-502912 or dyes described in European Patent 317,308A, U.S. Pat. No. 4,420,555, and JP-A-1-259358.

Various color couplers can be used in the present invention, and specific examples of these couplers are described in patents described in above-mentioned Research Disclosure No. 17643, VII-C to VII-G and Research Disclosure No. 307105, VII-C to VII-G.

Preferable examples of yellow couplers other than those presented by the formula (I) are described in, e.g., U.S. Pat. Nos. 3,933,501, 4,022,620, 4,326,024, 4,401,752, and 4,248,961, JP-B-58-10739, British Patents 1,425,020 and 1,476,760, U.S. Pat. Nos. 3,973,968, 4,314,023, and 4,511,649, and European Patent 249,473A.

Examples of a magenta coupler are preferably 5-pyrazolone type and pyrazoloazole type compounds, and more preferably, compounds described in, for example, U.S. Pat. Nos. 4,310,619 and 4,351,897, European Patent 73,636, U.S. Pat. Nos. 3,061,432 and 3,725,067, Research Disclosure No. 24220 (June 1984), JP-A-60-33552, Research Disclosure No. 24230 (June 1984), JP-A-60-43659, JP-A-61-72238, JP-A-60-35730, JP-A-55-118034, and JP-A-60-185951, U.S. Pat. Nos. 4,500,630, 4,540,654, and 4,556,630, and WO No. 88/04795.

Examples of a cyan coupler are phenol type and naphthol type ones. Of these, preferable are those described in, for example, U.S. Pat. Nos. 4,052,212, 4,146,396, 4,228,233, 4,296,200, 2,369,929, 2,801,171, 2,772,162, 2,895,826, 3,772,002, 3,758,308, 4,343,011, and 4,327,173, West German Patent Laid-open Application 3,329,729, European Patents 121,365A and 249,453A, U.S. Pat. Nos. 3,446,622, 4,333,999, 4,775,616, 4,451,559, 4,427,767, 4,690,889, 4,254,212, and 4,296,199, and JP-A-61-42658. Also, the pyrazoloazole type couplers disclosed in JP-A-64-553, JP-A-64-554, JP-A-64-555 and jP-A-64-556, and imidazole type couplers disclosed in U.S. Pat. No. 4,818,672 can be used as cyan coupler in the present invention.

Typical examples of a polymerized dye-forming coupler are described in U.S. Pat. Nos. 3,451,820, 4,080,211, 4,367,282, 4,409,320, and 4,576,910, British Patent 2,102,173, and European Patent 341,188A.

Preferable examples of a coupler capable of forming coloring dyes having proper diffusibility are those described in U.S. Pat. No. 4,366,237, British Patent 2,125,570, European Patent 96,570, and West German Laid-open Patent Application No. 3,234,533.

Preferable examples of a colored coupler for correcting additional, undesirable absorption of a colored dye are those described in Research Disclosure No. 17643, VII-G, Research Disclosure No. 307105, VII-G, U.S. Pat. No. 4,163,670, JP-B-57-39413, U.S. Pat. Nos. 4,004,929 and 4,138,258, and British Patent 1,146,368. A coupler for correcting unnecessary absorption of a colored dye by a fluorescent dye released upon coupling described in U.S. Pat. No. 4,774,181 or a coupler having a dye precursor group which can react with a developing agent to form a dye as a split-off group described in U.S. Pat. No. 4,777,120 may be preferably used.

Compounds releasing a photographically useful residue upon coupling are preferably used in the present invention. DIR couplers, i.e., couplers releasing a development inhibitor other than one defined in present invention are described in the patents cited in the above-described RD No. 17643, VII-F, RD No. 307105, VII-F, JP-A-57-151944, JP-A-57-154234, JP-A-60-184248, JP-A-63-37346, JP-A-63-37350, and U.S. Pat. Nos. 4,248,962 and 4,782,012.

Preferable examples of a coupler for imagewise releasing a nucleating agent or a development accelerator in development are described in British Patents 2,097,140 and 2,131,188, JP-A-59-157638, and JP-A-59-170840. In addition, compounds for releasing, for example, a fogging agent, a development accelerator, or a silver halide solvent upon redox reaction with an oxidized form of a developing agent, described in JP-A-60-107029, JP-A-60-252340, JP-A-1-44940, and JP-A-1-45687, can also be preferably used.

Examples of a coupler which can be used in the light-sensitive material of the present invention are competing couplers described in, for example, U.S. Pat. No. 4,130,427; poly-equivalent couplers described in, e.g., U.S. Pat. Nos. 4,283,472, 4,338,393, and 4,310,618; a DIR redox compound releasing coupler, a DIR coupler releasing coupler, a DIR coupler releasing redox compound, or a DIR redox releasing redox compound described in, for example, JP-A-60-185950 and JP-A-62-24252; couplers releasing a dye which turns to a colored form after being released described in European Patent 173,302A and 313,308A; a ligand releasing coupler described in, e.g., U.S. Pat. No. 4,555,477; a coupler releasing a leuco dye described in JP-A-63-75747; and a coupler releasing a fluorescent dye described in U.S. Pat. No. 4,774,181.

The couplers for use in this invention can be added to the light-sensitive material by various known dispersion methods.

Examples of a high-boiling solvent to be used in the oil-in-water dispersion method are described in e.g. U.S. Pat. No. 2,322,027.

Examples of a high-boiling organic solvent to be used in the oil-in-water dispersion method and having a boiling point of 175° C. or more at atmospheric pressure are phthalates (e.g., dibutylphthalate, dicyclohexylphthalate, di-2-ethylhexylphthalate, decylphthalate, bis(2,4-di-t-amylphenyl) phthalate, bis(2,4-di-t-amylphenyl) isophthalate, bis(1,1-di-ethylpropyl) phthalate), phosphates or phosphonates (e.g., triphenylphosphate, tricresylphosphate, 2-ethylhexyldiphenylphosphate, tricyclohexylphosphate, tri-2-ethylhexylphosphate, tridodecylphosphate, tributoxyethylphosphate, trichloropropylphosphate, and di-2-ethylhexylphenylphosphonate), benzoates (e.g., 2-ethylhexylbenzoate, dodecylbenzoate, and 2-ethylhexyl-p-hydroxybenzoate), amides (e.g., N,N-diethyldodecaneamide, N,N-diethyllaurylamide, and N-tetradecylpyrrolidone), alcohols or phenols (e.g., isostearyl alcohol and 2,4-di-tert-amylphenol), aliphatic carboxylates (e.g., bis(2-ethylhexyl) sebacate, dioctylazelate, glyceroltributylate, isostearyllactate, and trioctylcitrate), an aniline derivative (e.g., N,N-dibutyl-2-butoxy-5-tert-octylaniline), and hydrocarbons (e.g., paraffin, dodecylbenzene, and diisopropylnaphthalene). An organic solvent having a boiling point of about 30° C. or more, and preferably, 50° C. to about 160° C. can be used as an auxiliary solvent. Typical examples of the auxiliary solvent are ethyl acetate, butyl acetate, ethyl propionate, methylethylketone, cyclohexanone, 2-ethoxyethylacetate, and dimethylformamide.

Steps and effects of a latex dispersion method and examples of a loadable latex are described in, e.g., U.S. Pat. No. 4,199,363 and German Laid-open Patent Application (OLS) Nos. 2,541,274 and 2,541,230.

Various types of antiseptics and fungicides agent are preferably added to the color light-sensitive material of the present invention. Examples of the antiseptics and the fungicides are phenethyl alcohol, and 1,2-benzisothiazoline-3-one, n-butyl, p-hydroxybenzoate, phenol, 4-chloro-3,5-dimethylphenol, 2-phenoxyethanol, and 2-(4-thiazolyl) benzimidazole, which are described in JP-A-63-257747, JP-A-62-272248, and JP-A-1-80941.

The present invention can be applied to various color light-sensitive materials. Examples of the material are a color negative film for a general purpose or a movie, a color reversal film for a slide or a television, color paper, a color positive film, and color reversal paper.

A support which can be suitably used in the present invention is described in, e.g., RD. No. 17643, page 28, RD. No. 18716, from the right column, page 647 to the left column, page 648, and RD. No. 307105, page 879.

In the light-sensitive material of the present invention, the sum total of film thicknesses of all hydrophilic colloidal layers at the side having emulsion layers is preferably 28 μm or less, more preferably, 23 μm or less, much more preferably, 18 μm or less, and most preferably, 16 μm or less. A film swell speed $T_{\frac{1}{2}}$ is preferably 30 sec. or less, and more preferably, 20 sec. or less. The film thickness means a film thickness measured under moisture conditioning at a temperature of 25° C. and a relative humidity of 55% (two days). The film swell speed $T_{\frac{1}{2}}$ can be measured in accordance with a known method in the art. For example, the film swell speed $T_{\frac{1}{2}}$ can be measured by using a swell meter described in Photographic Science & Engineering, A. Green et al., Vol. 19, No. 2, pp. 124 to 129. When 90% of a maximum swell film thickness reached by performing a treatment by using a color developing agent at 30° C. for 3 min. and 15 sec. is defined as a saturated film thickness, $T_{\frac{1}{2}}$ is defined as a time required for reaching $\frac{1}{2}$ of the saturated film thickness.

The film swell speed $T_{\frac{1}{2}}$ can be adjusted by adding a film hardening agent to gelatin as a binder or changing aging conditions after coating. A swell ratio is preferably 150% to 400%. The swell ratio is calculated from the maximum swell film thickness measured under the above conditions in accordance with a relation: (maximum swell film thickness−film thickness)/film thickness.

In the light-sensitive material of the present invention, hydrophilic colloid layers (called back layers) having a total dried film thickness of 2 to 20 μm are preferably formed on the side opposite to the side having emulsion layers. The back layers preferably contain, for example, the light absorbent, the filter dye, the ultraviolet absorbent, the antistatic agent, the film hardener, the binder, the plasticizer, the lubricant, the coating aid, and the surfactant described above. The swell ratio of the back layers is preferably 150% to 500%.

The color photographic light-sensitive material according to the present invention can be developed by conventional methods described in RD. No. 17643, pp. 28 and 29, RD. No. 18716, the left to right columns, page 651, and RD. No. 307105, pp. 880 and 881.

A color developer used in development of the light-sensitive material of the present invention is an aqueous alkaline solution containing as a main component, preferably, an aromatic primary amine-based color developing agent. As the color developing agent, although an aminophenol-based compound is effective, a p-phenylenediamine-based compound is preferably used. Typical examples of the p-phenylenediamine-based compound are: 3-methyl-4-amino-N,N-diethylaniline, 3-methyl-4-amino-N-ethyl-β-hydroxyethylaniline, 3-methyl-4-amino-N-ethyl-N-β-methanesulfonamide ethylaniline, 3-methyl-4-amino-N-ethyl-β-methoxyethylaniline, and the sulfates, hydrochlorides and p-toluenesulfonates thereof. Of these compounds, 3-methyl-4-amino-N-ethyl-N-β-hydroxyethyl aniline sulfates. These compounds can be used in a combination of two or more thereof in accordance with the application.

In general, the color developer contains a pH buffering agent such as a carbonate, a borate, or a phosphate of an alkali metal, and a development restrainer or an antifoggant such as a chloride, a bromide, an iodide, benzimidazoles, benzothiazoles, or a mercapto compound. If necessary, the color developer may also contain a preservative such as hydroxylamine, diethylhydroxylamine, sulfites, a hydrazine such as N,N-biscarboxymethyl hydrazine, a phenylsemicarbazide, triethanolamine, or a catechol sulfonic acid; an organic solvent such as ethyleneglycol or diethyleneglycol; a development accelerator such as benzylalcohol, polyethyleneglycol, a quaternary ammonium salt or an amine; a dye-forming coupler; a competing coupler; an auxiliary developing agent such as 1-phenyl-3-pyrazolidone; a viscosity-imparting agent; and a chelating agent such as aminopolycarboxylic acid, an aminopolyphosphonic acid, an alkylphosphonic acid, or a phosphonocarboxylic acid. Examples of the chelating agent are ethylenediaminetetraacetic acid, nitrilotriacetic acid, diethylenetriaminepentaacetic acid, cyclohexanediaminetetraacetic acid, hydroxyethyliminodiacetic acid, 1-hydroxyethylidene-1,1-diphosphonic acid, nitrilo-N,N,N-trimethylenephosphonic acid, ethylenediamine-N,N,N,N-tetramethylenephosphonic acid, and ethylenediamine-di(o-hydroxyphenylacetic acid), and salts thereof.

To perform reversal development, black-and-white development is performed and then color development is performed. As a black-and-white developer, well-known black-and-white developing agents, e.g., a dihydroxybenzene such as hydroquinone, a 3-pyrazolidone, such as 1-phenyl-3-pyrazolidone, and an aminophenol such as N-methyl-p-aminophenol can be singly or in a combination of two or more thereof.

The pH of the color and black-and-white developers is generally 9 to 12. Although the quantity of replenisher of the developer depends on a color photographic light-sensitive material to be processed, it is generally 3 liters or less per $m^2$ of the light-sensitive material. The quantity of replenisher can be decreased to be 500 ml or less by decreasing a bromide ion concentration in a replenisher. In order to decrease the quantity of the replenisher, a contact area of a processing tank with air is preferably decreased to prevent evaporation and oxidation of the solution upon contact with air.

The contact area of the solution with air in a processing tank can be represented by an aperture defined below:

$$\text{Aperture} = [\text{contact area } (cm^2) \text{ of processing solution with air}]/[\text{volume } (cm^3) \text{ of the solution}]$$

The above aperture is preferably 0.1 or less, and more preferably, 0.001 to 0.05. In order to reduce the aperture, a shielding member such as a floating cover may be provided on the surface of the photographic processing solution in the processing tank. In addition, a method of using a movable cover described in JP-A-1-82033 or a slit developing method descried in JP-A-63-216050 may be used. The aperture is preferably reduced not only in color and black-and-white development steps but also in all subsequent steps, e.g., bleaching, bleach-fixing, fixing, washing, and stabilizing steps. In addition, the quantity of replenisher can be reduced by using a means of suppressing the storage of bromide ions in the developing solution.

A color development time is normally 2 to 5 minutes. The processing time, however, can be shortened by setting a high temperature and a high pH and using the color developing agent at a high concentration.

The photographic emulsion layer is generally subjected to bleaching after color development. The bleaching may be performed either simultaneously with fixing (bleach-fixing) or independently thereof. In addition, in order to increase a processing speed, bleach-fixing may be performed after bleaching. Also, processing may be performed in a bleach-fixing bath having two continuous tanks, fixing may be performed before bleach-fixing, or bleaching may be performed after bleach-fixing, in accordance with the application. Examples of the bleaching agent are a compound of a multivalent metal, e.g., iron(III), peroxides; quinones; and a nitro compound. Typical examples of the bleaching agent are an organic complex salt of iron(III), e.g., a complex salt of an aminopolycarboxylic acid such as ethylenediaminetetraacetic acid, diethylenetriaminepentaacetic acid, cyclohexanediaminetetraacetic acid, methyliminodiacetic acid, and 1,3-diaminopropanetetraacetic acid, and glycoletherdiaminetetraacetic acid; or a complex salt of citric acid, tartaric acid, or malic acid. Of these compounds, an iron(III) complex salt of aminopolycarboxylic acid such as an iron(III) complex salt of ethylenediaminetetraacetic acid or 1,3-diaminopropanetetraacetic acid is preferred because it can increase a processing speed and prevent an environmental contamination. The iron(III) complex salt of aminopolycarboxylic acid is useful in both the bleaching and bleach-fixing solutions. The pH of the bleaching or bleach-fixing solution using the iron(III) complex salt of aminopolycarboxylic acid is normally 4.0 to 8. In order to increase the processing speed, however, processing can be performed at a lower pH.

A bleaching accelerator can be used in the bleaching solution, the bleach-fixing solution, and their pre-bath, if necessary. Examples of a useful bleaching accelerator are: compounds having a mercapto group or a disulfide group described in, for example, U.S. Pat. No. 3,893,858, West German Patents 1,290,812 and 2,059,988, JP-A-53-32736, JP-A-53-57831, JP-A-53-37418, JP-A-53-72623, JP-A-53-95630, JP-A-53-95631, JP-A-53-104232, JP-A-53-124424, and JP-A-53-141623, and JP-A-53-28426, and Research Disclosure No. 17129 (July, 1978); a thiazolidine derivative described in JP-A-50-140129; thiourea derivatives described in JP-B-45-8506, JP-A-52-20832, JP-A-53-32735, and U.S. Pat. No. 3,706,561; iodide salts described in West German Patent 1,127,715 and JP-A-58-16235; polyoxyethylene compounds described in West German Patents 966,410 and 2,748,430; a polyamine compound described in JP-B-45-8836; compounds descried in JP-A-49-40943, JP-A-49-59644, JP-A-53-94927, JP-A-54-35727, JP-A-55-26506, and JP-A-58-163940; and a bromide ion. Of these compounds, a compound having a mercapto group or a disulfide group is preferable since the compound has a large accelerating effect. In particular, compounds described in U.S. Pat. No. 3,893,858, West German Patent 1,290,812, and JP-A-53-95630 are preferred. A compound described in U.S. Pat. No. 4,552,834 is also preferable. These bleaching accelerators may be added in the light-sensitive material. These bleaching accelerators are useful especially in bleach-fixing of a photographic color light-sensitive material.

The bleaching agent or the bleach-fixing solution preferably contains, in addition to the above compounds, an organic acid in order to prevent a bleaching stain. The most preferable organic acid is a compound having an acid dissociation constant (pKa) of 2 to 5, more specifically, acetic acid, propionic acid, or hydroxy acetic acid.

Examples of the fixing agent used as the fixing solution or the bleach-fixing solution are thiosulfate, thiocyanate, a thioether-based compound, thioureas and a large amount of an iodide. Generally used is a thiosulfate. Of these compounds, a thiosulfate, especially, ammonium thiosulfate can be used in the widest range of applications. In addition, a combination of thiosulfate and a thiocyanate, a thioether-based compound, or thiourea is preferably used. As a preservative of the fixing solution or the bleach-fixing solution, a sulfite, a bisulfite, a carbonyl bisulfite adduct, or a sulfinic acid compound described in European Patent 294,769A is preferred. In addition, in order to stabilize the fixing solution or the bleach-fixing solution, various types of aminopolycarboxylic acids or organic phosphonic acids are preferably added to the solution.

In the present invention, 0.1 to 10 mol/l of a compound having a pKa of 6.0 to 9.0 are preferably added to the fixing solution or the bleach-fixing solution in order to adjust the pH. Preferable examples of the compound are imidazoles such as imidazole, 1-methylimidazole, 1-ethylimidazole, and 2-methylimidazole.

The total time of a desilvering step is preferably as short as possible as long as no desilvering defect occurs. A preferable time is one to three minutes, and more preferably, one to two minutes. A processing temperature is 25° C. to 50° C., and preferably, 35° C. to 45° C. Within the preferable temperature range, a desilvering speed is increased, and generation of a stain after the processing can be effectively prevented.

In the desilvering step, stirring is preferably as strong as possible. Examples of a method of intensifying the stirring are a method of colliding a jet stream of the processing solution against the emulsion surface of the light-sensitive material described in JP-A-62-183460, a method of increasing the stirring effect using rotating means described in JP-A-62-183461, a method of moving the light-sensitive material while the emulsion surface is brought into contact with a wiper blade provided in the solution to cause disturbance on the emulsion surface, thereby improving the stirring effect, and a method of increasing the circulating flow amount in the overall processing solution. Such a stirring-improving means is effective in any of the bleaching solution, the bleach-fixing solution, and the fixing solution. It is assumed that the improvement in stirring increases the speed of supply of the bleaching agent and the fixing agent into the emulsion film to lead to an increase in desilvering speed. The above stirring improving means is more effective when the bleaching accelerator is used, i.e., significantly increases the accelerating speed or eliminates fixing interference caused by the bleaching accelerator.

An automatic developing machine for processing the light-sensitive material of the present invention preferably has a light-sensitive material conveyer means described in JP-A-60-191257, JP-A-60-191258, or JP-A-60-191259. As described in JP-A-60-191257, this conveyer means can significantly reduce carry-over of a processing solution from a pre-bath to a post-bath, thereby effectively preventing degradation in performance of the processing solution. This effect significantly shortens especially a processing time in each processing step and reduces the quantity of replenisher of a processing solution.

The photographic light-sensitive material of the present invention is normally subjected to washing and/or stabilizing steps after desilvering. An amount of water used in the washing step can be arbitrarily determined over a broad range in accordance with the properties (e.g., a property determined by the substances used, such as a coupler) of the light-sensitive material, the application of the material, the temperature of the water, the number of water tanks (the number of stages), a replenishing scheme representing a counter or forward current, and other conditions. The relationship between the amount of water and the number of water tanks in a multi-stage counter-current scheme can be obtained by a method described in "Journal of the Society of Motion Picture and Television Engineering", Vol. 64, PP. 248–253 (May, 1955).

In the multi-stage counter-current scheme disclosed in this reference, the amount of water used for washing can be greatly decreased. Since washing water stays in the tanks for a long period of time, however, bacteria multiply and floating substances may be adversely attached to the light-sensitive material. In order to solve this problem in the process of the color photographic light-sensitive material of the present invention, a method of decreasing calcium and magnesium ions can be effectively utilized, as described in JP-A-62-288838. In addition, a germicide such as an isothiazolone compound and cyabendazole described in JP-A-57-8542, a chlorine-based germicide such as chlorinated sodium isocyanurate, and germicides such as benzotriazole described in Hiroshi Horiguchi et al., "Chemistry of Antibacterial and Antifungal Agents", (1986), Sankyo Shuppan, Eiseigijutsu-Kai ed., "Sterilization, Antibacterial, and Antifungal Techniques for Microorganisms", (1982), Kogyogijutsu-Kai, and Nippon Bokin Bokabi Gakkai ed., "Dictionary of Antibacterial and Antifungal Agents", (1986), can be used.

The pH of the water for washing the photographic light-sensitive material of the present invention is 4 to 9, and preferably, 5 to 8. The water temperature and the washing time can vary in accordance with the properties and applications of the light-sensitive material. Normally, the washing time is 20 seconds to 10 minutes at a temperature of 15° C. to 45° C., and preferably, 30 seconds to 5 minutes at 25° C. to 40° C. The light-sensitive material of the present invention can be processed directly by a stabilizing agent in place of washing. All known methods described in JP-A-57-8543, JP-A-58-14834, and JP-A-60-220345 can be used in such stabilizing processing.

In some cases, stabilizing is performed subsequently to washing. An example is a stabilizing bath containing a dye stabilizing agent and a surface-active agent to be used as a final bath of the photographic color light-sensitive material. Examples of the dye stabilizing agent are formalin, an aldehyde such as glutaraldehyde, an N-methylol compound, hexamethylenetetramine, and an adduct of aldehyde sulfite.

Various cheleting agents and fungicides can be added to the stabilizing bath.

An overflow solution produced upon washing and/or replenishment of the stabilizing solution can be reused in another step such as a desilvering step.

In the processing using an automatic developing machine or the like, if each processing solution described above is condensed by evaporation, water is preferably added to correct condensation.

The silver halide color light-sensitive material of the present invention may contain a color developing agent in order to simplify processing and increases a processing speed. For this purpose, various types of precursors of a color developing agent can be preferably used. Examples of the precursor are an indoaniline-based compound described in U.S. Pat. No. 3,342,597, Schiff base compounds described in U.S. Pat. No. 3,342,599, Research Disclosure No. 14850 and Research Disclosure No. 15159, an aldol compound described in RD No. 13924, a metal salt complex described in U.S. Pat. No. 3,719,492, and an urethane-based compound described in JP-A-53-135628.

The silver halide color light-sensitive material of the present invention may contain various 1-phenyl-3-pyrazolidones in order to accelerate color development, if necessary. Typical examples of the compound are described in JP-A-56-64339, JP-A-57-144547, and JP-A-58-115438.

Each processing solution in the present invention is used at a temperature of 10° C. to 50° C. Although a normal processing temperature is 33° C. to 38° C., processing may be accelerated at a higher temperature to shorten a processing time, or image quality or stability of a processing solution may be improved at a lower temperature.

The silver halide light-sensitive material of the present invention can be applied to a heat development light-sensitive material of the type described in, for example, U.S. Pat. No. 4,500,626, JP-A-60-133449, JP-A-59-218443, JP-A-61-238056, and European Patent 210,600A2.

The present invention will be described in more detail below by way of its examples, but the present invention is not limited to these examples.

EXAMPLE 1

(Preparation of Seed-Crystal Emulsion $\alpha$)

A silver halide seed-crystal emulsion $\alpha$ containing tabular double-structured silver iodide grains specified below was prepared, with reference to JP-A-63-151618, U.S. Pat. No. 4,797,354, and German Patent 3,707,135-A1.

Core: 13% of the silver in the seed crystal

Shell: 87% of the silver in the seed crystal, formed in the presence of thiourea dioxide to form a shell and then ripened for 5 minutes in the presence of a compound of formula (III), wherein R and M are ethyl and Na, respectively, the amounts of thiourea dioxide and the compound being $5\times10^{-6}$ mol and $2\times10^{-4}$ mol per mol of silver contained in the seed crystal, respectively.

(Preparation of Seed-Crystal Emulsion $\beta$)

An emulsion $\beta$ containing tabular grains was formed in the same way as in the preparation of the seed-crystal emulsion $\alpha$, except that neither thiourea dioxide nor the compound of the formula (III) was added. This emulsion shall be called a seed-crystal emulsion $\beta$.

(Preparation of EM-1)

Solutions (1-1a) and (1-1b), both specified below, were added to the seed-crystal emulsion $\alpha$ (containing 170 g of silver in $AgNo_3$ used and 40 g of gelatin), simultaneously over 5 minutes, while maintaining the emulsion at 60° C. and stirring the emulsion.

| | |
|---|---|
| Solution (1-1a) | |
| $AgNO_3$ | 8 g |
| $H_2O$ | 200 cc |
| Solution (1-1b) | |
| KI | 6 g |
| $H_2O$ | 200 cc |

Next, solutions (1-2a) and (1-2b), both specified below, were added to the emulsion simultaneously over 30 minutes, while maintaining the pAg value at 9.0.

| | |
|---|---|
| Solution (1-2a) | |
| $AgNO_3$ | 70 g |
| $H_2O$ | 300 cc |
| Solution (1-2b) | |
| KBr | 49 g |
| $H_2O$ | 300 cc |

Thereafter, the emulsion was desalted by the ordinary method, gelatin was added to the emulsion, and the emulsion was optimally gold-sulfur sensitized with chloroauric acid and sodium thiosulfate, thereby preparing a silver halide emulsion. This emulsion shall be called "EM-1."

(Preparation of EM-2)

Another silver halide emulsion was prepared by forming grains, by performing desalting, and by carrying out chemical sensitization in the same way as EM-1, except that the seed-crystal emulsion $\beta$ was used in place of the seed-crystal emulsion $\alpha$ in the forming of grains. The silver halide emulsion, thus prepared, shall be called "EM-2."

(Preparation of EM-3)

Grains were formed in the same way as in the forming of grains of EM-1, except that solution (3-1b) specified below was used in place of solution (1-1b).

| Solution (3-1b) | |
|---|---|
| KBr | 4.3 g |
| KI | 6.0 9 |
| $H_2O$ | 200 cc |

Thereafter, desalting and chemical sensitization were conducted in the same way as in the preparation of EM-1, thus preparing a silver halide emulsion. This silver halide emulsion shall be called "EM-3."

(Preparation of EM-4)

Still another silver halide emulsion was prepared by forming grains, by performing desalting, and by carrying out chemical sensitization in the same way as EM-3, except that the seed-crystal emulsion $\beta$ was used in place of the seed-crystal emulsion $\alpha$ in the forming of grains and that solution (1-1b) and solution (3-1b) were not used. The silver halide emulsion, thus prepared, shall be called "EM-4."

The properties of EM-1 to EM-4 are shown in the following Table 1. The dislocation lines, the number of which is specified in Table 1, were observed by means of a transmission electron microscope as has been described. The average aspect ratio was determined by measuring the ratio of each of many tabular grains selected at random so that the mean of all tabular grains in halide grains might be as accurate as possible. The equivalent-sphere diameter was a volume weighted mean by means of Coal-Tar Counter TA II manufactured by Coal Tar Electronics, Inc., U.S.

TABLE 1

| Emulsion No. | Seed-crystal Emulsion | Reduction sensitization | Dislocation lines | Average aspect ratio | Equivalent-sphere diameter (μm) |
|---|---|---|---|---|---|
| EM-1 | $\alpha$ | Performed | 70% or more of all grains had 30 or more dislocation lines each | 6 | 0.8 |
| EM-2 | $\beta$ | Not performed | The same as above | 6 | 0.8 |
| EM-3 | $\alpha$ | Performed | The same as above | 4.5 | 0.5 |
| EM-4 | $\beta$ | Not performed | None of the grains had 10 or more dislocation lines each | 4.5 | 0.5 |

Samples 101 to 116 were prepared by coating a multilayered color light-sensitive material comprising a plurality of layers having the compositions specified in the following Table 2 on an undercoated triacetylcellulose film support.

TABLE 2

| Sample No. | Silver bromoiodide emulsion-U in layer 12 | ExY-U in layer 12 | Silver bromoiodide emulsion-O in layer 14 | ExY-O in layer 14 | Remarks |
|---|---|---|---|---|---|
| 101 | EM-1 | Y-5 | EM-5 | Y-5 | Invention |
| 102 | EM-2 | Y-5 | EM-5 | Y-5 | Invention |
| 103 | EM-3 | Y-5 | EM-5 | Y-5 | Invention |
| 104 | EM-4 | Y-5 | EM-5 | Y-5 | Comparative |
| 105 | EM-1 | Y-28 | EM-5 | Y-28 | Invention |
| 106 | EM-2 | Y-28 | EM-5 | Y-28 | Invention |
| 107 | EM-3 | Y-28 | EM-5 | Y-28 | Invention |
| 108 | EM-4 | Y-28 | EM-5 | Y-28 | Comparative |
| 109 | EM-1 | Y-30 | EM-5 | Y-30 | Invention |
| 110 | EM-2 | Y-30 | EM-5 | Y-30 | Invention |
| 111 | EM-3 | Y-30 | EM-5 | Y-30 | Invention |
| 112 | EM-4 | Y-30 | EM-5 | Y-30 | Comparative |
| 113 | EM-1 | ExY-3 | EM-5 | ExY-3 | Comparative |
| 114 | EM-2 | ExY-3 | EM-5 | ExY-3 | Comparative |
| 115 | EM-3 | ExY-3 | EM-5 | ExY-3 | Comparative |
| 116 | EM-4 | ExY-3 | EM-5 | ExY-3 | Comparative |

(Compositions of light-sensitive layers)

The amounts in which silver halide and colloidal silver were coated are indicated in units of g/m$^2$; the amounts in which couplers, additives, and gelatin were coated are represented in units of g/m$^2$; and the amounts in which the sensitizing dyes were used are indicated in units of moles per mole of a silver halide in the same layer. However, the amounts in which yellow couplers ExY-U and ExY-O were coated are specified in terms of the coated amount (g/m$^2$) of ExY-3. The symbols identifying the additives have the meanings listed below, but any additive achieving two or more effects is identified by the symbol showing one of those effects.

UV: ultraviolet absorbent, Solv: high-melting organic solvent, ExF: dye, ExS: sensitizing dye, ExC: cyan coupler, ExM: magenta coupler, ExY: yellow coupler, Cpd: additive

| | |
|---|---|
| Layer 1: Antihalation layer | |
| Black colloidal silver | 0.15 |
| Gelatin | 2.33 |
| ExM-2 | 0.11 |
| UV-1 | $3.0 \times 10^{-2}$ |
| UV-2 | $6.0 \times 10^{-2}$ |
| UV-3 | $7.0 \times 10^{-2}$ |
| Solv-1 | 0.16 |
| Solv-2 | 0.10 |
| ExF-1 | $1.0 \times 10^{-2}$ |
| ExF-2 | $4.0 \times 10^{-2}$ |
| ExF-3 | $5.0 \times 10^{-3}$ |
| Cpd-6 | $1.0 \times 10^{-3}$ |
| Layer 2: Low red-sensitive emulsion layer | |
| Silver bromoiodide emulsion (AgI 4.0 mol %, uniform AgI type, equivalent-sphere diameter: 0.4 μm, variation coefficient in terms of | silver 0.35 |

equivalent-sphere diameter: 30%, tabular grains,

-continued

| | |
|---|---|
| aspect ratio: 3.0) | |
| Silver bromoiodide emulsion (AgI 6.0 mol %, internally high AgI type, core/shell ratio: 1:2, equivalent-sphere diameter: 0.45 μm, variation coefficient in terms of equivalent-sphere diameter: 23%, tabular grains, aspect ratio: 2.0) | silver 0.18 |
| Gelatin | 0.77 |
| ExS-1 | $2.4 \times 10^{-4}$ |
| ExS-2 | $1.4 \times 10^{-4}$ |
| ExS-5 | $2.3 \times 10^{-4}$ |
| ExS-7 | $4.1 \times 10^{-6}$ |
| ExC-1 | $9.0 \times 10^{-2}$ |
| ExC-2 | $2.0 \times 10^{-2}$ |
| ExC-3 | $4.0 \times 10^{-2}$ |
| ExC-4 | $2.0 \times 10^{-2}$ |
| ExC-5 | $8.0 \times 10^{-2}$ |
| ExC-6 | $2.0 \times 10^{-2}$ |
| ExC-9 | $1.0 \times 10^{-2}$ |
| Layer 3: Medium red-sensitive emulsion layer | |
| Silver bromoiodide emulsion (AgI 6.0 mol %, internally high AgI type, core/shell ratio: 1:2, equivalent-sphere diameter: 0.65 μm, variation coefficient in terms of equivalent-sphere diameter: 35%, tabular grains, aspect ratio: 2.0) | silver 0.80 |
| Gelatin | 1.46 |
| ExS-1 | $2.4 \times 10^{-4}$ |
| ExS-2 | $1.4 \times 10^{-4}$ |
| ExS-5 | $2.4 \times 10^{-4}$ |
| ExS-7 | $4.3 \times 10^{-6}$ |
| ExC-1 | 0.19 |
| ExC-2 | $1.0 \times 10^{-2}$ |
| ExC-3 | $2.5 \times 10^{-2}$ |
| ExC-4 | $1.6 \times 10^{-2}$ |
| ExC-5 | 0.19 |
| ExC-6 | $2.0 \times 10^{-2}$ |
| ExC-7 | $3.0 \times 10^{-2}$ |
| ExC-8 | $1.0 \times 10^{-2}$ |
| ExC-9 | $3.0 \times 10^{-2}$ |
| Layer 4: High red-sensitive emulsion layer | |
| Silver bromoiodide emulsion (AgI 9.3 mol %, multi-structure grains, core/shell ratio: 3:4:2, AgI contents: 24, 0, 6 mol % from the inner part, equivalent-sphere diameter: 0.75 um, variation coefficient in terms of equivalent-sphere diameter: 42%, tabular grains, aspect ratio: 2.5) | silver 1.05 |
| Gelatin | 1.38 |
| ExS-1 | $2.0 \times 10^{-4}$ |
| ExS-2 | $1.1 \times 10^{-4}$ |
| ExS-5 | $1.9 \times 10^{-4}$ |
| ExS-7 | $1.4 \times 10^{-5}$ |
| ExC-1 | $8.0 \times 10^{-2}$ |
| ExC-4 | $9.0 \times 10^{-2}$ |
| ExC-6 | $2.0 \times 10^{-2}$ |
| ExC-9 | $1.0 \times 10^{-2}$ |
| Solv-1 | 0.20 |
| Solv-2 | 0.53 |
| Layer 5: Interlayer | |
| Gelatin | 0.62 |
| Cpd-1 | 0.13 |
| Polyethylacrylate latex | $8.0 \times 10^{-2}$ |
| Solv-1 | $8.0 \times 10^{-2}$ |
| Layer 6: Low green-sensitive emulsion layer | |
| Silver bromoiodide emulsion (AgI 4.0 mol %, uniform AgI type, equivalent-sphere diameter: 0.45 μm, variation coefficient in terms of equivalent-sphere diameter: 20%, tabular grains, aspect ratio: 4.0) | silver 0.13 |
| Gelatin | 0.31 |
| ExS-3 | $1.0 \times 10^{-4}$ |
| ExS-4 | $3.1 \times 10^{-4}$ |
| ExS-5 | $6.4 \times 10^{-5}$ |
| ExM-1 | 0.12 |
| ExM-3 | $2.1 \times 10^{-2}$ |
| Solv-1 | 0.09 |
| Solv-4 | $7.0 \times 10^{-3}$ |
| Layer 7: Medium green-sensitive emulsion layer | |
| Silver bromoiodide emulsion (AgI 4.0 mol %, uniform AgI type, equivalent-sphere diameter: 0.65 μm, variation coefficient in terms of equivalent-sphere diameter: 25%, tabular grains, aspect ratio: 4.0) | silver 0.31 |

-continued

| | |
|---|---|
| Gelatin | 0.54 |
| ExS-3 | $2.7 \times 10^{-4}$ |
| ExS-4 | $8.2 \times 10^{-4}$ |
| EXS-5 | $1.7 \times 10^{-4}$ |
| ExM-1 | 0.27 |
| ExM-3 | $7.2 \times 10^{-2}$ |
| ExY-1 | $5.4 \times 10^{-2}$ |
| Solv-1 | 0.23 |
| Solv-4 | $1.8 \times 10^{-2}$ |
| Layer 8: High green-sensitive emulsion layer | |
| Silver bromoiodide emulsion (AgI 9.8 mol %, multi-structure grains, silver ratio: 3:4:2, AgI contents: 24, 0, 3 mol % from the inner part, equivalent-sphere diameter: 0.81 μm, variation coefficient in terms of equivalent-sphere diameter: 51%, multi-structure twin tabular grains, aspect ratio: 2.5) | silver 0.49 |
| Gelatin | 0.61 |
| ExS-4 | $4.3 \times 10^{-4}$ |
| ExS-5 | $8.6 \times 10^{-5}$ |
| ExS-8 | $2.8 \times 10^{-5}$ |
| ExM-2 | $1.0 \times 10^{-2}$ |
| ExM-5 | $1.0 \times 10^{-2}$ |
| ExM-6 | $3.0 \times 10^{-2}$ |
| ExY-1 | $1.5 \times 10^{-2}$ |
| ExC-1 | $0.4 \times 10^{-2}$ |
| ExC-4 | $2.5 \times 10^{-3}$ |
| ExC-6 | $0.5 \times 10^{-2}$ |
| Solv-1 | 0.12 |
| Cpd-8 | $1.0 \times 10^{-2}$ |
| Layer 9: Interlayer | |
| Gelatin | 0.56 |
| Cpd-1 | $4.0 \times 10^{-2}$ |
| Polyethylacrylate latex | $5.0 \times 10^{-2}$ |
| Solv-1 | $3.0 \times 10^{-2}$ |
| UV-4 | $3.0 \times 10^{-2}$ |
| UV-5 | $4.0 \times 10^{-2}$ |
| Layer 10: Multilayer-effect donor layer for red-sensitive layers | |
| Silver bromoiodide emulsion (AgI 8.0 mol %, internally high AgI type, core/shell ratio: 1:2, equivalent-sphere diameter: 0.72 μm, variation coefficient in terms of equivalent-sphere diameter: 49%, multi-structure twin tabular grains, aspect ratio: 2.0) | silver 0.67 |
| Silver bromoiodide emulsion (AgI 10.0 mol %, internally high AgI type, core/shell ratio: 1:3, equivalent-sphere diameter: 0.40 μm, variation coefficient in terms of equivalent-sphere diameter: 15%, regular grains) | silver 0.20 |
| Gelatin | 0.87 |
| ExS-3 | $6.7 \times 10^{-4}$ |
| ExM-4 | 0.06 |
| ExM-8 | 0.10 |
| Solv-1 | 0.30 |
| Solv-6 | $3.0 \times 10^{-2}$ |
| Layer 11: Yellow filter layer | |
| Yellow colloidal silver | $9.0 \times 10^{-2}$ |
| Gelatin | 0.84 |
| Cpd-2 | 0.13 |
| Solv-1 | 0.13 |
| Cpd-1 | $5.0 \times 10^{-2}$ |
| Cpd-6 | $2.0 \times 10^{-3}$ |
| H-1 | 0.25 |
| Layer 12: Low blue-sensitive emulsion layer | |
| Silver bromoiodide emulsion-U | silver 0.80 |
| Gelatin | 2.18 |
| ExS-6 | $9.0 \times 10^{-4}$ |
| ExC-1 | 0.05 |
| ExC-2 | 0.10 |
| ExY-2 | 0.05 |
| EXY-U | 1.09 |
| Solv-1 | 0.54 |
| Layer 13: Interlayer | |
| Gelatin | 0.30 |
| ExY-4 | 0.14 |
| Solv-1 | 0.14 |
| Layer 14: Low blue-sensitive emulsion layer | |
| Silver bromoiodide emulsion-O | silver 0.40 |
| Gelatin | 0.59 |

-continued

| | |
|---|---|
| ExS-6 | $2.6 \times 10^{-4}$ |
| ExY-2 | $1.0 \times 10^{-2}$ |
| ExY-O | 0.20 |
| ExC-1 | $1.0 \times 10^{-2}$ |
| Solv-1 | $9.0 \times 10^{-2}$ |
| Layer 15: First protective layer | |
| Fine-grain silver bromoiodide emulsion (AgI 2.0 mol %, uniform AgI type, equivalent-sphere diameter: 0.07 μm) | silver 0.12 |
| Gelatin | 0.63 |
| UV-4 | 0.11 |
| UV-5 | 0.18 |
| Solv-5 | $2.0 \times 10^{-2}$ |
| Cpd-5 | 0.10 |
| Polyethylacrylate latex | $9.0 \times 10^{-2}$ |
| Layer 16: Second protective layer | |
| Fine-grain silver bromoiodide emulsion (AgI 2.0 mol %, uniform AgI type, equivalent-sphere diameter: 0.07 μm) | silver 0.36 |
| Gelatin | 0.85 |

-continued

| | |
|---|---|
| B-1 (diameter: 2.0 μm) | $8.0 \times 10^{-2}$ |
| B-2 (diameter: 2.0 μm) | $8.0 \times 10^{-2}$ |
| B-3 | $2.0 \times 10^{-2}$ |
| W-4 | $2.0 \times 10^{-2}$ |
| H-1 | 0.18 |

Further, 1,2-benzisothiazoline- 3-one, n-butyl-p-hydroxybenzoate, and 2-phenoxyethanol were added to Samples thus formed, in average amounts of about 200 ppm, about 1,000 ppm, and about 10,000 ppm, respectively, per part of the gelatin. Also, the samples, thus formed, contained B-4, B-5, F-1, F-2, F-3, F-4, F-5, F-6, F-7, F-8, F-9, F-10, F-11, F-12, iron salt, lead salt, gold salt, platinum salt, iridium salt, and rhodium salt.

Besides the components described above, surfactants W-1, W-2, and W-3 were added, as coating aids or emulsification dispersants, to each of the layers.

UV-1

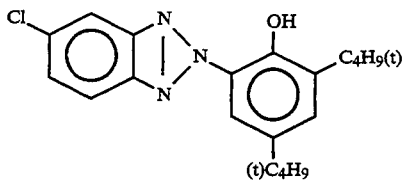

UV-2

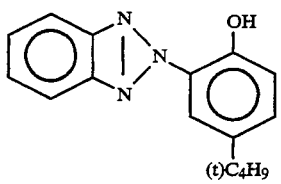

UV-3

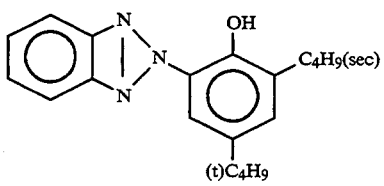

UV-4

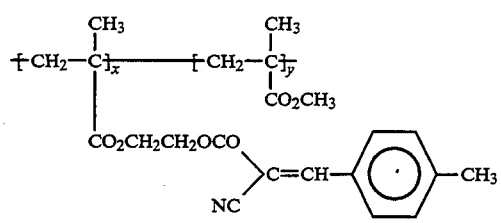

x:y = 70:30 (wt %)

UV-5

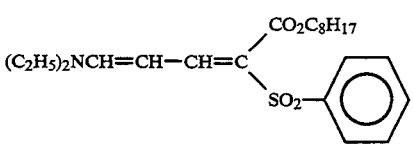

Solv-1

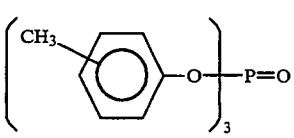

-continued
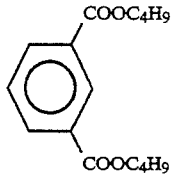
Solv-2
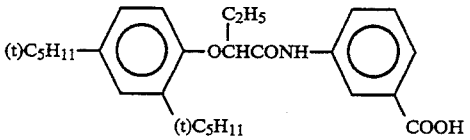
Solv-4
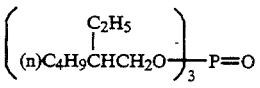
Solv-5
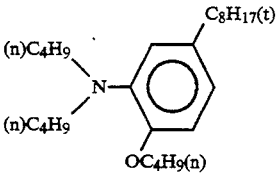
Solv-6
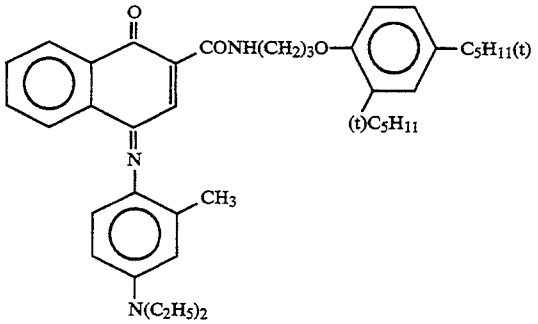
ExF-1
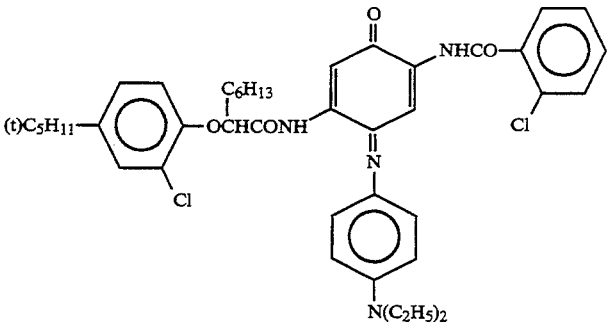
ExF-2
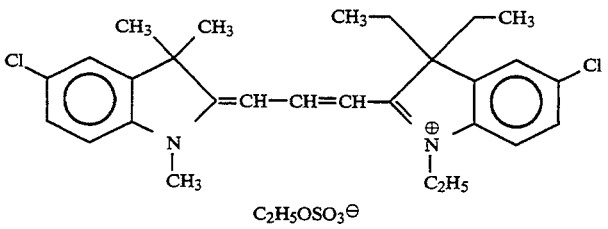
ExF-3

-continued
ExC-1
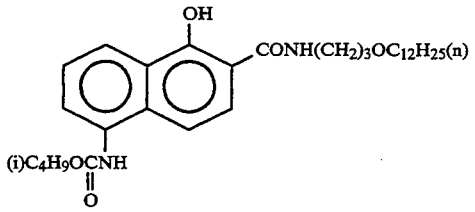
ExC-2
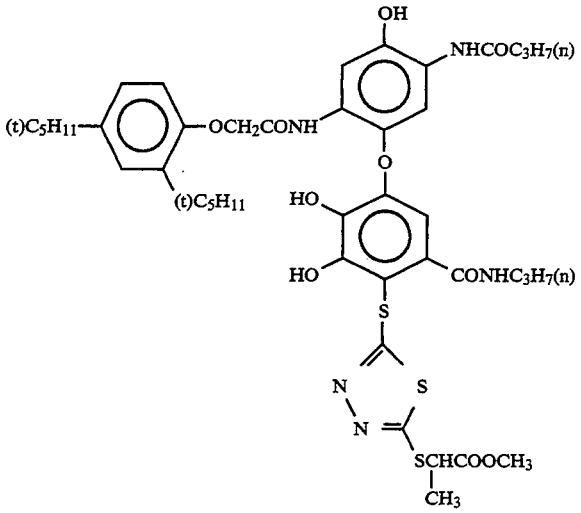
ExC-3
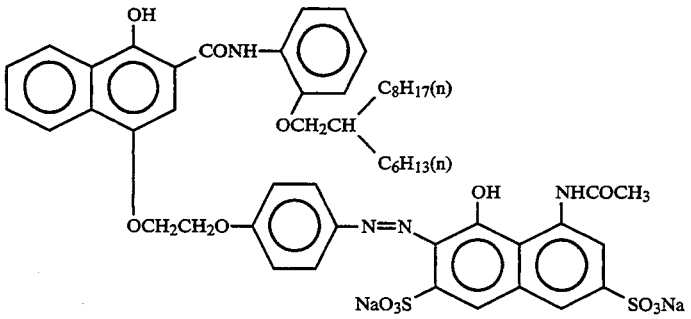
ExC-4
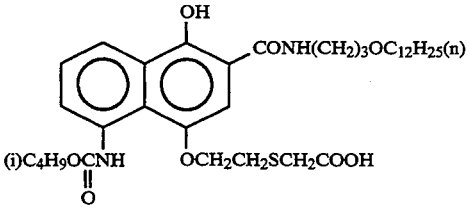
ExC-5
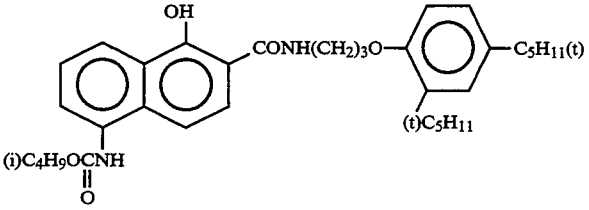

-continued
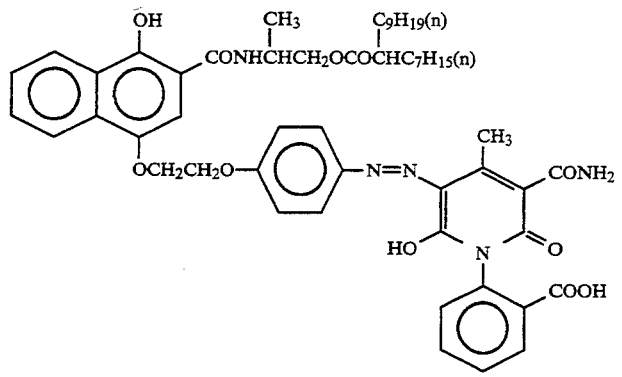
ExC-6
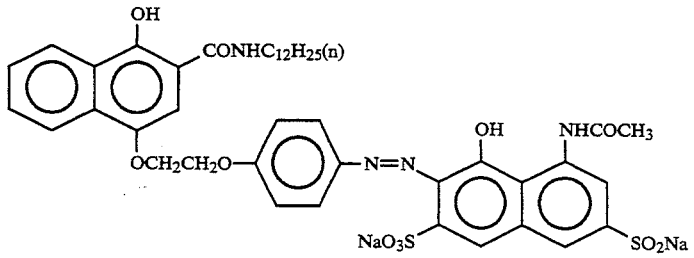
ExC-7
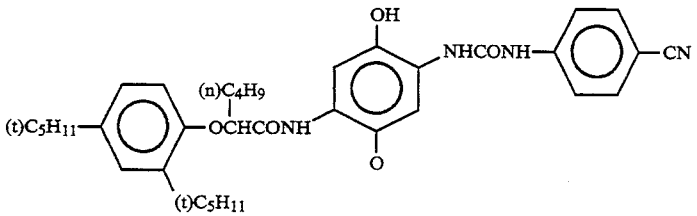
ExC-8
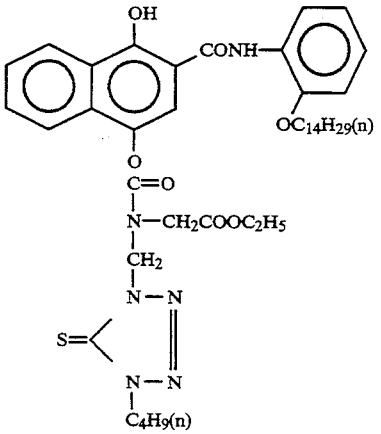
ExC-9

-continued
ExM-1
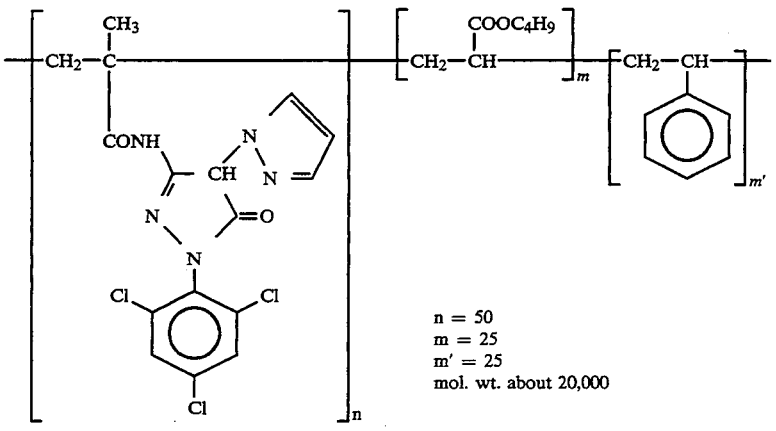
ExM-2
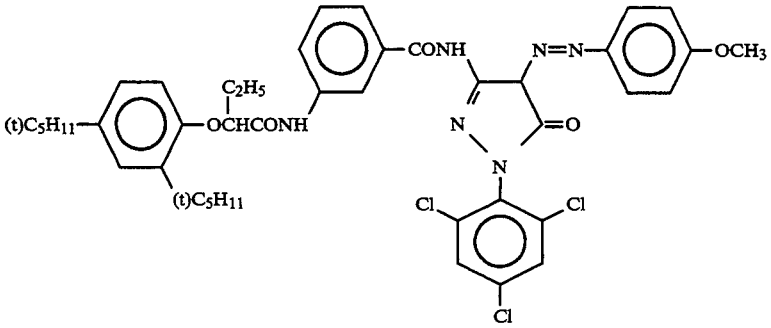
ExM-3
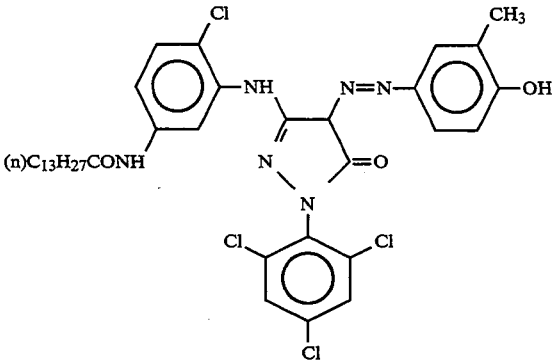
ExM-4
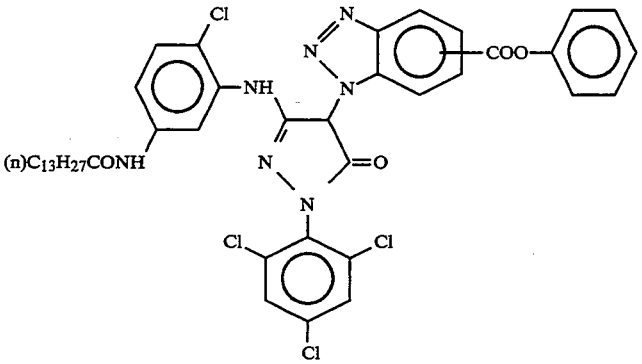

-continued
ExM-5
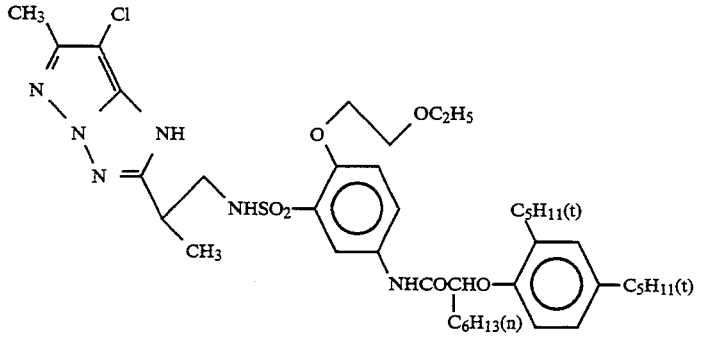
ExM-6
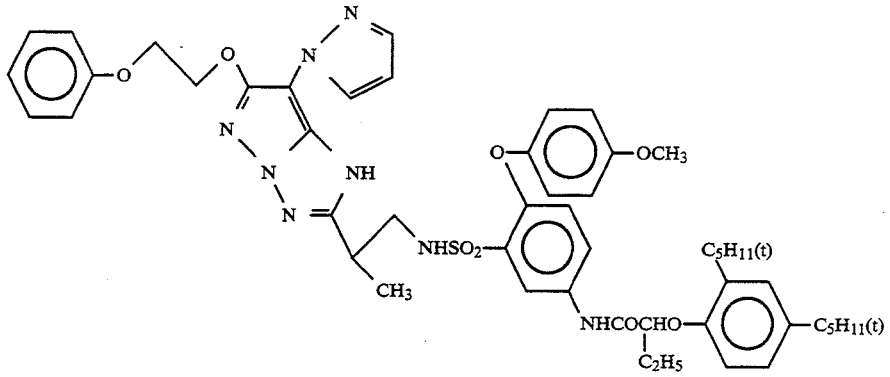
ExM-7
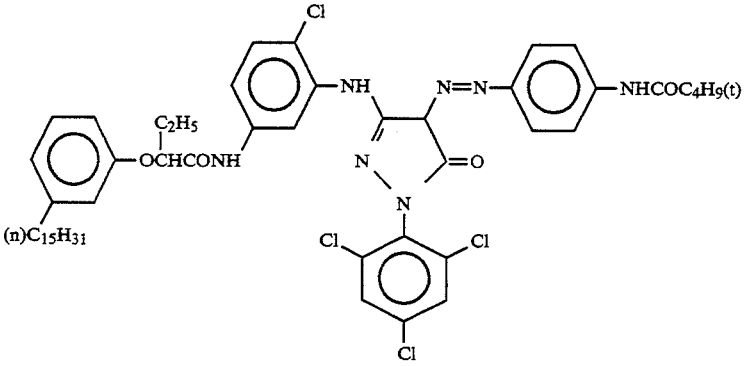
ExM-8
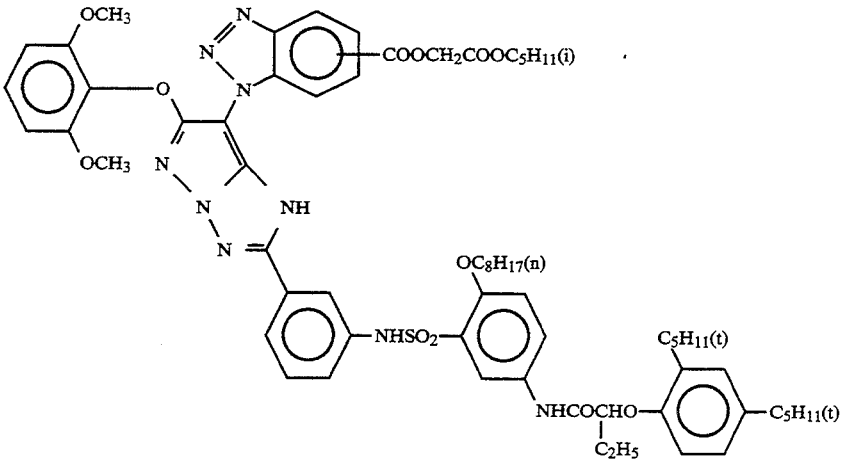

-continued
ExY-1
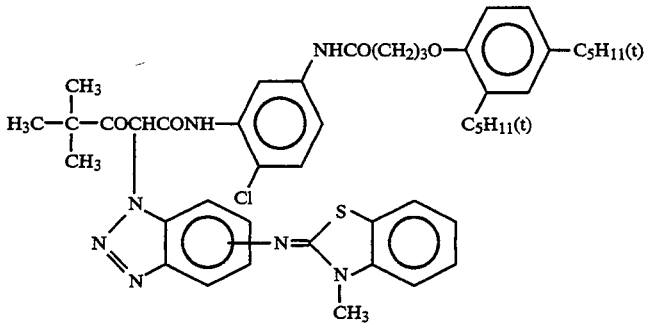
ExY-2
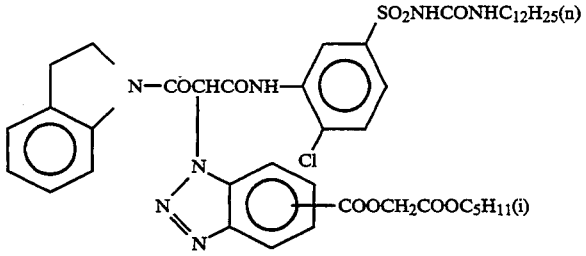
ExY-3
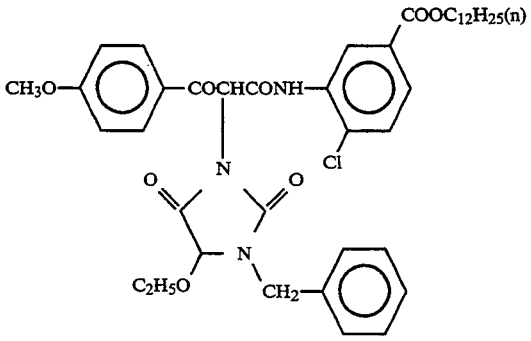
ExY-4
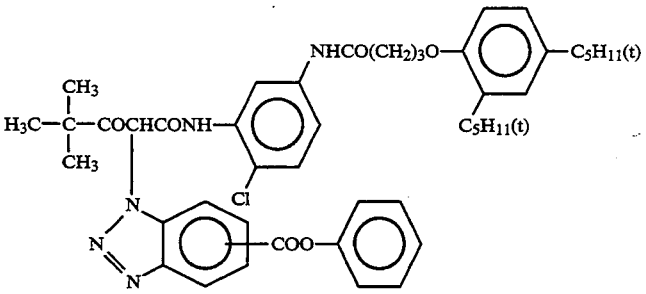
ExY-5
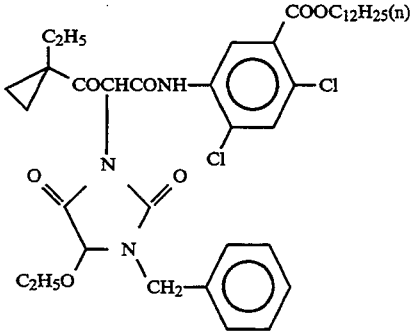

-continued
Cpd-1
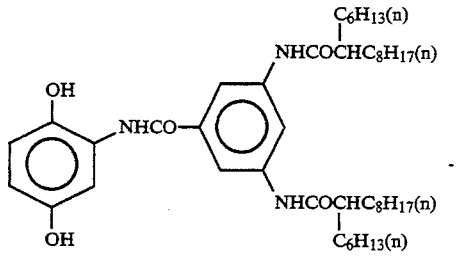
Cpd-2
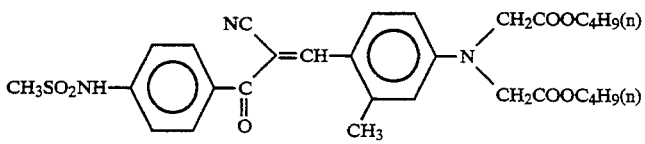
Cpd-5
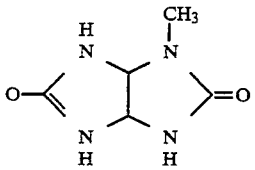
Cpd-7
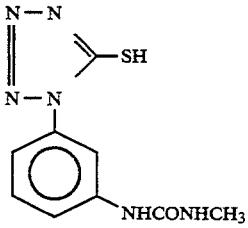
Cpd-8
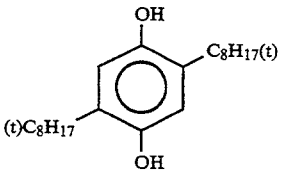
H-1
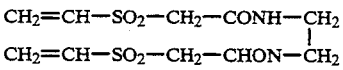
W-1
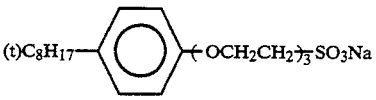
W-2
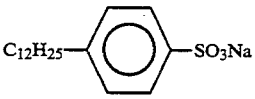
W-3
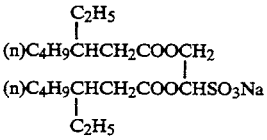
W-4
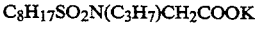

-continued
ExS-1
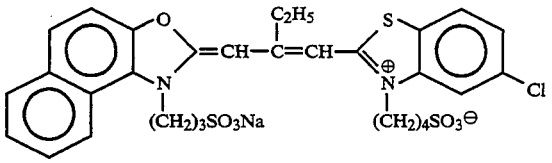
ExS-2
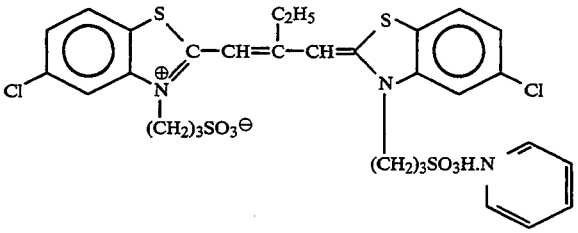
ExS-3
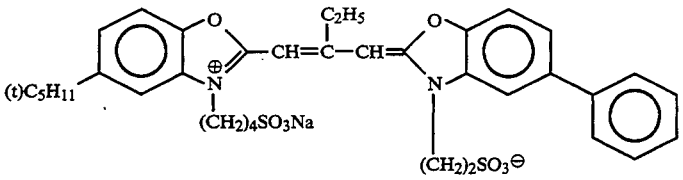
ExS-4
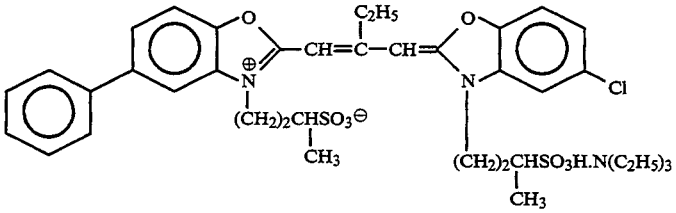
ExS-5
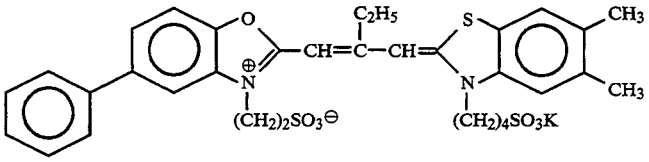
ExS-6
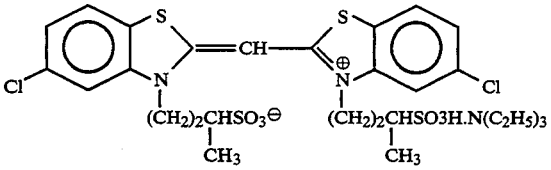
ExS-7
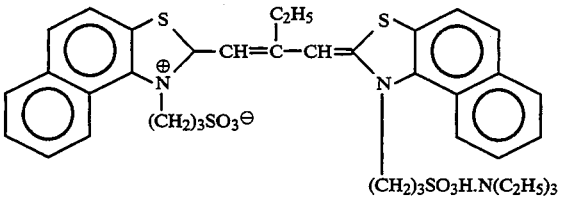
ExS-8
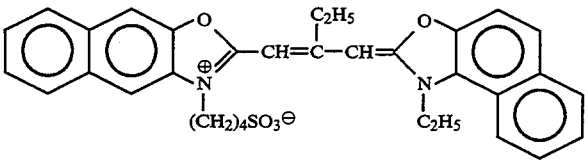

-continued
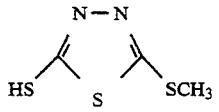
F-1
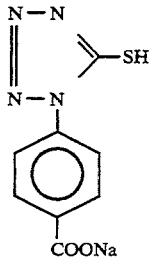
F-2
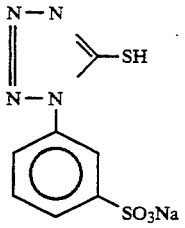
F-3
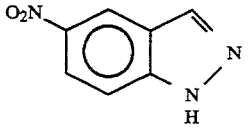
F-4
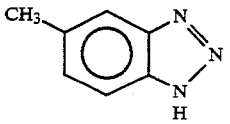
F-5
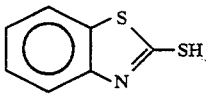
F-6
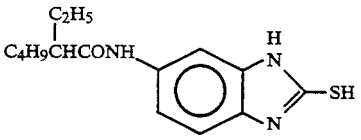
F-7
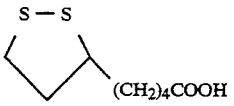
F-8
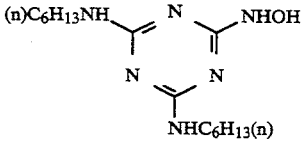
F-9
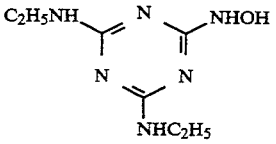
F-10

-continued

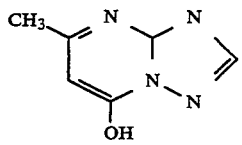

F-11

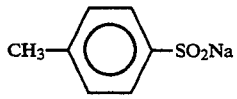

F-12

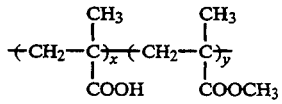

x/y = 10/90

B-1

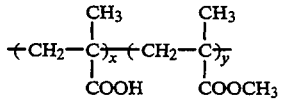

x/y = 40/60

B-2

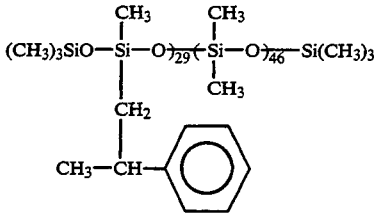

B-3

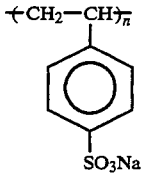

B-4

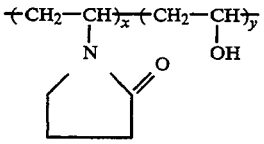

x/y = 70/30

B-5

In Table 2, EM-5 is a silver halide emulsion containing 10.0 mol % of AgI, internally high AgI type, multistructure twinned tabular grains having an equivalent-sphere diameter of 1.4 μm, variation coefficient of 70% in terms of equivalent-sphere diameter, and an aspect ratio of 2.0. In Table 2, yellow couplers ExY-U and Ex-O were replaced in equi-molar amounts.

Samples 101 to 116 were imagewise exposed to white light at a shutter speed of 1/100 second, and were subjected to the color development specified below. The photographic sensitivity of each sample, thus developed, was as is shown in the following Table 3. Relative sensitivity S(D)n shown in Table 3, which is defined below, was determined from the exposure amount E (CMS) corresponding to that fog positive optical density on the sensitomery curve which had been measured by a filter which having the spectral transmission factor characteristic indicated by curve 10 in FIG. 1.

$$S(D)n=(Eo/En)\times 100$$

where En is the exposure amount which imparted the above-mentioned sensitivity to any sample n, and Eo is the exposure amount which imparted the lowest optical sensitivity to the sample which had a lower sensitivity than any other sample. Samples were left to stand at 70° C. at a relative humidity of 70 for 4 weeks, and their densities were measured again, thereby determining the changes in their yellow densities, which are specified as color fastness in Table 3.

TABLE 3

| Sample No. | Relative sensitivity S (D = 1.0)n | Dye stability (density decrease) |
|---|---|---|
| 101 (Invention) | 170 | 0.03 |
| 102 (Invention) | 147 | 0.03 |
| 103 (Invention) | 155 | 0.03 |
| 104 (Comparative) | 115 | 0.06 |
| 105 (Invention) | 160 | 0.02 |
| 106 (Invention) | 140 | 0.04 |
| 107 (Invention) | 140 | 0.02 |
| 108 (Comparative) | 110 | 0.05 |
| 109 (Invention) | 143 | 0.03 |
| 110 (Invention) | 127 | 0.04 |
| 111 (Invention) | 129 | 0.02 |
| 112 (Comparative) | 100 | 0.05 |
| 113 (Comparative) | 150 | 0.13 |
| 114 (Comparative) | 135 | 0.15 |
| 115 (Comparative) | 135 | 0.14 |

TABLE 3-continued

| Sample No. | Relative sensitivity S (D = 1.0)n | Dye stability (density decrease) |
|---|---|---|
| 116 (Comparative) | 102 | 0.16 |

| Processing Method | | | | |
|---|---|---|---|---|
| Process | Time | Temp. | Quantity of replenisher* | Tank volume |
| Color development | 3 min. 15 sec. | 38° C. | 45 ml | 10 l |
| Bleaching | 1 min. 00 sec. | 38° C. | 20 ml | 4 l |
| Bleach-Fixing | 3 min. 15 sec. | 38° C. | 30 ml | 8 l |
| Washing (1) | 40 sec. | 35° C. | ** | 4 l |
| Washing (2) | 1 min. 00 sec. | 35° C. | 30 ml | 4 l |
| Stabilization | 40 sec. | 38° C. | 20 ml | 4 l |
| Drying | 1 min. 15 sec. | 55° C. | | |

*Note: The amount presented is per meter of a 35 mm-wide sample.
**Note: The replenisher was supplied in counter flow from the step (2) to the step (1).

The compositions of the solutions used in the process are as follows:

| (Color Developing Solution) | Mother Solution (g) | Replenisher (g) |
|---|---|---|
| Diethylenetriamine-pentaacetic acid | 1.0 | 1.1 |
| 1-hydroxyethylidine-1,1-diphosphonic acid | 3.0 | 3.2 |
| Sodium sulfite | 4.0 | 4.4 |
| Potassium carbonate | 30.0 | 37.0 |
| Potassium bromide | 1.4 | 0.7 |
| Potassium iodide | 1.5 mg | — |
| Hydroxylamine sulfate | 2.4 | 2.8 |
| 4-(N-ethyl-N-β-hydroxylethylamino)-2-methylaniline sulfate | 4.5 | 5.5 |
| Water to make | 1.0 l | 1.0 l |
| pH | 10.05 | 10.10 |

| (Bleaching Solution): The same solution used for mother solution and replenisher | (g) |
|---|---|
| Ethylenediamine tetraacetic acid, iron (III) ammonium salt dehydrate | 120.0 |
| Ethylenediamine tetraacetic acid, disodium salt | 10.0 |
| Ammonium bromide | 100.0 |
| Ammonium nitrate | 10.0 |
| Bleach accelerator $\{(CH_3)_2N—CH_2CH_2—S\}_2$ 2HCl | 0.005 mol |
| Ammonia water (27%) | 15.0 ml |
| Water to make | 1.0 l |
| pH | 6.3 |

| (Bleach-Fixing Solution): The same solution used for mother solution and replenisher | (g) |
|---|---|
| Ethylenediaminetetraacetic acid iron (III) ammonium salt dehydrate | 50.0 |
| Ethylenediamine tetraacetic acid, disodium salt | 5.0 |
| Sodium sulfite | 12.0 |
| Aqueous solution of ammonium thiosulfate (70%) | 240.0 ml |
| Ammonia water (27%) | 6.0 ml |
| water to make | 1.0 l |
| pH | 7.2 |

(Washing Solution): The same solution used for mother solution and replenisher

The solution as follows. First, tap water was passed through a mixed-bed column filled with H-type strong-acid cation exchange resin (Amberlite IR-120B) and OH-type strong-base anion exchange resin (Amberlite IR-400), both resins made by manufactured by Rome and Harse, Inc., whereby the calcium and magnesium ion concentration in the water was reduced to 3 mg/l or less. Next, 20 mg/l of sodium dichloroisocyanurate and 0.15 g/l of sodium sulfate were added to the water. The washing solution had pH value ranging from 6.5 to 7.5.

| (Stabilizing Solution): The same solution used for mother solution and replenisher | (g) |
|---|---|
| Formalin (37%) | 2.0 ml |
| Polyoxyethylene-p-monononyl phenylether (av. polymerization degree: 10) | 0.3 |
| Ethylenediaminetetraacetic acid, disodium salt | 0.05 |
| Water to make | 1.0 l |

As is evident from Table 3, the samples of the present invention were color light-sensitive materials which had high sensitivities and excelled in yellow-image fastnesses (storage stabilities).

EXAMPLE 2

(Preparation of EM-6)

A silver halide emulsion, hereinafter called "EM-6," was prepared in the same method as EM-1, except that sensitizing dye I-1 was adsorbed by 80% of its saturated adsorption amount after the desalting and before the chemical sensitization, and gold, sulfur and selenium sensitizations were optimally carried out.

(Preparation of EM-7)

Another silver halide emulsion, hereinafter called "EM-7," was prepared in the same method as EM-6, except that only good and sulfur sensitizations were optimally carried out.

(Preparation of EM-8)

Still another silver halide emulsion, hereinafter called "EM-8," was prepared in the same method as EM-1, except that sensitizing dye of the following formula (A) was adsorbed by 80% of its saturated adsorption amount after the desalting and before the chemical sensitization, and gold, sulfur and selenium sensitizations were optimally carried out.

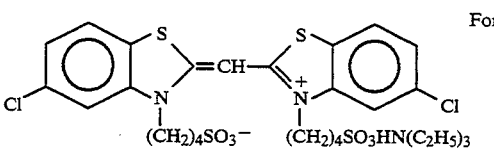

Formula (A)

(Preparation of EM-9)

A silver halide emulsion, hereinafter called "EM-9," was prepared in the same method as EM-8, except that only good and sulfur sensitizations were optimally carried out.

The properties of EM-6 to M-9 were as is shown in the following Table 4:

TABLE 4

| Emulsion No. | Seed-crystal emulsion | Reduction sensitization | Dislocation lines | Average aspect ratio | Equivalent-sphere diameter | Chemical sensitization | Sensitizing dye |
|---|---|---|---|---|---|---|---|
| EM-6 | α | Performed | 70% or more of all grains had 30 or more dislocation lines each | 6 | 0.8 | Gold, sulfur, selenium | 1-I |
| EM-7 | α | Performed | The same as above | 6 | 0.8 | Gold, sulfur | 1-I |
| EM-8 | α | Performed | The same as above | 6 | 0.8 | Gold, sulfur selenium | Formula A |
| EM-9 | α | Performed | The same as above | 6 | 0.8 | Gold, sulfur | Formula A |

Samples 201 to 216 were formed in the same way as in Example 1, using EM-6 to EM-9 as is specified in the following Table 5:

TABLE 5

| Sample No. | Silver bromoiodide emulsion-U in layer 12 | ExY-U in layer 12 | Silver bromoiodide emulsion-O in layer 14 | ExY-O in layer 14 | Remarks |
|---|---|---|---|---|---|
| 201 | EM-6 | Y-5 | EM-5 | Y-5 | Invention |
| 202 | EM-7 | Y-5 | EM-5 | Y-5 | Invention |
| 203 | EM-8 | Y-5 | EM-5 | Y-5 | Invention |
| 204 | EM-9 | Y-5 | EM-5 | Y-5 | Invention |
| 205 | EM-6 | Y-28 | EM-5 | Y-28 | Invention |
| 206 | EM-7 | Y-28 | EM-5 | Y-28 | Invention |
| 207 | EM-8 | Y-28 | EM-5 | Y-28 | Invention |
| 208 | EM-9 | Y-28 | EM-5 | Y-28 | Invention |
| 209 | EM-6 | Y-30 | EM-5 | Y-30 | invention |
| 210 | EM-7 | Y-30 | EM-5 | Y-30 | Invention |
| 211 | EM-8 | Y-30 | EM-5 | Y-30 | Invention |
| 212 | EM-9 | Y-30 | EM-5 | Y-30 | Invention |
| 213 | EM-6 | ExY-3 | EM-5 | ExY-3 | Comparative |
| 214 | EM-7 | ExY-3 | EM-5 | ExY-3 | Comparative |
| 215 | EM-8 | ExY-3 | EM-5 | ExY-3 | Comparative |
| 216 | EM-9 | ExY-3 | EM-5 | ExY-3 | Comparative |

These samples were exposed, developed and tested in the same way as the samples of Example 1, thereby measuring their relative sensitivities S(D)n. Their color fastnesses were also determined in the same way as as in Example 1. These results is shown in Table 6. The samples were left to stand at 40° C. at a relative humidity of 70 for 14 hours. Further, they were left in an atmosphere having a relative humidity of 55% for 3 or more hours. Thereafter, a load of 4 g was applied to each sample, still in said atmosphere, with a needle having a diameter of 0.1 mm, while moving the needle at a speed of 1 cm/sec, thus scratching the emulsion layer of the sample. The sample was then developed in the same way as in Example 1 and tested for its density, using an aperture having a diameter of 25 μm. The results were as is shown in the following Table 6:

TABLE 6

| Sample No. | Relative sensitivity S (D = 1.0)n | Fog increase due to scratching | Dye stability (density decrease) |
|---|---|---|---|
| 201 (Invention) | 150 | 0.17 | 0.03 |
| 202 (Invention) | 120 | 0.17 | 0.03 |
| 203 (Invention) | 129 | 0.27 | 0.04 |
| 204 (Invention) | 110 | 0.29 | 0.04 |
| 205 (Invention) | 145 | 0.16 | 0.02 |
| 206 (Invention) | 113 | 0.15 | 0.03 |
| 207 (Invention) | 144 | 0.30 | 0.04 |
| 208 (Invention) | 100 | 0.29 | 0.05 |
| 209 (Invention) | 133 | 0.15 | 0.02 |
| 210 (Invention) | 115 | 0.17 | 0.02 |
| 211 (Invention) | 123 | 0.27 | 0.03 |
| 212 (Invention) | 100 | 0.28 | 0.04 |
| 213 (Comparative) | 145 | 0.19 | 0.15 |
| 214 (Comparative) | 105 | 0.19 | 0.14 |
| 215 (Comparative) | 144 | 0.30 | 0.14 |
| 216 (Comparative) | 101 | 0.29 | 0.16 |

As is evident from Table 6, any sample using silver halide emulsions containing sensitizing dye I-1 had a fog increase (due to the scratching) less than those using silver halide emulsions containing the compound of the formula (A) as sensitizing dye. It is also obvious that any sample using silver halide emulsions which had been gold-, sulfur- and selenium-sensitized exhibited a relative sensitivity higher than any sample using silver halide emulsion which had been subjected to gold sensitization and sulfur sensitization only. In terms of color-image fastness, the samples according to this invention were particularly excellent, as in the case of Example 1.

EXAMPLE 3

(Preparation of EM-10)

Twenty-nine grams of inactive gelatin, 34 g of potassium bromide, and 18 g of potassium iodide were dissolved in 1300 cc of distilled water, thereby forming an aqueous solution. In the meantime, ammonium water was added to 400 cc of an aqueous solution containing 60 g of silver nitrate until the solution became transparent. An aqueous solution containing potassium bromide in an amount excessive to silver was also prepared. The silver nitrate solution and the potassium bromide solution, thus prepared were simultaneously added over 4 minutes to the solution containing inactive gelatin, potassium bromide and potassium iodide, while this solution is being stirring at 75° C. Thereafter, 60 cc of 25% ammonia water was added to the resultant solution, and the solution was physically ripened for 10 minutes. The pH value of the solution was adjusted to 6.0. Thiourea dioxide was added to the solution in an amount of $4\times10^{-6}$ mol per mol of silver of the silver nitrate used in EM-10, and a compound of the formula (III) in which R is ethyl and M is sodium was added to the solution in an amount of $1\times10^{-4}$ mol per mol of silver of the silver nitrate used in EM-10. Next, 800 cc of an aqueous solution containing 120 g of silver nitrate, and an aqueous solution of potassium bromide were added simultaneously to the solution over 80 minutes, during which time the pAg value was maintained at 7.8.

Thereafter, the solution was desalted by the ordinary method. Gelatin was added to the solution and optimally gold-sensitized with chloroauric acid and optimally sulfur-sensitized with sodium thiosulftate. Sensitizing dye I-1 was adsorbed by 40% of its saturated adsorption amount. As a result, a silver halide emulsion was prepared, which shall be called "EM-10."

(Preparation of EM-11)

Another silver halide emulsion was prepared in the same way as EM-10, except that the compound of the formula (A) was used, in place of dye I-1, and adsorbed by 40% of its saturated adsorption amount. This emulsion shall be called "EM-11."

EM-10 and EM-11 were examined under a transmission electron microscope to determine how many dislocation liens each grain had. It was found that 70% or more of all grains contained in each emulsion had 30 or more dislocation lines each. Also, EM-10 and EM-11 were examined in the same way as in Example 1 to measure the equivalent-sphere diameter and variation coefficient thereof. It was found that the equivalent-sphere diameter and variation coefficient of each emulsion were 1.4 μm and 70%, respectively.

(Preparation of EM-12)

Still another silver halide emulsion was prepared in the same way as EM-3, except that sensitizing dye I-1 was adsorbed by 80% of its saturated adsorption amount after the desalting and before the chemical sensitization and was gold- and sulfur-sensitized optimally. This emulsion shall be called "EM-12."

Samples 301 to 308 were formed in the same way as in Example 1. The structure of Samples 301 to 308 is shown in the following Table 7:

TABLE 7

| Sample No. | Silver bromoiodide emulsion in layer 12 | ExY-U in layer 12 | Silver bromoiodide emulsion in layer 14 | ExY-O in layer 14 | Remarks |
|---|---|---|---|---|---|
| 301 | Mixture of EM-7 and EM-12 (silver ratio: 4:7) | Y-5 | EM-10 | Y-5 | Invention |
| 302 | The same as above | Y-5 | EM-11 | Y-5 | Invention |
| 303 | The same as above | Y-28 | EM-10 | Y-28 | Invention |
| 304 | The same as above | Y-28 | EM-11 | Y-28 | Invention |
| 305 | The same as above | Y-30 | EM-10 | Y-30 | Invention |
| 306 | The same as above | Y-30 | EM-11 | Y-30 | Invention |
| 307 | The same as above | ExY-3 | EM-10 | ExY-3 | Comparative |
| 308 | The same as above | ExY-3 | EM-11 | ExY-3 | Comparative |

These samples were subjected to scratching test in the same way as the samples of Example 2, thereby determining the fog increase of each sample. Also, the color-image fastness of each sample was determined by the same method as used in Example 1. The results were as is shown in the following Table 8:

TABLE 8

| Sample No. | Fog increase due to scratching | Dye stability (density decrease) |
|---|---|---|
| 301 (Invention) | 0.28 | 0.02 |
| 302 (Invention) | 0.49 | 0.03 |
| 303 (Invention) | 0.25 | 0.03 |
| 304 (Invention) | 0.49 | 0.04 |
| 305 (Invention) | 0.27 | 0.03 |
| 306 (Invention) | 0.45 | 0.04 |
| 307 (Comparative) | 0.24 | 0.15 |
| 308 (Comparative) | 0.48 | 0.16 |

As is evident from Table 8, any sample using silver halide emulsions containing sensitizing dye I-1 had a fog increase less than those using silver halide emulsions containing the compound of the formula (A) as sensitizing dye. It obvious that the color-image fastness of any sample according to the invention invention was particularly excellent, as in the case of Example 1.

Additional advantages and modifications will readily occur to those skilled in the art. Therefore, the invention in its broader aspects is not limited to the specific details, and representative material shown and described herein. Accordingly, various modifications may be made without departing from the spirit or scope of the general inventive concept as defined by the appended claims and their equivalents.

What is claimed is:

1. A silver halide color photographic light-sensitive material comprising blue-sensitive emulsion layers containing acylacetoamide type yellow dye-forming couplers represented by the following formula (I), at least one of which contains at least one reduction sensitized silver halide emulsion (A) having silver halide grains, 50% or more of which contain 10 or more dislocation lines per grain,

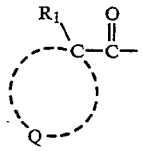

Formula (I)

wherein $R_1$ is a monovalent group, Q is a non-metal atom group which bonds to C to form 3- to 5-membered hydrocarbon ring and $R_1$ is not a hydrogen atom and does not bond to Q to form a ring.

2. The silver halide color photographic light-sensitive material according to claim 1, wherein said blue-sensitive emulsion layers contain the yellow dye-forming couplers represented by the formula (I), at least one of which contains at least one silver halide emulsion which has been spectrally sensitized with a compound represented by the following formula (II),

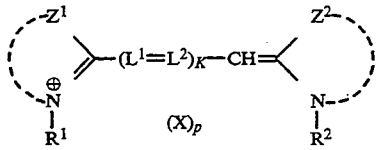

Formula (II)

wherein in formula (II):

$R^1$ *and* $R^2$ are alkyl groups in at least one of which at least one carbon atom bonds to at least three atoms other than hydrogen atoms, $Z^1$ and $Z^2$ are atom groups required to form 5- or 6-membered hetero ring containing nitrogen, $L^1$ and $L^2$ are substituted or unsubstituted methine groups, X is an anion, k is 0, 1 or 2, and p is an integer required for balancing electric charge.

3. This silver halide color photographic light-sensitive material according to claim 1, wherein said blue-sensitive emulsion layers contain the yellow dye-forming couplers represented by the formula (I), at least one of which contains at least one silver halide emulsion which has been chemically sensitized with a gold sensitizer, a sulfur sensitizer, and a selenium sensitizer.

4. The silver halide color photographic light-sensitive material according to claim 1, wherein said silver halide emulsion (A) contains 50% or more silver halide grains having 20 or more dislocation lines per the silver halide grain.

5. The silver halide color photographic light-sensitive material according to claim 1, wherein said silver halide emulsion (A) contains 50% or more silver halide grains having 30 or more dislocation lines per the silver halide grain.

6. The silver halide color photographic light-sensitive material according to claim 1, wherein said silver halide emulsion (A) contains grains having an aspect ratio of 3 or more.

7. The silver halide color photographic light-sensitive material according to claim 1, wherein silver halide emulsion is reduction-sensitized by thiourea dioxide.

8. The silver halide color photographic light-sensitive material according to claim 1, wherein $R_1$, Q and C are formed together and selected from the group consisting of

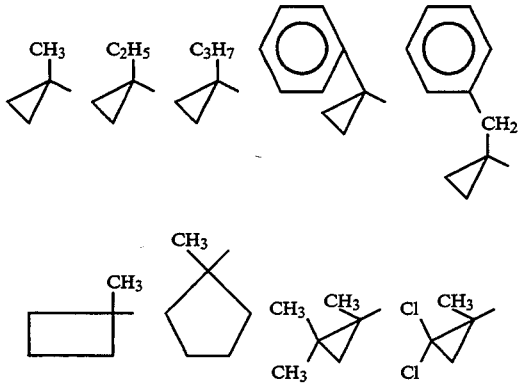

-continued

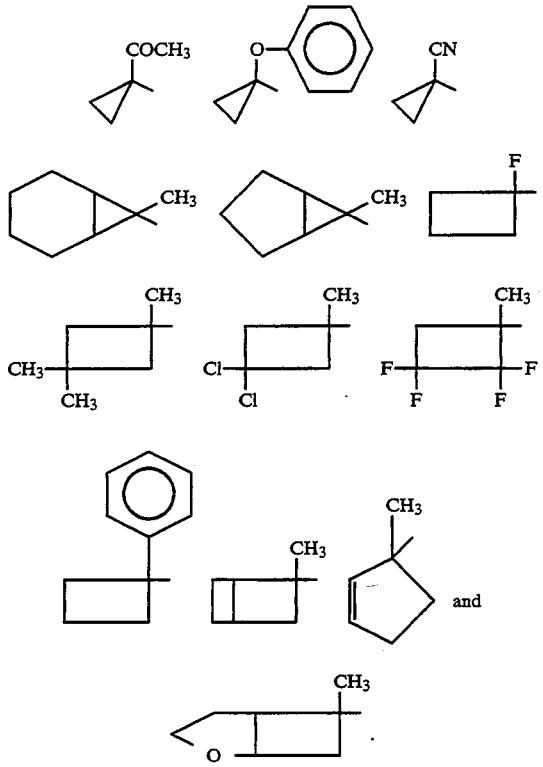

9. The silver halide color photographic light-sensitive material according to claim 1, wherein the reduction sensitized silver halide emulsion (A) is reduction sensitized in the presence of a reduction sensitizer selected from the group consisting of stannous chloride, thiourea dioxide, dimethylamine-borane, and L-ascorbic acid.

10. The silver halide color photographic light-sensitive material according to claim 1, wherein said acylacetoamide type yellow dye-forming couplers is a compound shown in formula (Y):

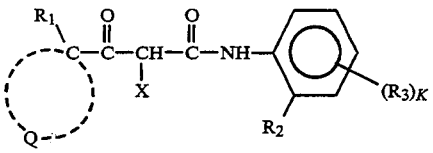

Formula (Y)

wherein $R_1$ is a monovalent group other than a hydrogen atom, Q is a non-metal atom group which bonds to C to form a 3- to 5-membered hydrocarbon ring, $R_2$ is a hydrogen atom, a halogen atom, an alkoxy group, an aryloxy group, an alkyl group, or an amino group, $R_3$ is a group which can be substituted on a benzene ring, X is a hydrogen atom or a leaving group, k is an integer ranging from 0 to 4, and if k is 2 or more, groups $R_3$ may be identical or different.

11. The silver halide color photographic light-sensitive material according to claim 10, wherein $R_3$ is selected from the group consisting of a halogen atom, an alkyl group, an aryl group, an alkoxy group, an aryloxy group, an alkoxycarbonyl group, an aryloxycarbonyl group, a carbonamido group, a sulfonamido group, a carbamoyl group, a sulfamoyl group, an alkylsulfonyl group, an ureido group, a sulfamoylamino group, an alkoxycarbonyl-amino group, an alkoxysulfonyl group, an acyloxy group, a nitro group, a heterocyclic group, a cyano group, an acyl group, an amino group, an imido group, an alkylsufomyloxy group, an arylsulfonyloxy group, a carboxyl group, a sulfo group and a hydroxyl group.

12. The silver halide color photographic light-sensitive material according to claim 10, wherein in formula (Y), $R_1$ is a halogen atom, a cyano group, a monovalent group which may be substituted and has a total carbon number of 1 to 30, or a monovalent group which has a total carbon number of 6 to 30.

13. The silver halide color photographic light-sensitive material according to claim 10, wherein in formula (Y), Q is a nonmetal atom group which may be substituted and form, together with C, a 3- to 5-membered hydrocarbon group which may be substituted and which has a C number of 3 to 30, and the ring which Q and C form may have a unsaturated bond.

14. The silver halide color photographic light-sensitive material according to claim 13, wherein the ring which Q and C form are selected from the group consisting of a cyclopropane ring, a cyclobutane ring, a cyclopentane ring, a cyclopropene ring, a cyclobutene ring, a cyclopentene ring, an oxetane ring, an oxolane ring, a 1,3-dioxolane ring, a thietane ring, a thiolane ring, and a pyrrolidine ring.

15. The silver halide color photographic light-sensitive material according to claim 10, wherein in formula (Y), $R_2$ is a halogen atom, an alkoxy group having a C number of 1 to 30, an aryloxy group having a C number of 6 to 30, alkyl group having a C number of 1 to 30, or an amino group having a C number of 0 to 30.

16. The silver halide color photographic light-sensitive material according to claim 10, wherein in formula (Y), $R_3$ is a halogen atom, an alkyl group having a C number of 1 to 30, an aryl group having a C number of 6 to 30, an alkoxy group having a C number of 1 to 30, an alkoxycarbonyl group having a C number of 2 to 30, an arylkoxycarbonyl group having a C number of 7 to 30, a carbonamido group having a C number of 1 to 30, a sulfonamide group having a C number of 1 to 30, a carbamoyl group having a C number of 1 to 30, a sulfamoyl group having a C number of 0 to 30, an alkylsulfonyl group having a C number of 1 to 30, an arylsulfonyl group having a C number of 6 to 30, an ureido group having a C number of 1 to 30, a sulfamoylamino group having a C number of 0 to 30, an alkoxycarbonylamino group having a C number of 2 to 30, a heterocyclic group having a C number of 1 to 30, an acyl group having a C number of 1 to 30, an alkylsulfonyloxy group having a C number of 1 to 30, or an arylsulfonyloxy group having a C number of 6 to 30.

17. The silver halide color photographic light-sensitive material according to claim 10, wherein $R_2$ is selected from the group consisting of F, Cl, Br, I, $CH_3O$—, 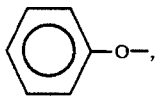

$CH_3O$— 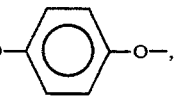 —O—, $CH_3$—, $C_2H_5$—, i-$C_3H_7$—, t-$C_4H_9$—,

-continued $CH_3OCH_2CH_2O$—, $CF_3$—, $(CH_3)_2N$—, 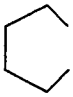 N— n-$C_4H_9O$—, n-$C_{14}H_{29}O$—, n-$C_{16}H_{33}O$—,

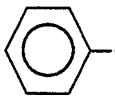 —$CH_2O$—, and n-$C_{12}H_{25}O$—.

18. The silver halide color photographic light-sensitive material according to claim 10, wherein $R_3$ is selected from the group consisting of F, Cl, Br, I, —$OCH_3$, —$OC_{12}H_{25}$, —$OC_{16}H_{33}$

—$COOCH_3$, —$COOC_{12}H_{25}$, —$COOCH(CH_3)COOC_{12}H_{25}$

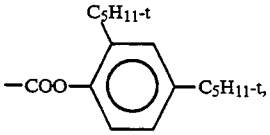

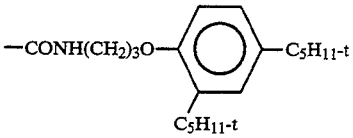

—$SO_2NH(CH_2)_3OC_{12}H_{25}$, —$SO_2N(C_8H_{17})_2$, —$SO_2N(CH_3)_2$

—$SO_2NHCOC_2H_5$, —$NHCOC_{13}H_{27}$, —$NHCOCH(C_6H_{13})C_8H_{17}$

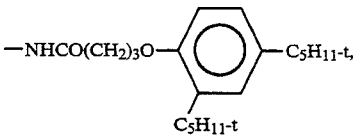

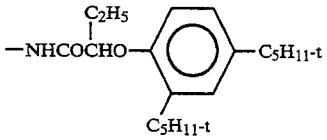

—$NHCOCH(CH_3)CH_2SO_2C_{12}H_{25}$, —$NHSO_2C_{16}H_{33}$

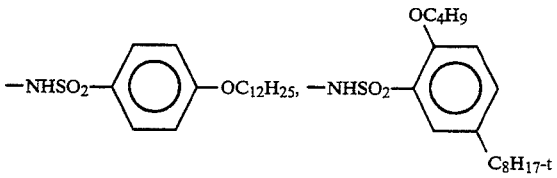

-continued
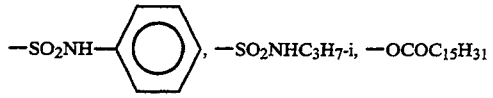
$-OSO_2C_{16}H_{33}$, $-SO_2OC_{12}H_{25}$, and $-NHCOOC_{12}H_{25}$.
19. The silver halide color photographic light-sensitive material according to claim 10, wherein X is selected from the group consisting of
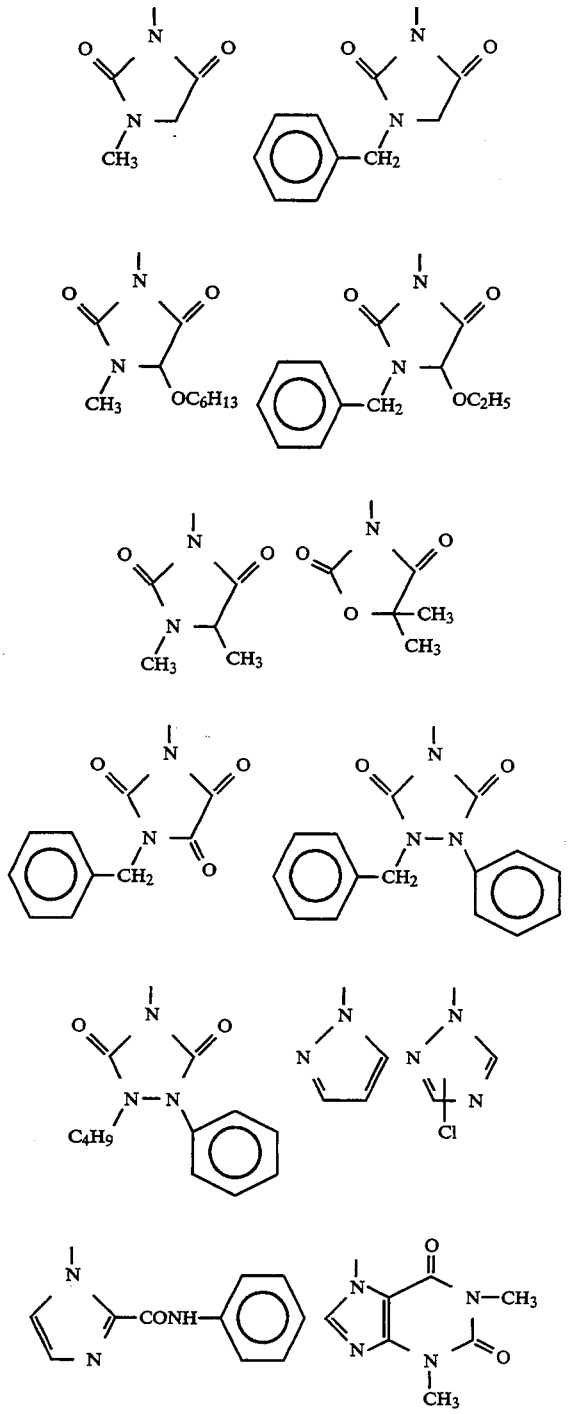
-continued
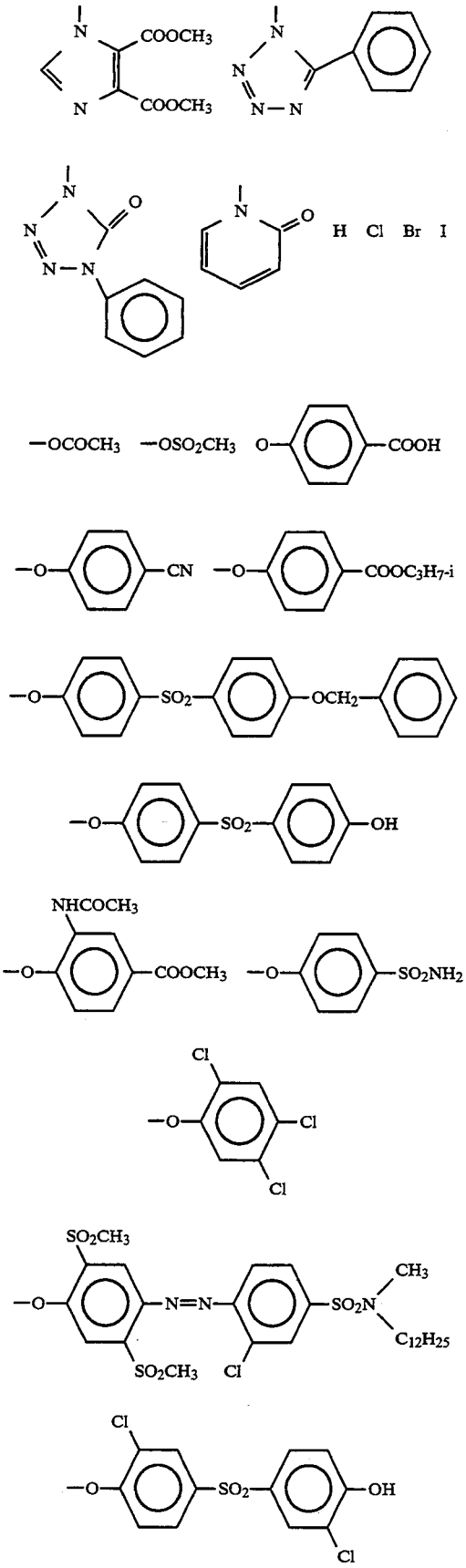

-continued

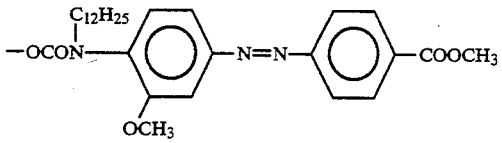

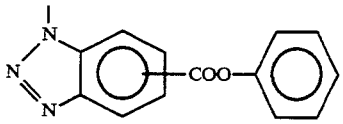

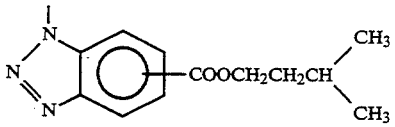

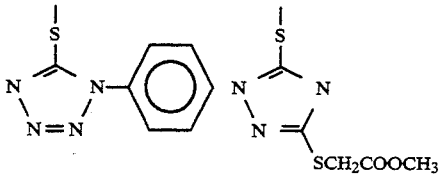

-continued

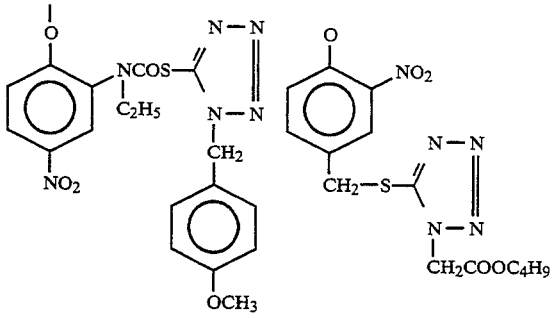

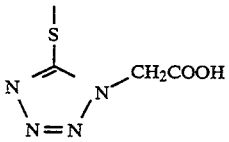

and

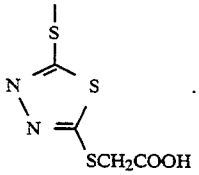

20. The silver halide color photographic light-sensitive material according to claim 10, wherein the leaving group is selected from the group consisting of a heterocyclic group, an aryloxy group, an arylthio group, an acyloxy group, an alkylsulfonyloxy group, an arylsulfonyloxy group, a heterocyclicoxy group, and a halogen atom, each attached to a coupling active position through a nitrogen atom.

* * * * *